US009739127B2

(12) United States Patent
Purkis et al.

(10) Patent No.: US 9,739,127 B2
(45) Date of Patent: Aug. 22, 2017

(54) METHOD AND SYSTEM FOR OPERATING A DOWNHOLE TOOL, FOR FRACTURING A FORMATION AND/OR FOR COMPLETING A WELLBORE

(71) Applicant: Petrowell Limited, Aberdeen (GB)

(72) Inventors: Daniel George Purkis, Aberdeen (GB); Stephen Reid, Aberdeen (GB)

(73) Assignee: Petrowell Limited, Aberdeen (GB)

( * ) Notice: Subject to any disclaimer, the term of this patent is extended or adjusted under 35 U.S.C. 154(b) by 139 days.

(21) Appl. No.: 14/390,309

(22) PCT Filed: Apr. 3, 2013

(86) PCT No.: PCT/GB2013/050880
§ 371 (c)(1),
(2) Date: Oct. 2, 2014

(87) PCT Pub. No.: WO2013/150304
PCT Pub. Date: Oct. 10, 2013

(65) Prior Publication Data

US 2015/0053408 A1 Feb. 26, 2015

(30) Foreign Application Priority Data

Apr. 3, 2012 (GB) ..... 1205985.3

(51) Int. Cl.
*E21B 34/14* (2006.01)
*E21B 43/26* (2006.01)
(Continued)

(52) U.S. Cl.
CPC ..... *E21B 43/26* (2013.01); *E21B 17/04* (2013.01); *E21B 23/02* (2013.01); *E21B 34/14* (2013.01);
(Continued)

(58) Field of Classification Search
CPC ..... E21B 23/00; E21B 34/06; E21B 34/12; E21B 34/14; E21B 43/26
See application file for complete search history.

(56) References Cited

U.S. PATENT DOCUMENTS 7,377,322 B2 5/2008 Hofman
7,556,102 B2 7/2009 Gomez
(Continued)

OTHER PUBLICATIONS

Examination Opinion and Search Report received in corresponding Great Britain Application No. GB1306034.8, dated Sep. 18, 2013.
(Continued)

*Primary Examiner* — Catherine Loikith
(74) *Attorney, Agent, or Firm* — Blank Rome LLP

(57) ABSTRACT

Systems and methods for use in wellbore completion and/or for operating a downhole tool, such as a downhole tool associated with well fracturing, include a tool assembly having a lower packer, an upper packer, a first downhole tool in the form of a flow control device, a second downhole tool in the form of a fracture tool, a plurality of production tools and a plurality of screens. Each tool assembly includes or is associated with a downhole actuator in the form of a shifting tool which is operable to actuate one or more of the first downhole tool, second downhole tool or production tools in use. The actuator may be disposed on, or operatively associated with a string, such as a tubular string. All operations are performed with a body of the shifting tool in tension.

39 Claims, 33 Drawing Sheets

(51) Int. Cl.

| | |
|---|---|
| ***E21B 23/02*** | (2006.01) |
| ***E21B 17/04*** | (2006.01) |
| ***E21B 43/14*** | (2006.01) |
| *E21B 34/00* | (2006.01) |

(52) U.S. Cl.
CPC ..... *E21B 43/14* (2013.01); *E21B 2034/007* (2013.01)

(56) References Cited

U.S. PATENT DOCUMENTS

| | | | | |
|---|---|---|---|---|
| 7,637,317 | B1 | 12/2009 | Hernandez | |
| 2009/0294124 | A1 | 12/2009 | Patel | |
| 2010/0108323 | A1 | 5/2010 | Wilkin | |
| 2011/0203807 | A1 | 8/2011 | Hofman | |
| 2012/0048559 | A1 | 3/2012 | Ganguly et al. | |
| 2012/0234534 | A1* | 9/2012 | Hughes ..... | E21B 33/05 166/255.1 |

OTHER PUBLICATIONS

Partial Search Report received in corresponding PCT Application No. PCT/GB2013/050880, dated Jul. 28, 2014.
International Search Report and Written Opinion received in corresponding PCT Application No. PCT/GB2013/050880, dated Oct. 14, 2014.

* cited by examiner 36
65
62c
61
121
62b
62a
127
60
67
122
124
120
34
18

36
65
121
60
173
67
172
173
171
178

171
65
121
61
60
173
172
122
173
178
18

121
61
60
124
18

METHOD AND SYSTEM FOR OPERATING A DOWNHOLE TOOL, FOR FRACTURING A FORMATION AND/OR FOR COMPLETING A WELLBORE

FIELD OF THE INVENTION

This invention relates to systems and methods for use in wellbore completion. In particular, but not exclusively, embodiments of the invention relate to a method and system for operating a downhole tool, such as a downhole tool associated with well fracturing.

BACKGROUND TO THE INVENTION

In the oil and gas exploration and production industry, well boreholes are drilled from surface in order to access subsurface hydrocarbon-bearing formations. A tubular string, such as a completion string, may be run into the borehole and operable to perform a number of different operations in the borehole. One operation which may be carried out in the borehole is hydraulic fracturing, which involves the injection of fluid into the formation to propagate fractures in the formation rock and increase flow of hydrocarbons into the borehole for extraction. In use, one or more fracturing tools may be run into the borehole with the completion string and located adjacent to the formation. Fluid may then be directed through ports in a sidewall of the fracturing tool and injected into the formation. In some instances, a number of fracturing tools may be located at different axially spaced positions in the completion string and configured to facilitate fracturing of multiple and/or selected formation zones.

Completion strings are becoming ever more complex, with the various completion string tools utilising a variety of activation mechanisms, forces and pressures. At the same time, there is a significant drive to improve the effectiveness and reliability of tools which are deployed and operated in a downhole environment, for example to ensure that the tools operate at maximum efficiency, have minimum risk of failure or imprecise operation, can be flexible according to operator requirements, and minimise any necessary remedial action, associated time delays and costs.

In some applications, shifting tools can be used for mechanical actuation of downhole tools. Typically, shifting tools are attached to a work string and can be used during completion of a well to open, close or otherwise shift the position of downhole flow control or circulation devices, such as sliding sleeves. In order to perform a mechanical actuation, the shifting tool is manipulated (via the work string) from surface. Typically, actuation is achieved by locking the shifting tool onto profiles provided on the downhole tools and performing a combination of the following operations: pulling (work string in tension) pushing (work string in compression), jarring or rotating to deliver the necessary force or impact to the tool with which it is engaged.

As will be appreciated, however, it can be difficult to accurately control the operations of the shifting tool especially when it is situated at the end of several kilometers of work string and/or the shifting tool is located in a horizontal or highly deviated wellbore. In these situations it is usually not possible to accurately predict at surface whether the intended actuation has been successful. An additional disadvantage of these conventional shifting tools is the difficulty of use. For example, jarring down or slacking off to cause compression of the work string risks that the work string will 'catch' on other downhole tools or land on an unintended component with significant force thereby causing damage.

SUMMARY OF THE INVENTION

According to a first aspect of the present invention, there is provided a method for operating a downhole tool, the method comprising the steps of:

(a) locating an actuator downhole from a downhole tool;

(b) pulling the actuator uphole;

(c) engaging the downhole tool with the actuator;

(d) pulling the actuator uphole to perform a first operation of the downhole tool;

(e) changing the configuration of at least one of the downhole tool and the actuator; and (f) pulling the actuator to perform a second operation of the downhole tool.

Embodiments of the present invention may permit operations to be carried out on a downhole tool or a plurality of downhole tools which require only the application of a pulling force or tensile force to the actuator. Since embodiments of the invention do not require push forces to be applied from surface, the operations can be accurately controlled, even where the downhole tool and the actuator is located in a horizontal or highly deviated wellbore many kilometers from surface. Moreover, the likelihood of buckling or of the actuator becoming 'hung-up' or caught on the downhole tool may be reduced or eliminated.

The actuator may be disposed on, or operatively associated with a string, such as a tubular string. In particular embodiments, the string may comprise a washpipe string or the like. Providing a washpipe string permits fluid to be directed through the string. However, it will be understood that other suitable conveyance arrangements may be provided where required.

The method may comprise locating the downhole tool downhole.

The downhole tool may be configured to be selectively engagable with the actuator.

Any suitable means for changing the configuration of the downhole tool may be used.

In some embodiments, the method may comprise circulating fluid downhole to change the configuration of at least one of the downhole tool and the actuator.

Alternatively or additionally, the method may comprise changing the configuration of at least one of the downhole tool and the actuator mechanically.

The method can include the additional step of: (g) maintaining a body of the actuator in tension throughout steps (b)-(f).

Maintaining a body of the actuator in tension can be defined as not pushing the body of the actuator in the downhole direction.

The method can include the additional step of: (g) maintaining the string in tension throughout steps (b)-(f).

Maintaining the string in tension can be defined as not applying a pushing force to the string. Maintaining the string in tension can include maintaining a force at surface greater than or equal to 0 lbs (0 kN).

Step (g) can include maintaining a force at surface of between 2 lbs (0 kN) and 20,000 lbs (90 kN) throughout steps (b)-(f). Step (g) can include maintaining a force of between 20 lbs (89 N) and 10,000 lbs (44 kN) throughout steps (b)-(f). Step (g) can include maintaining a force of between 50 lbs (222 N) and 10,000 lbs (44.5 kN) throughout steps (b)-(f).

A minimum force of at least 20 lbs (89 N) can be maintained throughout the method steps. Alternatively a minimum force of at least 50 lbs (222 N) can be maintained throughout all the method steps.

The method may comprise operating another downhole tool.

The method can include the further step of: (h) disengaging the actuator and the downhole tool.

The method can include: locating another downhole tool uphole relative to the first downhole tool; and repeating the steps (b) to (g) downhole and thereby operating another downhole tool.

The method can include the steps of providing a plurality of downhole tools arranged in series and successively operating the downhole tools by repeating steps (b)-(g).

The string can be continuously maintained in tension throughout operation of the plurality of downhole tools. Thus the string can be continuously maintained in tension throughout the method of the invention. This ensures that an operator at surface always has a positive indication of the location of the actuator and an accurate log of the operation of the tool since every action requires a positive step (i.e. pulling or circulation) in order to perform a subsequent operation.

The method can include allowing an actuator to pass within the throughbore of the downhole tool without engaging the tool in a first direction and engaging the actuator with the downhole tool in a second direction. The first direction can be a downhole direction and the second direction can be an uphole direction.

The method can include providing co-operable engagers on each of the at least one of the downhole tools and the actuator such that pulling the actuator in an uphole direction within the throughbore of the downhole tool engages the downhole tool and the actuator.

Thus, step (c) can be achieved by pulling the actuator in an uphole direction.

The method can include running the string and attached actuator within the throughbore of the, or each, downhole tool to a location downhole from the lowermost downhole tool such that the actuator passes through the or each tool without engaging the tool. Co-operable engagers provided on the downhole tool and the actuator can be engagable in the uphole direction and non engagable in the downhole direction.

Alternatively, the method can include making up downhole tubing containing the downhole tool and simultaneously inserting the string and attached actuator within the throughbore defined by the downhole tool and running the a downhole tool and actuator downhole simultaneously. In this case, the engager provided on the actuator is located downhole from the engager on the lowermost downhole tool.

The method can include pulling the string with a predetermined minimum force to perform a first operation of the downhole tool.

The pulling force applied to the string can be transferred to the tool via the co-operable engagers engaging the actuator and the downhole tool.

The predetermined minimum force can be between 8,000 lbs (36 kN) and 20,000 lbs (89 kN). The predetermined force can be around 10,000 lbs (44 kN). The predetermined minimum force can be in the range between 9,000 lbs (40 kN) and 15,000 lbs (67 kN).

The string can be pulled with a predetermined minimum force calculated to exceed the force required to displace a retainer retaining a first portion of the downhole tool relative to a second portion of a downhole tool. The retainer can be a shear pin or shear ring and the minimum predetermined force can be greater than the rating of the shear pin or ring.

The first operation of step (d) can include moving a first portion of the downhole tool relative to a second portion of the downhole tool.

The first portion of the downhole tool can be an opening sleeve and the second portion of the downhole tool can be the housing.

The first operation of step (d) can include opening a circulation path downhole.

The circulation path opened by the first operation can allow fluid communication between the throughbore and the exterior of the downhole tool. The operation of step (d) can include opening a port in the downhole tool.

The method can further include pumping fracturing fluid downhole and directing fracturing fluid out through at least one port of the downhole tool. The downhole tool can be a fracture tool.

The method can include pumping fracturing fluid within the throughbore and out through the ports and thereby fracturing a geological formation surrounding the tool.

Prior to step (e), the method can include locking the actuator and the downhole tool in a configuration in which performance of the second operation is restricted.

The method can include locking the actuator and the downhole tool before, during or throughout step (c) and/or step (d).

The method can include locking the actuator to the downhole tool and retaining the tool in the configuration following performance of the first operation thereby restricting performance of the second operation.

The method can include circulating fluid downhole and thereby unlocking the actuator and the downhole tool.

The method can include circulating fluid downhole in step (e) to cause a pressure differential across a portion of at least one of the downhole tool or the actuator to thereby change the configuration of the downhole tool or actuator.

According to one embodiment, the pressure differential across a portion of at least one of the downhole tool or the actuator can act on an exposed piston area to thereby move the piston and unlock the actuator and the downhole tool.

Step (d) can include circulating fluid in an annulus between an inner diameter of the downhole tool and an outer portion of the string.

The method can include pulling the string with a predetermined minimum force to perform a second operation of the downhole tool.

Step (f) can be achieved by pulling the actuator in an uphole direction. The predetermined minimum force can be between 8,000 lbs (36 kN) and 20,000 lbs (89 kN).

The predetermined force can be around 10,000 lbs (44 kN). The predetermined minimum force can be in the range between 9,000 lbs (40 kN) and 15,000 lbs (67 kN).

The string can be pulled with a predetermined minimum force calculated to exceed the force required to displace a retainer retaining a third portion of the downhole tool relative to a fourth portion of the downhole tool. The retainer can be a shear pin or a shear ring and the minimum predetermined force can be greater than the rating of the shear pin or ring.

The operation of step (f) can include moving a third portion of the downhole tool relative to a fourth portion of the downhole tool.

The third portion of the downhole tool can be a closing sleeve and the fourth portion of the downhole tool can be the housing.

The operation of step (f) can include closing a fluid flow path in the downhole tool.

The fluid flow path between the throughbore and the exterior of the tool can be closed by the second operation. A port within the downhole tool can be obturated by the second operation and this can be the same port that was opened by the first operation of the downhole tool.

Step (h) can include pulling on the string and thereby disengaging the actuator from the downhole tool.

The method can include pulling the string uphole and thereby decoupling the co-operable engagers on the downhole tool and the actuator.

The method can further include providing an engager on the actuator and biasing the engager radially outwardly such that step (b) causes step (c). The method can include disengaging the actuator from the downhole tool by moving the engager radially inwardly.

According to a second aspect of the present invention, there is provided a system for operating a downhole tool comprising:

an actuator for coupling to a string, the actuator configured to pass through a downhole tool, wherein the actuator is selectively engagable with the downhole tool, such that in an engaged position a predetermined minimum tensile force applied to the actuator is transferred to the downhole tool to perform a first operation and a second operation, and a lock provided on at least one of the downhole tool and the actuator, wherein the lock is operable between an activated configuration in which performance of the second operation of the downhole tool is restricted and a deactivated configuration, wherein the lock is activated on performance of the first operation of the tool and deactivated by changing the configuration of at least one of the actuator and the downhole tool.

Changing the configuration of at least one of the actuator and the downhole tool may be performed by any suitable means.

In some embodiments, changing the configuration of at least one of the actuator and the downhole tool may be performed by circulation of fluid downhole.

In other embodiments, changing the configuration of at least one of the actuator and the downhole tool may be performed mechanically.

The system may comprise the downhole tool. The downhole tool may comprise a throughbore.

A body of the actuator can be arranged to be maintained in tension throughout the operation of the downhole tool.

The actuator can be configured to operate a plurality of downhole tools.

The lock can be activated before, during or following performance of the first operation.

The lock can be activated on initial engagement of the actuator and the downhole tool.

The lock can be deactivated by a pressure differential controllable by circulation of fluid downhole.

The downhole tool and actuator can be provided with co-operable engagers for selective engagement.

The co-operable engagers can be arranged to engage the downhole tool and the actuator in a first uphole direction. The co-operable engagers can allow the actuator to pass within the throughbore of the downhole tool without engaging the two components in a downhole direction.

The first and second operations of the downhole tool can be performed in response to a tensile force above a predetermined force.

The first operation of the tool can cause a first portion of the tool to move relative to a second portion of the tool. The first portion of the tool can be an opening sleeve and the second portion of the tool can be a housing.

The first operation of the tool can cause a circulation path to open in the downhole tool. The first operation can cause a port to open a circulation path between the throughbore of the downhole tool and the exterior of the tool.

The second operation of the tool can cause a third portion the tool to move relative to a fourth portion of the tool. The third portion of the tool can be a closing sleeve and the fourth portion of the tool can be a housing.

The second operation of the tool can cause a flow path between the throughbore and the exterior of the downhole tool to close. The second operation can close at least one port in the downhole tool. The port can be configured for pumping fracture fluid therethrough. The port can be surrounded by hard material such as a ceramic so that fracture fluid passing therethrough will not erode material defining the port opening.

Embodiments of the first aspect of the invention are also applicable to the second aspect of the invention and vice versa where appropriate.

According to a third aspect of the invention there is provided an actuator for operating a downhole tool comprising, a coupling means for coupling the actuator to a string, an engager co-operable with an engager on the downhole tool such that a tensile force applied to the actuator in use is translated to the downhole tool to perform a first operation and a second operation of the downhole tool, the actuator further comprising an actuator lock portion that is operable between an activated configuration following performance of the first operation to resist performance of the second operation of the downhole tool, and a deactivated configuration in which performance of the second operation is no longer restricted, and wherein a body of the actuator is arranged to be maintained in tension in use.

The lock portion may be operable in response between the activated configuration following performance of the first operation to resist performance of the second operation of the downhole tool, and the deactivated configuration to downhole fluid circulation in response to downhole fluid circulation.

The actuator can be a mechanical actuator such as a shifting tool. The actuator can cause performance of the first and/or second operations of the downhole tool by axial displacement of the actuator in response to an applied minimum tensile force to the actuator.

Forces can be transferred to the actuator via the string.

The actuator can be a fracture system actuator. The downhole tool can be a fracture sleeve.

The body of the actuator can be arranged to be in tension throughout the operation.

According to a fourth aspect of the invention, there is provided a downhole tool arranged for operation by an actuator, the downhole tool comprising, an engager co-operable with an engager on the actuator such that application of a predetermined minimum tensile force to the actuator in use is translated to the downhole tool to perform a first operation and a second operation of the downhole tool, the downhole tool further comprising a downhole tool lock portion that is operable between an activated configuration following performance of the first operation to resist performance of the second operation of the downhole tool, and a deactivated configuration in which performance of the second operation is no longer restricted.

The lock portion may be operable in response between the activated configuration following performance of the first operation to resist performance of the second operation of the downhole tool, and the deactivated configuration to downhole fluid circulation in response to downhole fluid circulation.

The engagers on each of the downhole tool and actuator can be arranged to cooperate such that application of a tensile force to the actuator translates tensile force to the downhole tool. The application of a predetermined tensile force to the actuator can cause relative movement of the first part of the downhole tool relative to a second part of the downhole tool. The second part of the downhole tool can remain stationary and can be an outer housing. The relative movement of first and second parts of the tool can be relative axial movement. The relative axial movement can be in an uphole direction.

The engager on the actuator can be radially displaced to selectively disengage a downhole tool. The engager on the actuator can be movable between a radially outward position and a radially inward position. The engager provided on the actuator can be biased into the radially outward position. The engager can be biased by a biasing means such as a spring.

The co-operable engager on the downhole tool can be a profiled section. The co-operable engager provided on the actuator can be a keyway.

The first and second operations of the downhole tools can be the opening and closing of a circulation sleeve to create a selective flow path between the throughbore and the exterior of the downhole tool.

The engager on the downhole tool can be coupled to a sleeve assembly. The sleeve assembly can comprise an opening sleeve and a closing sleeve. The opening sleeve can be movable to uncover a port in the downhole tool in the first operation.

The closing sleeve can be movable to cover the port in the downhole tool in performance of the second operation. Performance of the second operation is restricted by the presence of the activated lock and therefore performance of the second operation is dependent upon circulation of fluid from surface to deactivate the lock.

The string can be any line or pipe that is capable of being run downhole within a conduit. The string can be at least partially hollow or solid in cross section. Examples of such a string include washpipe, workstring or coiled tubing.

Circulation of fluid within an annulus between the actuator and the downhole tool can cause a pressure differential between the throughbore of the string and the annulus. One lock portion can include a piston having one piston area exposed to annulus pressure and an opposing piston area exposed to throughbore pressure. Thus, deactivation of the lock can include movement of a locking portion located on at least one of the actuator and the downhole tool by moving a piston in response to a throughbore/annulus pressure differential. Another lock portion provided on at least one of the actuator and the downhole tool can be a protrusion located in a recess. In an activated configuration, the protrusion can be held by the piston against movement out of the recess. In the deactivated configuration, the protrusion can be movable outwith the recess thereby to deactivate the lock and allow the second operation to proceed.

Embodiments of the first and second aspects of the invention are also applicable to the third and fourth aspects of the invention where appropriate and vice versa.

One advantage of the tool is that all port opening and closing is achieved by mechanical means i.e. through pull operations to apply a tensile force to the tool and fluid circulation from surface.

According to a fifth aspect of the invention, there is provided a method for fracturing a formation including the steps of:

(a) coupling a mechanical shifting tool to a string and locating the shifting tool downhole;

(b) applying a tensile force to the string and shifting tool to open at least one fracturing fluid flow path;

(c) pumping fracturing fluid downhole along the fracturing fluid flow path to thereby fracture a formation; and (d) applying a tensile force to the string and the shifting tool to close the fluid flow path.

The method may comprise locating tubing downhole comprising at least one selective fracturing fluid flow path downhole.

The method can include maintaining a body of the mechanical shifting tool in tension throughout steps (b)-(d).

The method can include maintaining the string in tension throughout steps (b)-(d).

The method can include fracturing a formation in a plurality of zones by repeating steps (b)-(d) for successive zones.

The method can include the steps of:

locating an alternative selective circulation path downhole along the tubing;

coupling a second shifting tool to the string and locating the second shifting tool downhole from the first shifting tool;

applying a tensile force to the string and shifting tools to open the circulation path with the first shifting tool;

flowing fluid along the alternative circulation path; and applying a tensile force to the string and shifting tools to close the alternative circulation path with the second shifting tool.

The alternative circulation path can be a reverse circulation path and the step of flowing fluid along the alternative circulation path includes returning at least some fracturing fluid to surface. Particulates that have fallen out from suspension in the fracturing fluid, such as proppant or sand can be recovered to surface to clear the throughbore of the string.

The method can include restricting performance of step (d) until fluid is circulated within the annulus between the string and the tubing.

According to a sixth aspect of the present invention there is provided a downhole completion method, comprising:

deploying a downhole system into a wellbore, wherein the downhole system includes a completion system and an activator tool mounted within the completion system; and withdrawing the activator tool from the completion system to operate at least a portion of the completion system.

According to a seventh aspect of the present invention there is provided a downhole completion system, comprising:

a downhole system deployable into a wellbore, wherein the downhole system includes a completion system and an activator tool mounted within the completion system, wherein the activator tool is configured to be withdrawn from the completion system to operate at least a portion of the completion system.

The activator tool may comprise an actuator according to any preceding aspect.

The activator tool may comprise a mechanical actuator. The activator tool may comprise a shifting tool. The actuator can cause performance of the first and/or second operations of the downhole tool by axial displacement of the actuator in response to an applied minimum tensile force to the actuator.

The activator tool may be disposed on a tubular string.

The tubular string may comprise a washpipe string or the like.

However, it will be understood that other conveyance means may be used where appropriate.

The activator tool may comprise a mandrel. A flow path may be defined through the shifting tool.

The activator tool may comprise a lateral flow passage or flow port.

The activator tool may comprise an upper shifter assembly. The upper shifter assembly may comprise a keyway.

The activator tool may comprise a lock assembly. The lock assembly may be operatively associated with the upper keyway assembly.

The activator tool may comprise a lower shifter assembly. The lower shifter assembly may comprise a keyway.

The lower keyway assembly may be axially spaced from the upper keyway assembly.

The upper keyway assembly may be located in a recess in the mandrel.

The upper keyway assembly may comprise a shifting key.

In use, the key may be moveable between a radially retracted position and a radially extended position. The key may be biased radially outwards, for example by one or more spring. The key may be disposed in a seat. A downhole seat surface may define a wedge profile.

An outer surface of the key may be profiled. In use, the key profile may be configured to engage a corresponding profile in a downhole tool.

An annular collar may be disposed around and may be axially moveable relative to the mandrel. The collar may be arranged to partially extend over a downhole end of the key. An uphole end of the collar may extend over the key. For example, the key may comprise one or more ledge, the ledge being engageable with the collar to retain the key in the radially retracted position.

The collar may be biased towards a first axial position relative to the mandrel. The collar may be biased towards the first axial position by a spring.

The collar may be moved from the first axial position to a second axial position. The collar may be moved from the first axial position to the second axial by directing fluid into a chamber. The chamber may be defined between the collar and the mandrel. The chamber may receive fluid via a passage.

In use, fluid may be directed to the chamber to urge the collar axially away from the key and so permits the key to move from its radially retracted position to its radially extended position.

The system may comprise a control system. The control system may comprise a control unit operatively associated with the actuator.

The control system may be configured to control fluid passage to the chamber.

The system may comprise an indicator. The indicator may be operatively associated with or form part of the control system.

The indicator may be of any suitable form. The indicator may comprise an electromagnetic element. The indicator may comprise an electromagnetic inductance coil.

The indicator may be configured for electromagnetic coupling to an indicator of the downhole tool.

In use, the control system may receives an indication in the form of an induced signal from the indicator to indicate that the actuator has passed the indicator of the downhole tool, the control system initiating the flow of fluid into the chamber to shift the collar and permit the key to move from its radially retracted position to its radially extended position.

The system may comprise a lock assembly.

The lock assembly may comprise a first lock. The first lock may comprise one or more dog, snap ring or the like.

The lock assembly may comprise a second lock. The second lock may comprise one or more dog, snap ring or the like.

At least one of the first lock and the second lock may initially be configured in a radially extended configuration.

At least one of the first lock and the second lock may be configured to move from the radially extended configuration to a radially retracted configuration. Any suitable means for moving at least one of the first lock and the second lock may be employed. For example, at least one of the first lock and the second lock may be moved by at least one of a mechanical arrangement, a hydraulic arrangement or the like. In particular embodiments, a piston assembly may be provided to move at least one of the first lock and the second lock from the radially extended configuration to the radially retracted configuration.

In use, the first lock and the second lock may be configured to move from the extended configuration to the retracted configuration sequentially. For example, movement of the piston assembly may first de-supports the first lock and then the second lock.

The system may receive power from surface. In particular embodiments, the system may comprise a downhole power source. The power source may comprise a battery or the like.

The system may comprise a pump for directing fluid into the chamber.

The downhole system may comprise at least one packer.

The system may comprise a plurality of packers. For example, the system may comprise a first packer. The first packer may be of any suitable form and construction. In particular embodiments, the first packer may comprise a sump packer. The system may comprise a second packer. The first packer may be of any suitable form and construction. In particular embodiments, the second packer may comprise a CZI Packer from Petrowell Limited.

The completion system may comprise a downhole tool. Operating at least a portion of the completion system may comprise operating the downhole tool. Operating at least a portion of the completion system may comprise performing a plurality of operations on the downhole tool.

The completion system may comprise a plurality of downhole tools.

A first downhole tool may comprise a flow control device.

The first downhole tool may comprise a sliding sleeve device.

The first downhole tool may comprise one or more lateral flow passage or flow port.

The first downhole tool may a sleeve.

In use, the first downhole tool may be actuable between a closed configuration in which fluid flow through the flow port or passage is permitted or restricted and an open configuration in which fluid flow through the flow port or passage is permitted.

The first downhole tool may comprise at least one centraliser blade. In particular embodiments, first downhole tool may comprise a plurality circumferentially spaced and radially extending centraliser blades. In use, the or each centraliser blade may offset the first downhole tool from a surrounding casing or bore wall.

The first downhole tool may comprise a collet. The collet may be formed or otherwise provided in the sleeve of the first downhole tool.

The first downhole tool may comprise an identifier. The identifier may comprise an electromagnetic element. In particular embodiments, the identifier may an electromagnetic coil, such as an inductor coil or element.

The first downhole tool may comprise a profile for engaging the activator tool. The profile may comprise a keyway profile.

In use, engagement between the profile and the activator tool may move the first downhole tool from a closed configuration to an open configuration.

The first downhole tool may comprise a retainer. The retainer may comprise one or more shear pin or the like. In use, the retainer may be used to initially axially secure the sleeve.

A second downhole tool may comprise a fracture tool.

The second downhole tool may comprise a sliding sleeve device.

The second downhole tool may comprise one or more lateral flow passage or flow port. In particular embodiments, the second downhole tool may comprise a plurality of lateral flow passages or flow ports.

In use, the second downhole tool may be actuable between a closed configuration in which fluid flow through the passage or port is prevented or restricted and an open configuration in which fluid flow through the passage or port is permitted.

The second downhole tool may comprise a collet. The collet may be formed or otherwise provided in the sleeve of the second downhole tool.

The second downhole tool may comprise an identifier. The identifier may comprise an electromagnetic element. In particular embodiments, the identifier may an electromagnetic coil, such as an inductor coil or element.

The second downhole tool may comprise a profile for engaging the activator tool. The profile may comprise a keyway profile.

In use, engagement between the profile and the activator tool may move the second downhole tool from a closed configuration to an open configuration.

The second downhole tool may comprise a retainer. The retainer may comprise one or more shear pin or the like. In use, the retainer may be used to initially axially secure the sleeve.

According to an eighth aspect of the present invention, there is provided a method for operating a downhole tool, the method comprising the steps of:

(a) locating an actuator downhole;

(b) moving the actuator relative to the downhole tool;

(c) engaging the actuator with the downhole tool;

(d) moving the actuator to perform a first operation of the downhole tool;

(e) changing the configuration of at least one of the downhole tool and the actuator; and (f) moving the actuator to perform a second operation of the downhole tool.

According to a further aspect of the present invention there is provided a method for operating at least one downhole tool, the method comprising the steps of:

(i) locating a tool downhole, the tool defining a throughbore, wherein the tool is adapted to be selectively engagable with an actuator;

(ii) locating a string comprising an actuator downhole from the tool;

(iii) pulling the string uphole;

(iv) engaging the downhole tool with the actuator;

(v) pulling the string to perform a first operation of the downhole tool;

(vi) circulating fluid downhole to change the configuration of at least one of the downhole tool and the actuator; and (vii) pulling the string and attached actuator to perform a second operation of the downhole tool.

According to a further aspect of the present invention there is provided a system for operating a downhole tool, the system comprising, at least one downhole tool having a throughbore, an actuator for coupling to a string, the actuator dimensioned to pass within the throughbore of the at least one of the downhole tool, wherein the actuator and the at least one downhole tool are selectively engagable, such that in an engaged position a predetermined minimum tensile force applied to the actuator is transferred to the downhole tool to perform a first operation and a second operation, the system further comprising a lock provided on at least one of the downhole tool and the actuator, wherein the lock is operable between an activated configuration in which performance of the second operation of the downhole tool is restricted and a deactivated configuration, wherein the lock is activated on performance of the first operation of the tool and deactivated by circulation of fluid downhole.

According to a further aspect of the invention there is provided an actuator for operating a downhole tool comprising, a coupling means for coupling the actuator to a string, an engager co-operable with an engager on the downhole tool such that a tensile force applied to the actuator in use is translated to the downhole tool to perform a first operation and a second operation of the downhole tool, the actuator further comprising an actuator lock portion that is operable between an activated configuration following performance of the first operation to resist performance of the second operation of the downhole tool, and a deactivated configuration in response to downhole fluid circulation in which performance of the second operation is no longer restricted, and wherein a body of the actuator is arranged to be maintained in tension in use.

According to a further aspect of the invention, there is provided a downhole tool arranged for operation by an actuator, the downhole tool comprising, an engager co-operable with an engager on the actuator such that application of a predetermined minimum tensile force to the actuator in use is translated to the downhole tool to perform a first operation and a second operation of the downhole tool, the downhole tool further comprising a downhole tool lock portion that is operable between an activated configuration following performance of the first operation to resist performance of the second operation of the downhole tool, and a deactivated configuration in response to downhole fluid circulation in which performance of the second operation is no longer restricted.

According to a further aspect of the invention, there is provided a method of fracturing a formation including the steps of:

(i) locating tubing downhole comprising at least one selective fracturing fluid flow path downhole;

(ii) coupling a mechanical shifting tool to a string and locating the shifting tool downhole;

(iii) applying a tensile force to the string and shifting tool to open the fracturing fluid flow path;

(iv) pumping fracturing fluid downhole along the fracturing fluid flow path to thereby fracture a formation; and (v) applying a tensile force to the string and shifting tool to close the fluid flow path.

It should be understood that the features defined above in accordance with any aspect of the present invention or below in relation to any specific embodiment of the invention may be utilised, either alone or in combination with any other defined feature, in any other aspect or embodiment of the invention.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figures 1A, 1B:
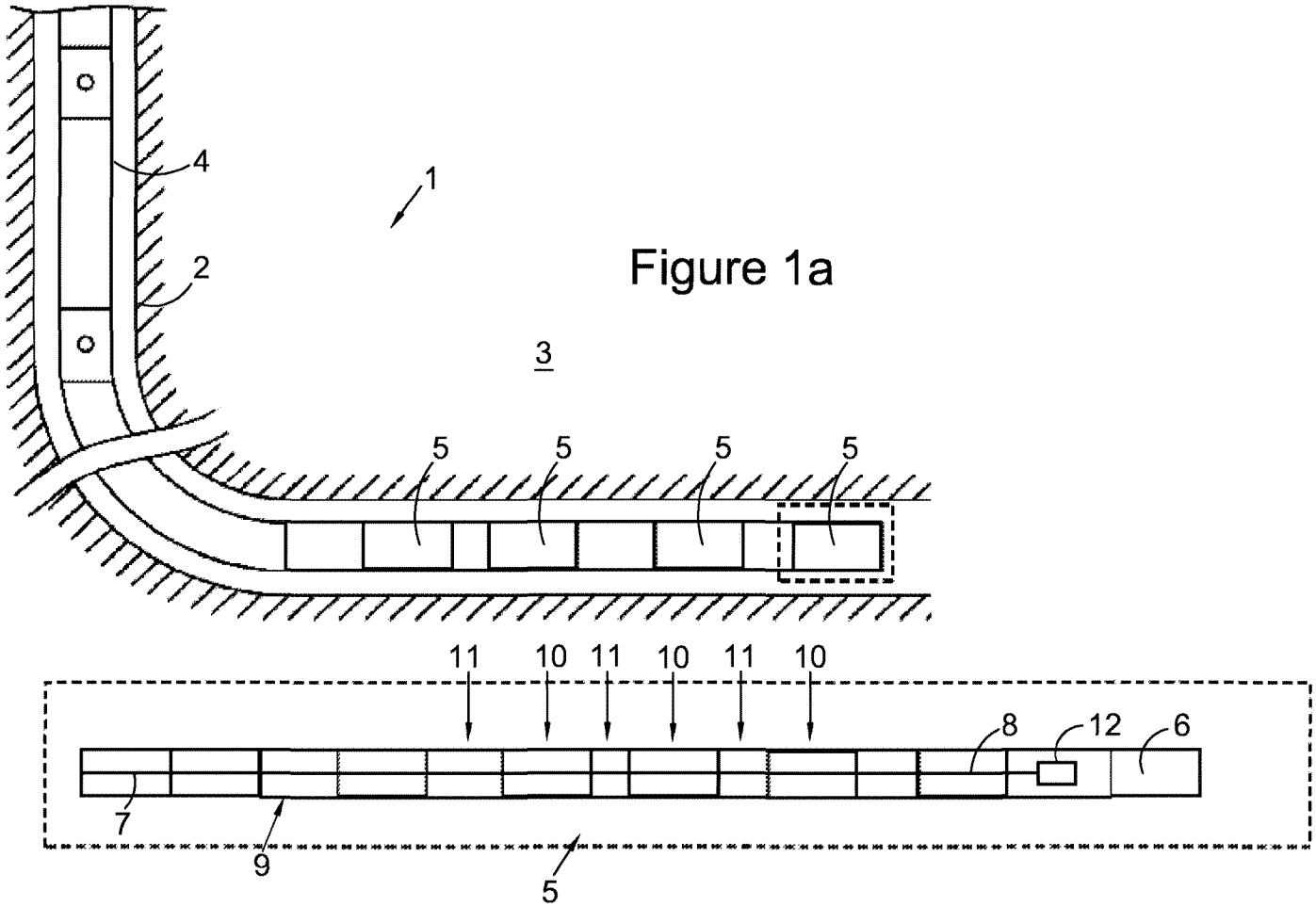
FIG. 1*a* is diagrammatic view of a wellbore system according to an embodiment of the present invention.
FIG. 1*b* is a diagrammatic view of a tool assembly of the wellbore system shown in FIG. 1*a;*

FIG. 1*a* shows a diagrammatic view of a wellbore system 1 according to an embodiment of the present invention. The wellbore system 1 includes a drilled borehole 2 which intercepts a subterranean reservoir or formation 3. The formation 3 may contain hydrocarbons to be produced to surface via the well system 1. Alternatively, or additionally, the subterranean formation 3 may define a target for receiving a fluid injected from surface via the wellbore system 1, for example for increasing formation pressure to improve production of hydrocarbons from the formation 3 or a neighbouring formation, for sequestration purposes, or the like.

Following drilling of the borehole 2, or following a period of production/injection, the formation 3 may require stimulation or treatment to permit improved production or injection rates to be achieved or restored. Known stimulation techniques include hydraulic fracturing which involves injecting a fracturing fluid into the formation at high pressure and/or flow rates to create mechanical fractures within the geology. These fractures may increase the effective near-wellbore permeability and fluid connectivity between the formation 3 and wellbore. The fracturing fluid may carry proppant material, which functions to prop open the fractures when the hydraulic fracturing pressure has been removed. Matrix stimulation provides a similar effect as hydraulic fracturing. This typically involves injecting a chemical such as an acid, for example hydrochloric acid, into the formation to chemically create fractures or wormholes in the geology. Such matrix stimulation may have application in particular geology types, such as in carbonate reservoirs.

In most stimulation or treatment regimes it is necessary to provide the ability to inject a treatment fluid into the formation 3 via wellbore tools and infrastructure and embodiments of the present invention permit such injection to be achieved. In this respect, a tubular string 4 extends through the borehole 2, wherein the tubular string 4 comprises a plurality of tools or tool assemblies 5 distributed along its length at desired interval spacing.

An exemplary tool assembly 5 is shown in FIG. 1*b*. In the illustrated embodiment, the tool assembly 5 includes a lower packer 6, an upper packer 7, a first downhole tool 8 in the form of a flow control device, a second downhole tool 9 in the form of a fracture tool, a plurality of production tools 10 and a plurality of screens 11, such as sandscreens. Further, each tool assembly 5 includes or is associated with a downhole actuator 12 which is operable to actuate one or more of the first downhole tool 8, second downhole tool 9 or production tools 10 in use. The tool assemblies 5 are capable of being actuated in a desired sequence, thus allowing the formation 3 to be treated in stages.

Such ability to actuate the tool assemblies 5 sequentially may in some embodiments be achieved via the associated downhole actuator, as will be described in further detail below.

Figure 2A:
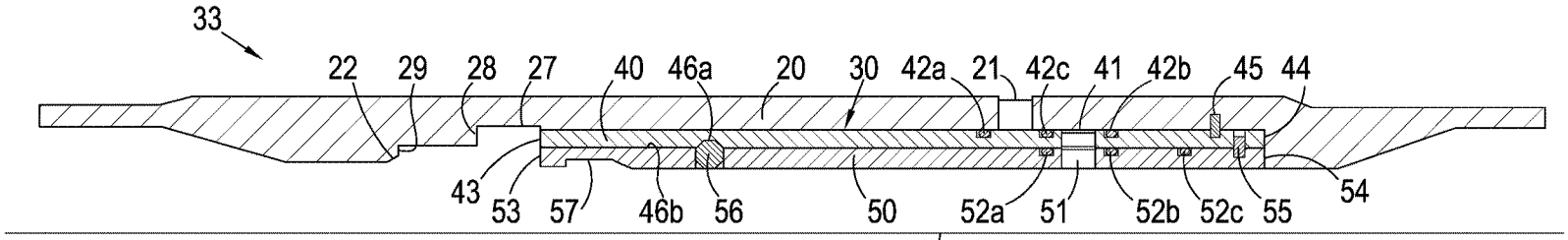
FIG. 2*a* is a partial sectional schematic view of a fracture tool having a sleeve assembly to obturate ports.

A fracture tool 33 according to an embodiment of the present invention is shown in FIG. 2*a*. The fracture tool 33 may, for example, but not exclusively, be used in a wellbore system such as the wellbore system 1 described above.

As shown in FIG. 2*a*, the fracture tool 33 has standard end connections enabling the tool 33 to be connected to tubing. The fracture tool 33 has an outer housing 20 having a plurality of radially spaced ports 21 extending through the sidewall of the housing 20. An inner surface of the housing 20 has a recess 27 sized to accommodate a sleeve assembly 30, with the uphole end of the recess 27 defining a shoulder stop 28.

The sleeve assembly 30 comprises a releasably connected first outer opening sleeve 40 and second coaxial inner closing sleeve 50. The opening sleeve 40 has a plurality of radially spaced ports 41 extending through the sidewall of the sleeve 40. The opening sleeve 40 is coupled to the housing 20 by means of a splined connection (not shown) to ensure that the ports 41 are radially aligned with the ports 21 in the housing 20. The opening sleeve 40 has an upper end 43, a lower end 44 and two axially spaced annular recesses 46*a*, 46*b* on its inner surface. Annular seals 42*a*, 42*b*, 42*c* are located in annular grooves provided on an outer surface of the sleeve 40 in the region of the port 41. The opening sleeve 40 is also connected to the housing 20 with a shear pin 45 towards its lower end 44.

The closing sleeve 50 is arranged within the opening sleeve 40. The closing sleeve 50 has an upper end 53 and a lower end 54. The closing sleeve 50 has a plurality of radially spaced ports 51 and a three annular seals 52*a*, 52*b*, 52*c* located in grooves provided in the outer surface of the closing sleeve 50. Towards its lower end 54 the closing sleeve 50 is releasably pinned to the opening sleeve 40 by a shear pin 55 and is provided with a lock portion in the form of a plurality of dogs 56 capable of radial displacement. Towards its upper end 53 an inner circumference of the closing sleeve 50 is provided with a profile 57 having a stepped shoulder 57*s*.

Figure 2B:
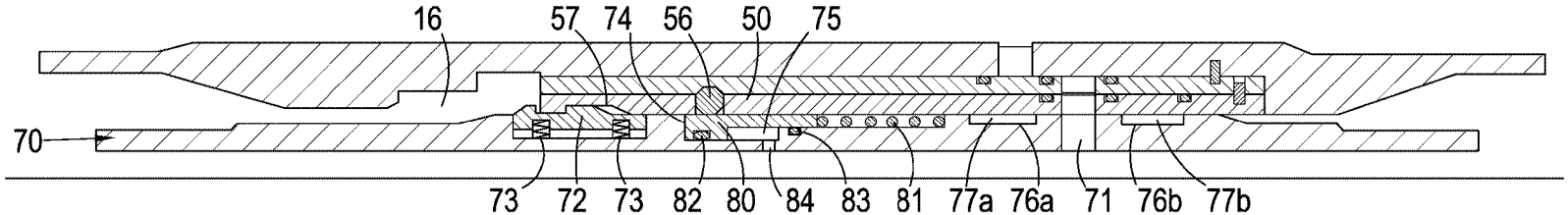
FIG. 2*b* is a partial sectional schematic view of the fracture tool of FIG. 2*a* engaged with an upper shifting tool.

FIG. 2*b* shows an actuator according to an embodiment of the present invention. The actuator may, for example, but not exclusively, be used in a wellbore system such as the wellbore system 1 described above. As shown in FIG. 2*b*, the actuator takes the form of an upper shifting tool 70 attached to a length of wash pipe (not shown). The actuator has an engager in the form of a keyway 72 having a unique profile for keying onto the profile 57 of the closing sleeve 50 of the fracture tool 33 in a first direction. The keyway 72 is biased radially outwardly by means of springs 73.

The shifting tool 70 has a plurality of radially spaced ports 71 extending through a sidewall and providing fluid communication between a throughbore of the wash pipe and the exterior of the shifting tool 70. Annular grooves 76*a*, 76*b* on each side of the ports 71 house a stack of chevron seals 77*a*, 77*b* respectively.

A recess 75 formed in the exterior of the upper shifting tool 70 houses a lock portion in the form of a piston 80. The piston 80 is biased towards an upper shoulder 74 of the recess 75 by a biasing means in the form of a spring 81. The piston 80 is sealed against an exterior of the housing. An area of the piston 80 between annular seals 82 and 83 is exposed to pressure within the throughbore 19 by a channel 84 that communicates throughbore 19 pressure to the piston 80. The remainder of the piston 80 is exposed to fluid pressure within the annulus 16 between the shifting tool 70 and the interior of the fracture tool 33.

Figures 3A, 3B, 3C, 3D:
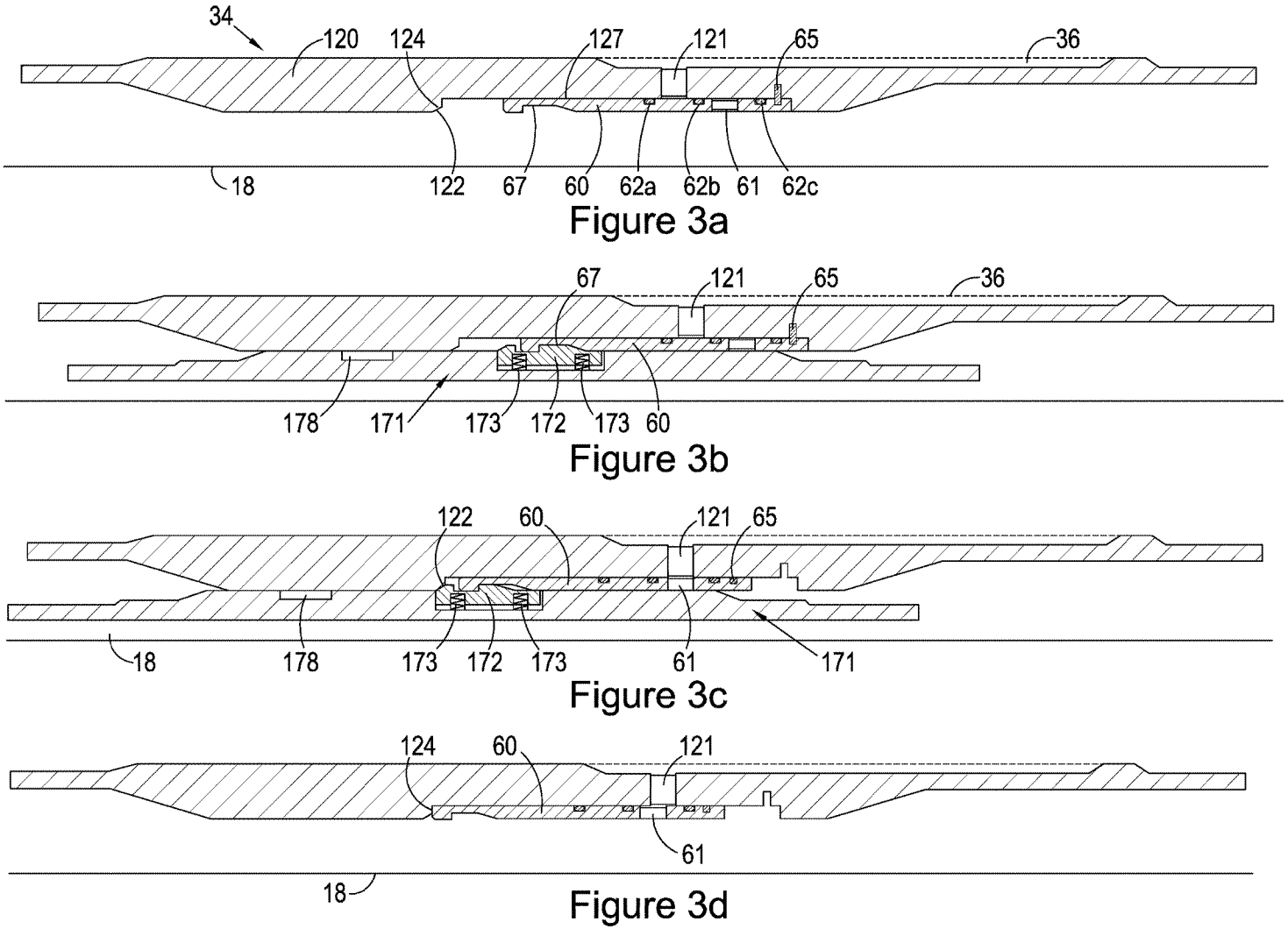
FIG. 3*a* is a partial sectional schematic view of a production tool having a sleeve to obturate ports.
FIG. 3*b* is a partial sectional schematic view of the production tool of FIG. 2*a* engaged with a lower shifting tool.
FIG. 3*c* is a partial sectional schematic view of the production tool of FIG. 2*a* with the ports opened.
FIG. 3*d* is a partial sectional schematic view of the production tool of FIG. 2*a* with the ports closed and the lower shifting tool released.

A production tool 34 according to an embodiment of the present invention is shown in FIG. 3*a*. The production tool 34 may, for example, but not exclusively, be used in a wellbore system such as the wellbore system 1 described above. As shown in FIG. 3*a*, the production tool 34 has a housing 120 and a plurality of radially spaced ports 121 extending through a sidewall of the housing 120. An external portion of the tool 34 in the region of the ports 121 is covered by a cylindrical portion of sandscreen 36. The sandscreen 36 provides a gauze surrounding the ports 121 through which particles above the predetermined gauze size cannot pass. An inner surface of the production tool 34 has a recess 127, an uphole end of which defines a shoulder stop 124. An area of inclined inner bore adjacent the shoulder stop 124 represents a kick down shoulder 122. The recess 127 houses a production sleeve 60.

The production sleeve 60 is releasably attached to the housing 120 by a shear pin 65. The production sleeve 60 has a plurality of radially spaced ports 61 extending through the sidewall and a series of annular seals 62*a*, 62*b*, 62*c* located in annular grooves surrounding the ports 61. A profile 67 is provided on the inner surface of the production sleeve 60 at its uphole end.

A lower shifting tool 171 is shown in FIG. 3*b*. The lower shifting tool 171 has a keyway 172 biased by springs 173 in a radially outward direction. An annular seal 178 is located uphole from the keyway 172. The profile 67 of the production tool 34 is shaped such that it engages with the keyway 172 of the lower shifting tool 171, but does not engage the keyway 72 of the upper shifting tool 70.

The system shown in FIGS. 2*a* to 2*f* can be used in a method of fracturing a formation. The system shown in FIGS. 3*a* to 3*d* can be used to produce hydrocarbons from a fractured formation. The fracturing and production operation is described below with reference to FIGS. 4*a* to 4*g*.

Prior to the fracturing operation, a well is drilled to access a subterranean formation containing hydrocarbons. According to the present embodiment the well may extend approximately 3 kilometers (10000 feet) in a vertical direction and 6 kilometers (20000 feet) in a horizontal direction parallel to the surface of the earth. The intention is then to fracture the surrounding geological formations of interest to penetrate the hydrocarbon reserves zone by zone and produce hydrocarbons from all zones.

Successive lengths of conjoined tubing of around 3½ to 5½ inch (approximately 0.09-0.14 meter) outer diameter is made up at surface and run into downhole. Simultaneously within the tubing, lengths of wash pipe (having a diameter sized to fit within the inner diameter of the tubing) are screwed together. Additional tools such as packers and blank pipe are interconnected with the tubing as required. The extent of each production zone is defined by packers 15 at each end. Packers 15 used in connection with the present invention are Petrowell's open hole hydraulically set packers (product reference CSI Open Hole Permanent Packer 52-CS10).

Figure 4A:
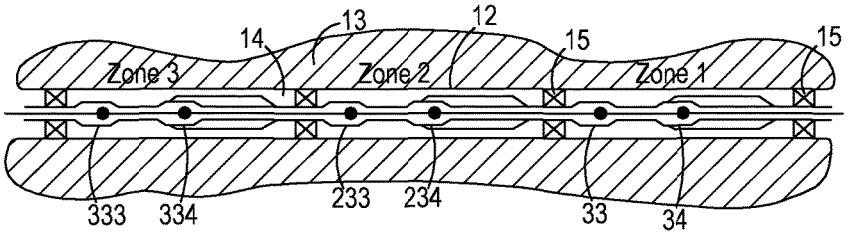
FIGS. 4*a* to 4*g* are schematic views of three zones within a well, each zone having a fracture tool and a production tool, showing successive opening and closing of ports within the tool.

FIG. 4*a* shows three zones. Each zone contains a production tool 34, 234, 334 and a fracture tool 33, 233, 333. All ports 21, 121 of the fracture tools 33, 233, 333 and the production tools 34, 234, 334 are closed while the tubing and the wash pipe is run downhole (FIG. 2*a*, FIG. 3*a*, FIG. 4*a*). During run-in the toe end of the tubing and wash pipe is open to allow circulation of fluids through the wash pipe and out of the end of the tubing to discharge debris ahead of the assembly and lubricate the assembly during run-in.

Once the assembly has reached the required depth and the tools 33, 233, 333, 34, 234, 334 are aligned alongside the respective zones of interest, a ball is dropped that is sized to land on a seat of restricted diameter at the end of the tubing to close off the tubing. The ball seat is attached to a shifting sleeve. Pressure build up behind the ball causes movement of the ball and drives the shifting sleeve to close off the toe end of the wash pipe. Pressure is increased in the tubing to actuate the hydraulically set open hole packers 15. The packers 15 are set to isolate the outer annulus 18 to separate the zones.

Figure 2C:
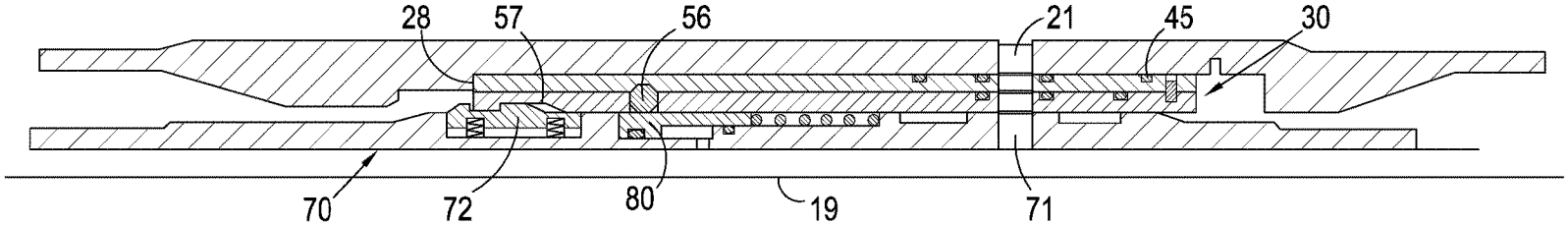
FIG. 2*c* is a partial sectional schematic view of the fracture tool of FIG. 2*a* with the ports opened.

Once the packers 15 are set the fracture tools 33134, 234 must be set up for the fracturing operation of each zone. Pulling force is then applied to the washpipe and shifting tool 70 at around 1000 lbs (approximately 4.5 kN). The keyway 72 on the upper shifting tool 70 engages the profile 57 on the closing sleeve 50 (FIG. 2*b*). At this point a resistance is measured by an operator at surface since the sleeve assembly 30 is shear pinned to the housing 20 of the fracture tool 33. The amount of force pulling the washpipe uphole is increased to around 10,000 lbs (approximately 44.5 kN). The increased pulling force is sufficient to shear the shear pin 45 pinning the sleeve assembly 30 to the housing 20. The sleeve assembly 30 moves relative to the housing 20. Since the closing sleeve 50 and the opening sleeve 40 are locked together by the locking portions in the form of piston 80 and dogs 56 as well as the shear pin 55, the sleeve assembly 30 moves as one uphole to the first shoulder stop 28 (FIG. 2*c*). Movement of the sleeve assembly 30 uphole aligns the sleeve assembly ports 41, 51 with the ports 21 extending through the sidewall of the fracture tool 33.

Once the sleeve assembly 30 reaches the shoulder stop 28, the washpipe is prevented from moving further uphole as it is locked to the sleeve assembly 30 by the keyway 72 and the sleeve assembly 30 is prevented from further movement by the stop 28. Thus a resistance is encountered at surface as applied pulling force ceases to have an effect. This gives a positive indication at surface that the ports 21 of the fracturing tool are open and a fracture fluid flow path has been created. The wash pipe retains the sleeve assembly 30 once the shear pin 45 has sheared so that the sleeve assembly 30 remains engaged to the shifting tool 70, with the wash pipe under tension enabling operations engineers managing the well to know the exact location of the shifting tool 70 and the sleeve assembly 30. The fracturing operation can then commence.

Figure 4B:
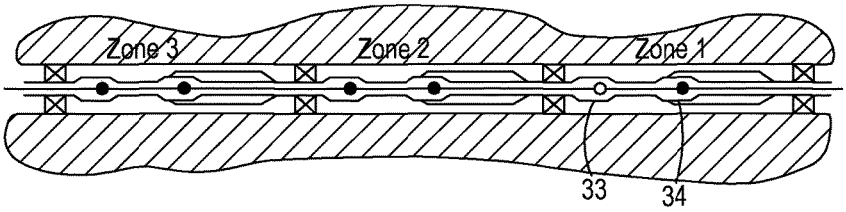

Fracturing fluids are pumped down the throughbore of the wash pipe at a rate of approximately 20 barrels per minute. The fluids are directed out of the ports 21 of the fracturing tool 33 and penetrate the geological formation to open up the rock in surrounding the zone. Sand suspended in fluid is pumped down the wash pipe. The sand and fluid mixture exits the ports in the fracturing tool and is urged into the cracks in the fractured formation. In this way the sand is packed between the cracks to restrict the fractured formation from reforming and prevent closure of the cracks. Once the fractured formation is packed full of sand, a pressure spike is measurable at surface and sand begins to build in the wash pipe. At this point an operations engineer at surface can immediately suspend the sand pumping (FIG. 4*b*).

In order to clear excess sand from the wash pipe, a reverse circulation operation is necessary. Before reverse circulation can occur, the ports of the fracturing tool must be closed.

Figure 2D:
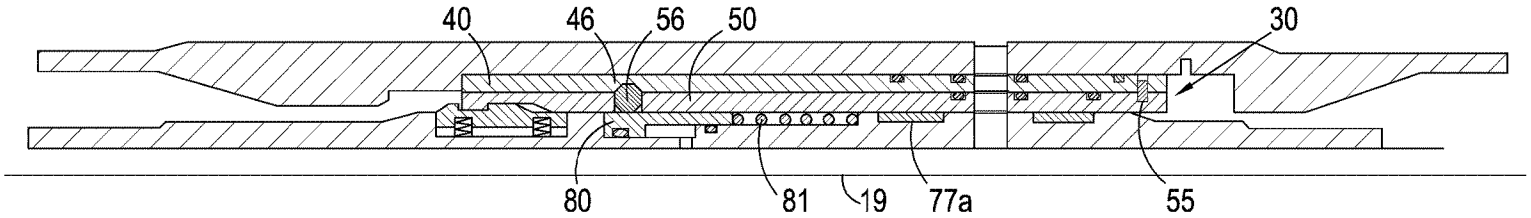
FIG. 2*d* is a partial sectional schematic view of the fracture tool of FIG. 1*a* with the shifting tool in a lock release position.

In order to close the ports of the fracturing tool, fluid is pumped down the inner annulus 16 between the interior of the tubing and the exterior of the wash pipe to create an annulus to throughbore pressure differential. The seals 77*a*, 77*b* located in seal bores on either side of the sleeve assembly ports, effectively seal the annulus from the open port 71. At around or slightly above 500 psi (3.4 MPa) continued pressure build-up leads to a throughbore to annulus pressure imbalance which acts on the piston 80 and urges the piston 80 against the bias of the spring 81 to compress the spring 81 and move the piston 80 in a downhole direction (FIG. 2*d*). This downhole movement causes the piston 80 to move away from the dog 56 on the closing sleeve 50. As a result, the dog 56 can move radially inwardly and the closing sleeve 50 is no longer locked to the opening sleeve 40.

Figure 2E:
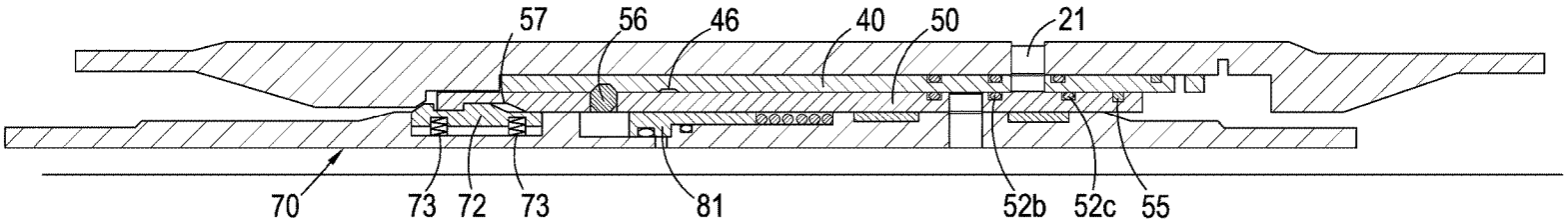
FIG. 2*e* is a partial sectional schematic view of the fracture tool of FIG. 1*a* with the ports closed.
Figure 2F:
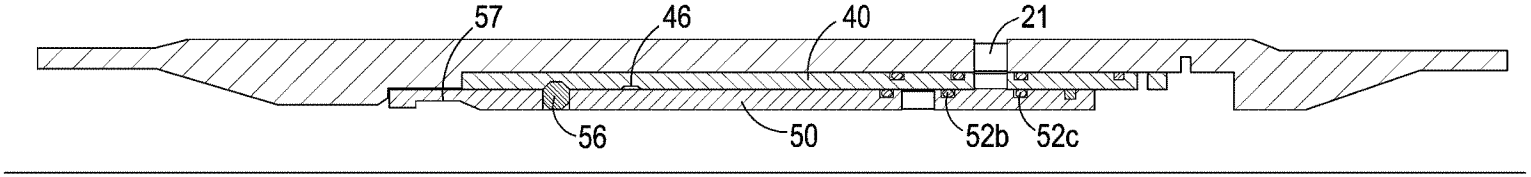
FIG. 2*f* is a partial sectional schematic view of the fracture tool of FIG. 1*a* with the ports closed and the upper shifting tool released.

Application of a pulling force to the wash pipe of around 10,000 lbs (approximately 45 kN) is sufficient to shear the shear pin 55 pinning the closing sleeve 50 to the opening sleeve 40. As a result, the shifting tool 70 and attached closing sleeve 50 move uphole (FIG. 2*e*). The second and third seals 52*b*, 52*c* of the closing sleeve 50 move over the ports 41 of the opening sleeve 40 still aligned with the ports 21 in the tubing housing 20. Once the second and third annular seals 52*b*, 52*c* are located on either side of the opening sleeve port 41, the ports 21 of the fracturing tool are obturated and the fluid flow path has been closed. Continued uphole movement of the wash pipe results in the closing sleeve 50 reaching the shoulder stop 29. Simultaneously, the angled upper shoulder of the keyway 72 on the shifting tool 70 contacts the kick down shoulder 22 formed on the tubing housing 20. The complementary angles result in inward movement of the keyway 72 against the bias of the springs 73 to release the shifting tool 70 from the closing sleeve 50. Thus the shifting tool 70 on the wash pipe is disengaged from the fracture tool 33 (FIG. 2*f*).

Continued pulling force applied to the wash pipe moves the shifting tools 70, 171 uphole until the keyway 172 on the lower shifting tool 171 engages the profile 67 located on the production sleeve 60 (FIG. 3*b*). Resistance to pulling encountered at surface indicates that the lower shifting tool 171 is latched to the production sleeve 60. This gives another positive indication of the relative position of the wash pipe and the tubing. In this known position the seal 178 is located within the bore to thereby create a fluid tight seal in the inner annulus 16 between the tubing and the wash pipe.

Excess sand lodged in the wash pipe is then cleared out by the process of reverse circulation. Reverse circulation involves pumping fluid down the annulus between the tubing and the wash pipe. Fluid cannot pass beyond the seals 178 sealing the lower shifting tool 171 against the production sleeve 60. Therefore the only outlet for the fluid continually pumped down the annulus is through the ports (not shown) in the sidewall of the wash pipe. Fluid enters the wash pipe and any sand blockage encountered causes a fluid pressure to build therebehind until that pressure is sufficient to dislodge the sand. The sand is then transported in the fluid suspension back flow through the tubing to surface where the sand is recovered.

Figure 4C:
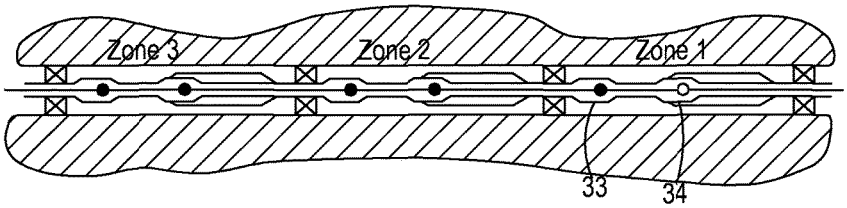

Once the wash pipe has been cleared of sand, an operator at surface applies a large pulling force of 10,000 lbs (approximately 45 kN) to the wash pipe to shear the pins 65 pinning the production sleeve 60 to the tubing. The pulling force transmitted to the production sleeve 60 via the keyway 172 causes axial uphole movement of the production sleeve 60 to align ports 61 in the production sleeve 60 with ports 121 through the sidewall of the tubing (FIG. 3*c*). Once the production sleeve 60 has reached the shoulder stop 124 and the production ports 121 are open, the keyway 172 on the shifting tool 171 contacts the kick down shoulder 122, and the keyway 172 is pushed radially inwardly against the spring bias 173 and releases the lower shifting tool 172 from the tubing (FIG. 3*d*, FIG. 4*c*).

Once the production ports have been opened a pressure imbalance is maintained within the tubing compared with the formation pressure. By over pressuring the tubing, downhole production fluids are maintained in the formation. At a later stage when an operator is ready to bring well production on, the pressure imbalance is removed. The production tool 34 is surrounded by sand screen 36. This sand screen 36 mesh covering the open ports 61 of the production tool 34 enables production of well fluids through the ports 61 without contamination by debris above a certain maximum size determined by the diameter of the holes in the sand screen 36 mesh.

Zone 1 has been successfully fractured and the operator repeats the method steps to fracture zone 2 and subsequently open the production ports 121.

The wash pipe is then pulled uphole with a force of approximately 1000 lbs (4.5 kN) to move the shifting tools 70, 171 into zone 2. The keyway 72 on the upper shifting tool 71 skips over the profile 67 on the next production tool 234 since the keyway 72 of the upper shifting tool 70 and the profile 67 on the production sleeve 60 are non-matching. On reaching the zone 2 fracturing tool 234, the keyway 72 engages the matching profile 57 and the operation can being again for zone 2.

Figure 4D:
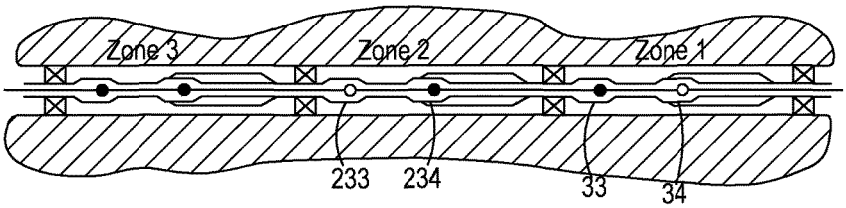
Figure 4E:
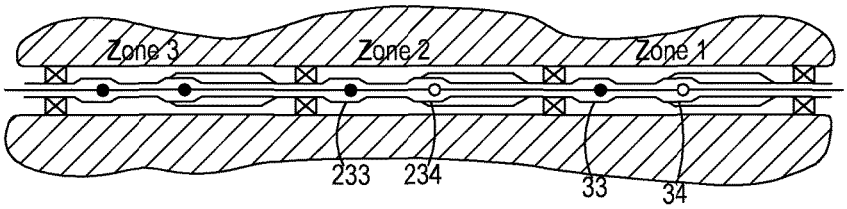
Figure 4F:
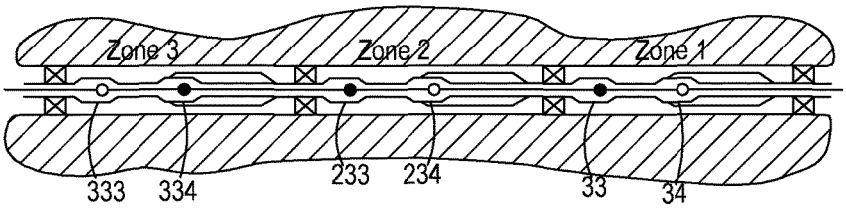
Figure 4G:
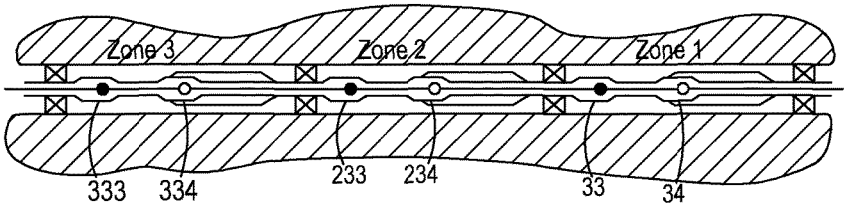
Figure 5:
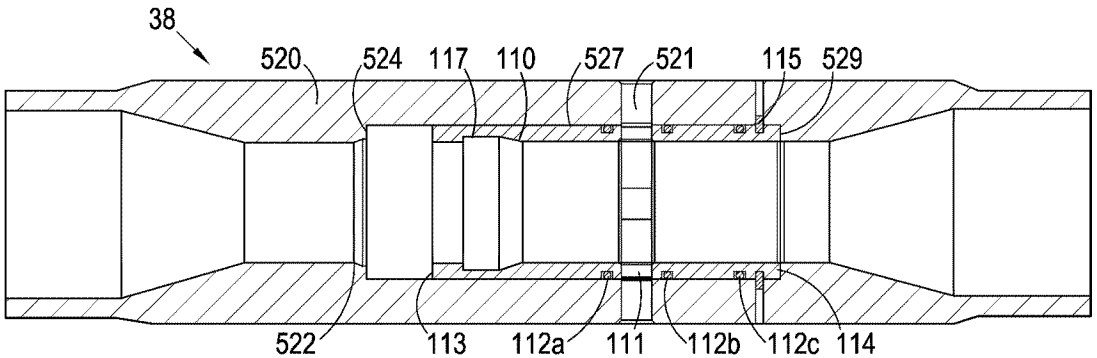
FIG. 5 is a sectional schematic view of a toe tool.
Figure 6:
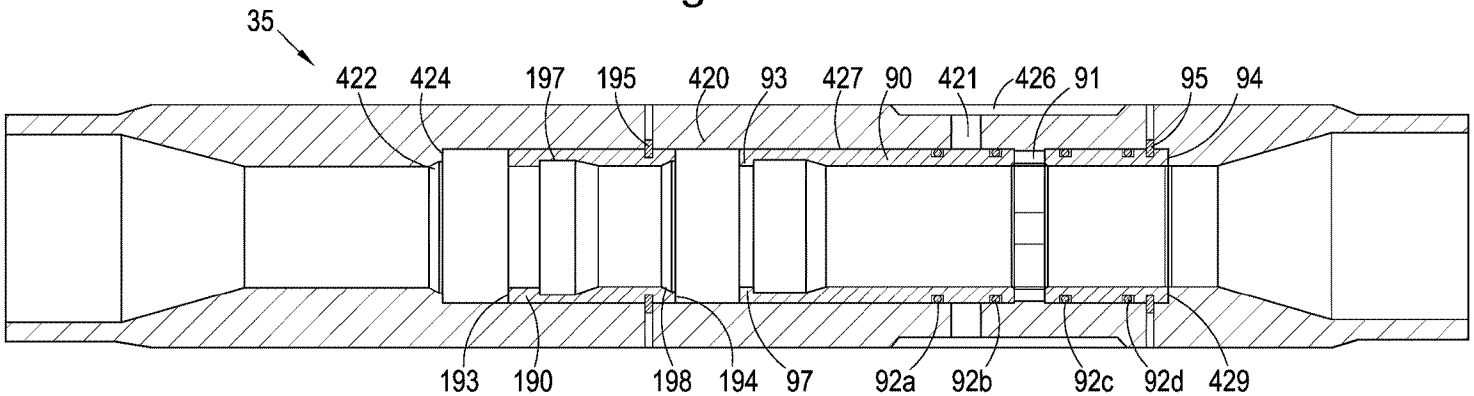
FIG. 6 is a sectional schematic view of a circulation tool.
Figure 7:
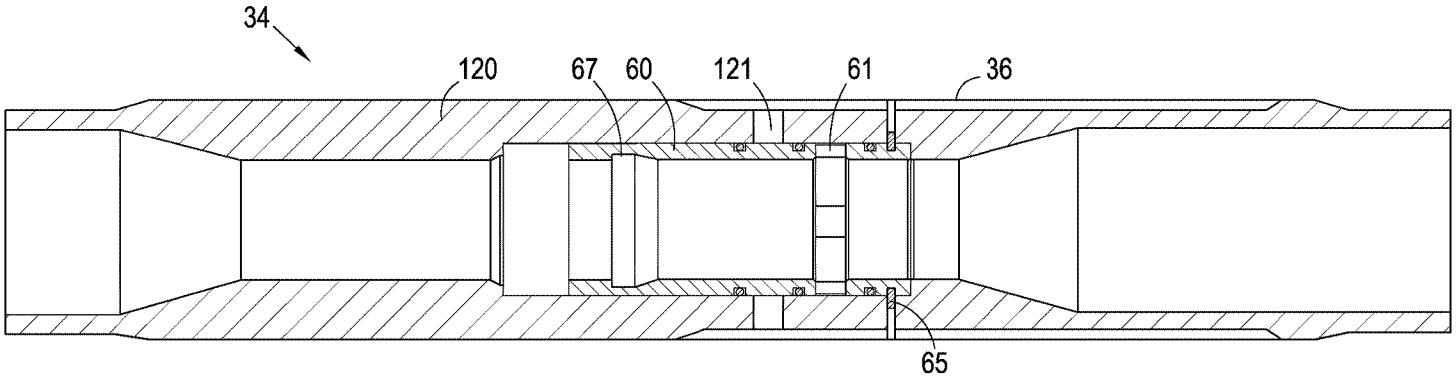
FIG. 7 is a sectional schematic view of a production tool.
Figure 8:
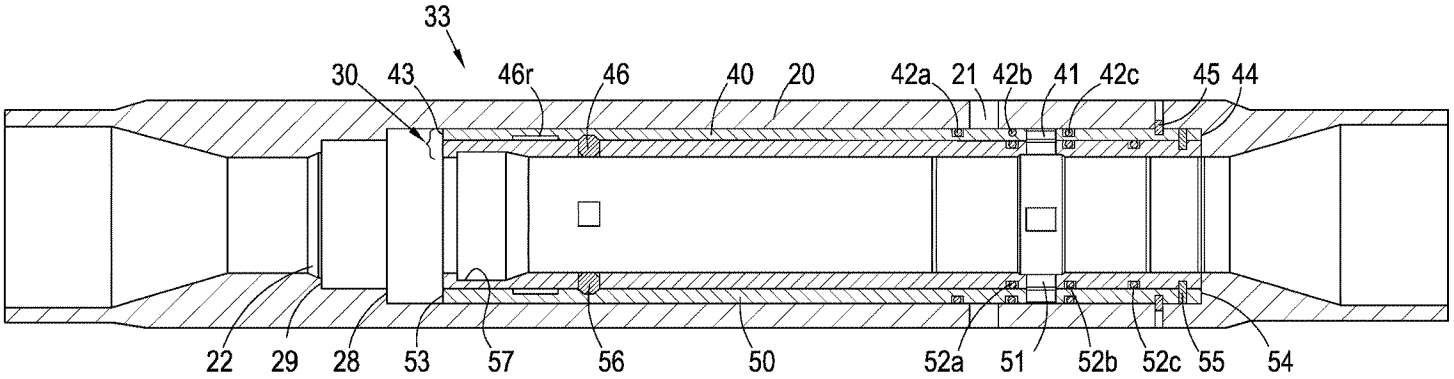
FIG. 8 is a sectional schematic view of a fracture tool.

The method steps described can be repeated for each subsequent zone containing a fracturing tool and a production tool (FIGS. 4*d* to 3*g*). In each case, the upper shifting tool 70 engages the fracture tool 233, 333. The shifting tool 70 is pulled uphole to open the fracturing ports 21. Fracturing and sand packing operations are performed. The arrangement of the sleeve assembly 30 within the housing 20 ensures that the relative positions of the shifting tool 70 and tubing are known. Reverse circulation removes the sleeve assembly 30 lock and allows the closing sleeve 50 to be moved, thereby closing the fracturing ports 21.

All operations are performed with the body of the shifting tool 70 in tension. This means that no pushing force is ever applied to the shifting tool 70 and as a result the shifting tool is always in a known location. The wash pipe is maintained in tension throughout operations. This is advantageous since it reduces the likelihood of buckling or of the wash pipe becoming 'hung-up' or caught on any of the downhole tools.

A further advantage of this invention is that in order to perform all operations, a positive indication of the relative position of the wash pipe and tubing exists. Hydraulic pressure and temperature can act to extend or contract the wash pipe (or any other small bore pipe extending over a large distance). Since the invention requires that an operator registers a continual tensile force (measured at greater than or equal to zero at surface), these effects do not alter the functionality of the invention. Further, maintaining the work string in tension ensures that it is always possible to measure and know with a high degree of certainty at what stage in the process the operations have reached.

The locking device of the invention (dogs 56, recess 46*a* and piston 80) enables the shifting tool 70 to remain engaged with the closing sleeve 50 until the configuration of the fracture tool 33 is altered (by circulation) and closure of the ports 21 is required. Thus, throughout the fracturing operation, the operators know the exact location of the shifting tool 70 relative to the tubing. This increased certainty allows greater control to be retained during the fracturing operation and results in increased reliability and lower risks of failure associated with the fracturing operation.

Another embodiment of the invention is shown in FIGS. 5 to 19.

In this embodiment, an outer tubing string is made up from a toe tool 38 to be located at the toe end of the well in use, and repeating sections comprising a circulation tool 35, a production tool 34, a fracture tool 33 and a packer (not shown) for each zone of the well.

The toe tool 38 (FIG. 5) has an outer cylindrical housing 520 with four radially equispaced ports 521 extending through the sidewall. An inner diameter of the housing is provided with an annular recess 527 or enlarged diameter portion extending between an upper shoulder stop 524 and a lower shoulder 529. A kick-down shoulder 522 formed from an inclined decreasing inner diameter of the housing 520 is located adjacent the upper shoulder stop 524.

A cylindrical toe sleeve 110 is positioned within the inner recess 527 of the housing 520. The toe sleeve 110 has an upper end 113 and a lower end 114 and the toe tool 38 is located with the lower end 114 closest to the toe end of the well is use. The lower end 114 of the toe sleeve 110 is positioned in abutting relationship with the lower shoulder 529 and the toe sleeve 110 is releasably fixed to the housing 520 by means of shear pins 115. The toe sleeve 110 has four radially equispaced ports 111 extending through the sidewall of the sleeve 110. The toe sleeve 110 is initially located and pinned such that the ports 111 of the toe sleeve 110 are axially and radially aligned with the ports 521 formed in the housing. Thus the toe tool 38 provides a flow path from the throughbore to the exterior of the tubing string.

An exterior of the toe sleeve 110 is provided with three axially spaced annular grooves in which O-rings 112*a*, 112*b*, 112*c* are respectively located. Seals 112*a*, 112*b* are located proximate each side of the ports 111 when the ports 111 of the toe sleeve 110 are axially aligned with the ports 521 of the housing 520. Seals 112*b*, 112*c* are located proximate each side of the ports 111 when the ports 111 of the toe sleeve 110 cover the ports 521 of the housing 520. A keyway 117 is located on an inner diameter of the toe sleeve 110 towards its upper end 113.

The circulation tool 35 (FIG. 6) has an outer cylindrical housing 420 with four radially equispaced ports 421 extending through the sidewall. A cylindrical sandscreen 426 is provided across a portion of the exterior of the housing 420 and extends over the ports 421. An inner diameter of the housing is provided with an annular recess 427 or enlarged diameter portion extending between an upper shoulder stop 424 and a lower shoulder 429. A kick-down shoulder 422 formed from an inclined decreasing inner diameter of the housing 420 is located adjacent the upper shoulder stop 424.

A cylindrical circulation sleeve 90 and a stop sleeve 190 located uphole in use from the circulation sleeve 90, are positioned within the inner recess 427 of the housing 420. The circulation sleeve 90 has an upper end 93 and a lower end 94 and the circulation tool 35 is located with the lower end 94 closest to the toe end of the well is use. The lower end 94 of the circulation sleeve 90 initially abuts the lower shoulder 429 and the circulation sleeve 90 is releasably fixed to the housing 420 by means of shear pins 95. The circulation sleeve 90 has four radially equispaced ports 91 extending through the sidewall of the sleeve 90. The circulation sleeve 90 is initially located and pinned such that the ports 91 of the circulation sleeve 90 are axially and radially aligned with the ports 421 formed in the housing 420. Thus the circulation tool 35 provides a flow path from the throughbore to the exterior of the tubing string.

An exterior of the circulation sleeve 90 is provided with three axially spaced annular grooves in which O-rings 92*a*, 92*b*, 92*c* are respectively located. Seals 92*a*, 92*b* are located proximate each side of the ports 91 when the ports 91 of the circulation sleeve 90 are axially aligned with the ports 421 of the housing 420. Seals 92*b*, 92*c* are located proximate each side of the ports 91 when the ports 91 of the circulation sleeve 90 covers the ports 421 of the housing 420. A keyway 97 is located on an inner diameter of the circulation sleeve 90 towards its upper end 93.

The stop sleeve 190 is also releasably pinned to the housing 420 by means of shear pins 195. The stop sleeve 190 is located uphole from the circulation sleeve 90 and spaced therefrom by a similar distance to the distance between the housing ports 421 and the circulation sleeve ports 91 in the initial pinned position. The stop sleeve 190 is similarly spaced from the housing upper stop shoulder 424 by a similar distance. A keyway 197 is located on an inner diameter of the stop sleeve 190 towards its upper end 193.

The production tool 34 and the fracture tool 33 are the same as those described with reference to the first embodiment.

The operation of the fracture system and method will now be described with reference to the sequential FIGS. 9 to 19. In each schematic drawing, the right side of drawing a) represents the lowermost portion of apparatus in the well, with the right side of figures b) and c) representing a continuation from the left side of drawing a) and b) respectively so that the left side of figure c) is the uppermost part of the apparatus shown in the figures.

Before operation, the outer tubing and the inner wash pipe are made up at surface. Components making up the tubing are connected by conventional threaded pin and box connections. The lowermost portion of tubing is blank end pipe 99 that is connected at its upper end to the toe tool 38. The following outer tubing components are then interconnected in order for each zone of the formation that is intended to be fractured: lengths of tubing 37; the circulation tool 35; lengths of tubing 37; the production tool 34; polished bore receptacle (PBR) 39; the fracture tool 33; and a packer (not shown). The polished bore receptacle (PBR) 39 is a portion of tubing having a reduced inner diameter that is smooth and manufactured to a low tolerance to enable a seal to be effectively formed by a sealing tool placed within the PBR 39.

While the outer tubing is made up, the inner wash pipe is simultaneously interconnected within the outer tubing at surface. Thus the outer tubing and inner wash pipe are concurrently made up and run downhole.

The lower end of the inner wash pipe has a shifting tool 470 provided with a lower keyway 372 and an upper keyway 272 axially spaced from the lower keyway. Each keyway 372, 272 has a different profile for engaging a different profile on a downhole tool. Both keyways 372, 272 are spring biased radially outwardly. Uphole from the lowermost shifting tool 470, the wash pipe is of solid cross section up to a seal and bypass portion 600.

The seal and bypass portion 600 has an inner bore 637 and an outer enlarged diameter portion 630 provided with an annular seal 631. Four radially equispaced lower ports 632 and four radially equispaced upper ports 635 provide communication with the inner bore 637 of the wash pipe and an inner annulus 16 between the wash pipe and the interior of the outer tubing. The upper and lower ports 635, 632 are overlaid with a length of cylindrical sandscreen 634, 633 respectively. The sandscreen 633, 634 has mesh gauze arranged to limit the size of particles that can travel within the inner bore 637 of the wash pipe. Two check valves 636 are located in the inner bore 637 to allow flow in an uphole direction, but limit flow in a downhole direction.

Figure 9A:
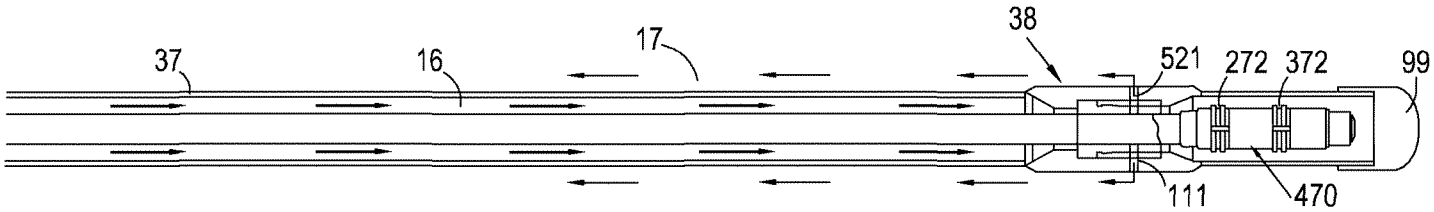
FIGS. 9 to 19 are schematic views of a wash pipe fracture system according to another embodiment of the invention.
Figure 9B:
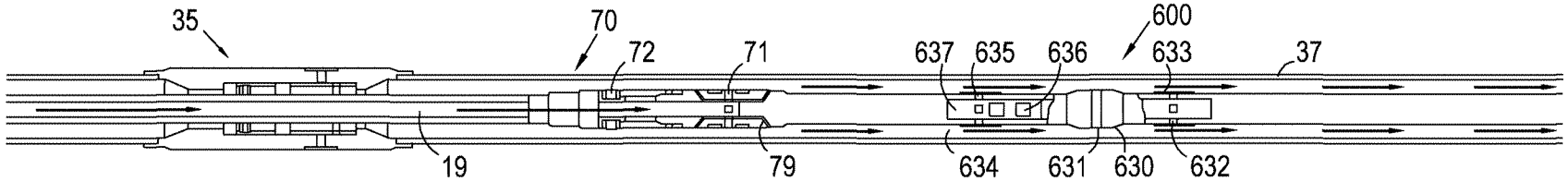
Figure 9C:
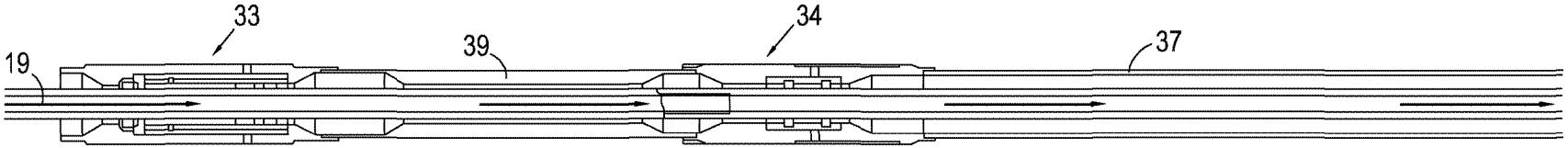

The shifting tool 70 described with reference to the previous embodiment is located uphole from the seal and bypass portion 600. The shifting tool 70 shown in FIG. 9*b* is additionally provided with a bypass flow path that runs axially between (but not in communication with) the ports 71 allowing communication with the inner annulus 16 across the seals 77*a*, 77*b*. Uphole from the shifting tool 70, the wash pipe has a throughbore 19 that communicates with surface.

As the system comprising outer tubing and washpipe are run downhole (FIG. 9), fluid is circulated within the throughbore of the washpipe. The fluid travels along the throughbore 19, out through the ports 71 in the upper shifting tool 70, along the inner annulus 16 between the washpipe and the interior of the tubing, out through the open ports 111 of the toe tool 38 and back to surface along an outer annulus 17 between the exterior of the tubing and the open hole (not shown). This circulation of fluid aids travel of the system downhole by lubricating its passage along the open hole. All other ports 421, 121, 21 of the circulation tool 35, production tool 34 and fracture tool 33 are closed during run in.

Figure 10A:
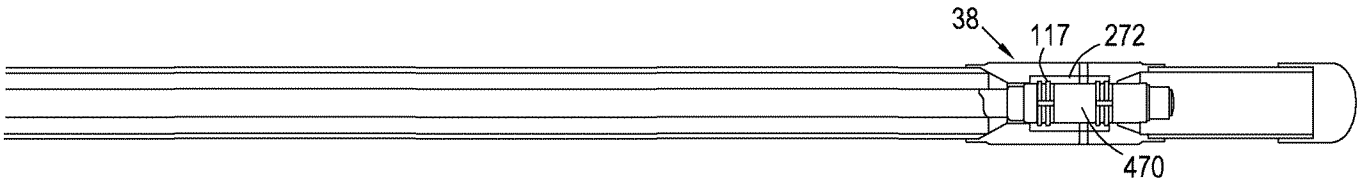
Figure 10B:
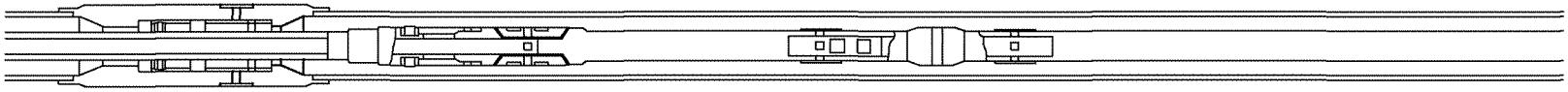
Figure 10C:
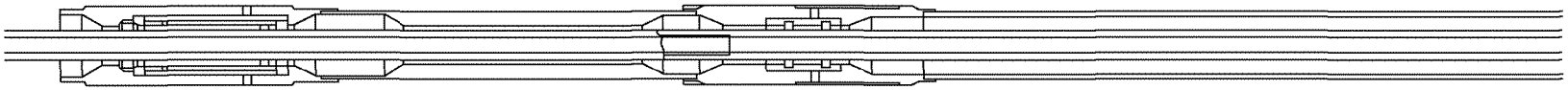

Once the system has reached the desired location downhole, tension is applied to the washpipe at surface. The resultant pulling force causes uphole movement of the wash pipe. Keyway 272 is shaped to engage with the profile 117 of the toe sleeve 110 within the toe tool 38. At this point an operator at surface registers a resistance to further movement of the washpipe, which indicates that the keyway 272 of the lower shifting tool has engaged with the toe sleeve 110 (FIG. 10). The operator then applies a pulling force to the washpipe sufficient to shear the shear pins 115 retaining the toe sleeve 110 to the housing 520. Shearing of the shear pins 115 and the tensile force applied to the toe sleeve 110 via the shifting tool 470 causes uphole movement of the toe sleeve 110 until the upper end 113 of the toe sleeve 110 reaches the shoulder stop 524. Thus, the ports 111 of the toe sleeve 110 are axially shifted relative to the ports 521 in the housing 520. This misalignment of sealed ports 111, 521 closes the flow path between the interior and exterior of the tubing. The shoulder stop 524 resists further uphole movement of the toe sleeve 110. An upper profile of the keyway 272 simultaneously meets the kick-down shoulder 522 which urges the keyway 272 against its bias in a radially inward direction, thereby releasing the shifting tool 470 from the toe tool 38.

Once the toe sleeve 110 is pulled across the ports 521, and the fluid path is closed, the interior of the tubing represents a closed system which can be pressurised. Pressure applied from surface builds within the tubing to hydraulically set the open hole packers (not shown) thereby defining each zone and anchoring the tubing within the open hole.

Figure 11A:
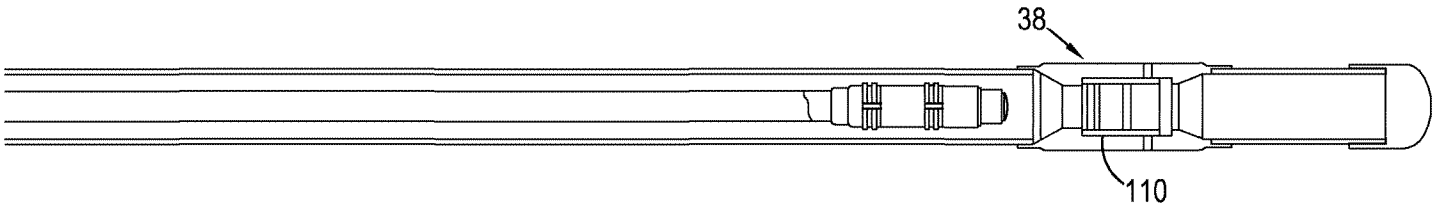
Figure 11B:
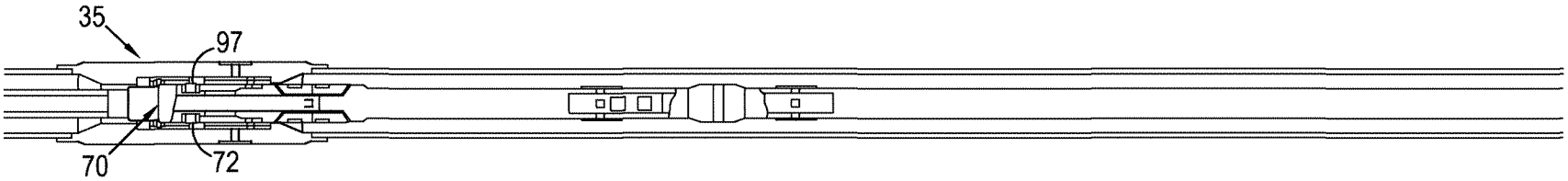
Figure 11C:
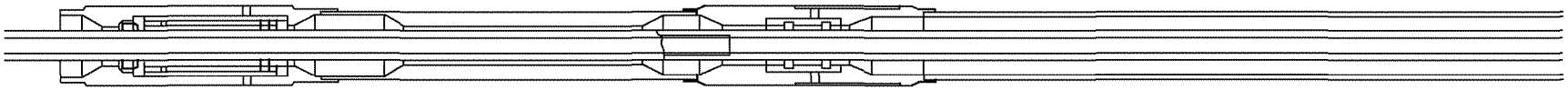

A pulling force applied to the washpipe results in continued movement uphole until the keyway 72 of the upper shifting tool 70 engages the profile 97 of the circulation sleeve 90. The operator at surface recognises the resistance of the wash pipe to further uphole movement and therefore has a positive indication that the wash pipe is engaged with the circulation tool 35 (FIG. 11). The operator then applies sufficient tensile force to the washpipe to shear the shear pins 95 and free the circulation sleeve for uphole movement urged by the engaged shifting tool 70 on the washpipe. When the upper end 93 of the circulation sleeve 90 meets the lower end 194 of the stop sleeve 190, further travel of the circulation sleeve 90 is resisted. At this point the sealed ports 91 of the circulation sleeve 90 are aligned with the ports 421 in the circulation tool 35 housing 420, thereby opening a flow path between the inner annulus 16 and the outer annulus 17. The kick down shoulder 198 provided on the stop sleeve 190 urges the upper profile of the keyway 72 radially inwardly against the spring bias to disengage the upper shifting tool 70 from the circulation tool 35.

Figure 12A:
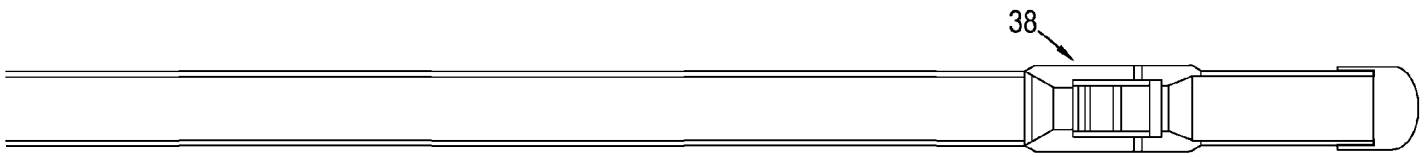
Figure 12B:
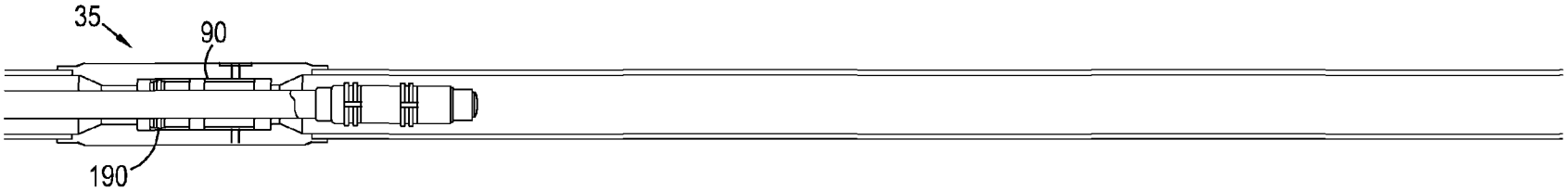
Figure 12C:
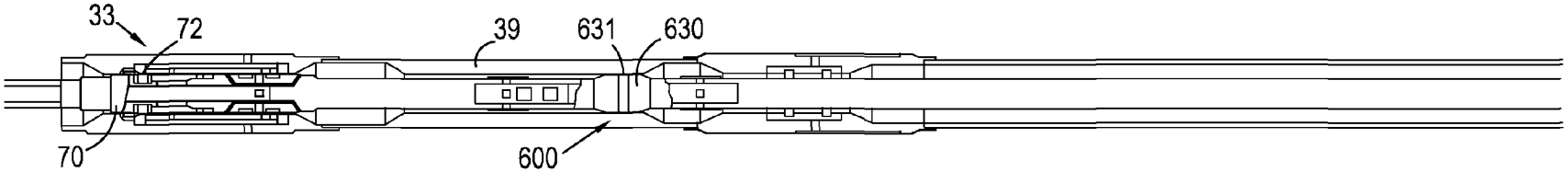

The operator at surface applies a pulling force to the washpipe, which continues uphole movement in response. As the washpipe moves uphole, the seal and bypass portion 600 is pulled within the PBR 39 such that the annular seal 631 forms a seal against an inner surface of the PBR 631 to substantially restrict fluid flow therepast (FIG. 12).

Continued uphole pulling of the washpipe brings the shifting tool 70 within the throughbore of the fracture tool 33. The operator at surface feels a resistance to further movement when the keyway 72 of the upper shifting tool 70 engages the profile 57 of the closing sleeve 50 (FIG. 12). Sufficient tensile force is applied via the washpipe to shear the shear pins 45 and allow movement of the sleeve assembly 30 uphole. Movement of the sleeve assembly 30 continues to align the ports 41, 51 of the sleeve assembly 30 with the ports 21 in the housing 20 of the fracture tool 33 thereby opening a flow path between the inner annulus 16 and the outer annulus 17. When the upper end 43, 53 of the sleeve assembly 30 reaches the shoulder stop 28, the sleeve assembly 30 is restricted from further uphole travel.

Figure 13A:
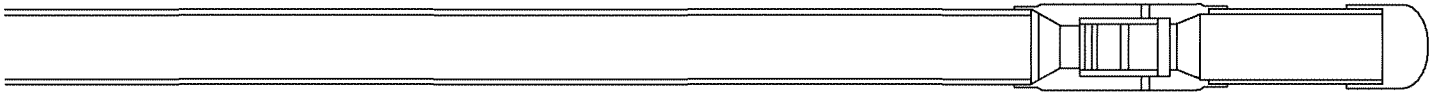
Figure 13B:
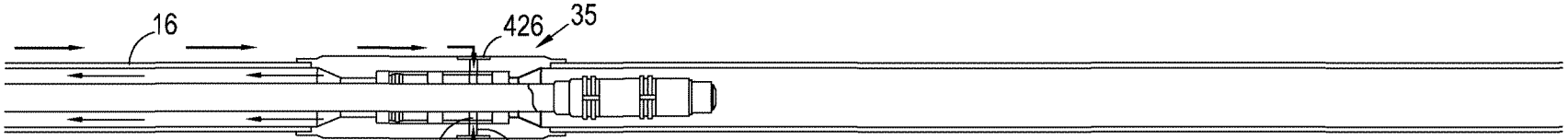
Figure 13C:
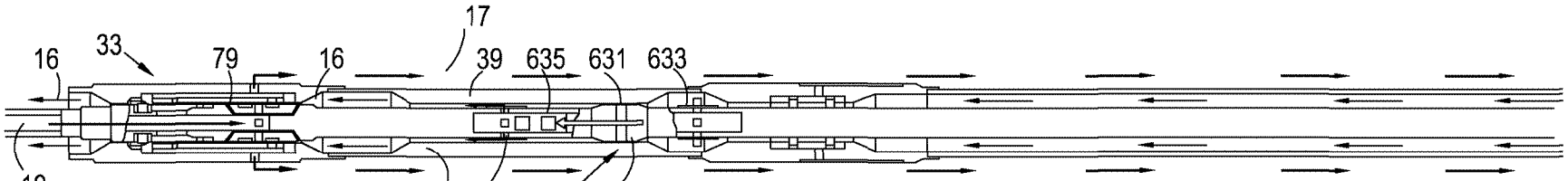

The fracture ports 21 and the circulation ports 421 are both open and the outer annulus 17 of the lowermost zone isolated. The fracturing operation can now begin (FIG. 13). Proppant fracturing fluid is pumped within the throughbore 19 of the washpipe and is directed out through the open ports 21 of the fracture tool 33. Fracturing fluid exiting the fracture ports 21 penetrates the geological formation of interest and the proppant particles suspended in the fracturing fluid fill the fissures in the formation to restrict resealing and prop open the newly formed cracks. Fracturing fluid travels the length of the zone and can flow through the screened ports 421 of the circulation tool 35 and along a return path through the inner annulus 16. The screens 426 surrounding the ports 421 of the circulation tool 35 prevent proppant and particles of rock above a predetermined size from entering the throughbore 18 of the tubing. Fracturing fluid returning via the circulation path travels uphole through the inner annulus 16 and through the lower ports 632 of the seal and bypass portion 600. The check valves 636 allow fluid to flow in an uphole direction and therefore the fluid flows through the check valves 636 within the inner bore 637 and out through the upper ports 635 into the inner annulus 16. Fluid flows through the port bypass 79 of the fracture tool 33 and uphole along the inner annulus 16. After a calculated volume of fracturing fluid has been pumped downhole, the fracturing operation of zone 1 is complete.

Figure 14A:
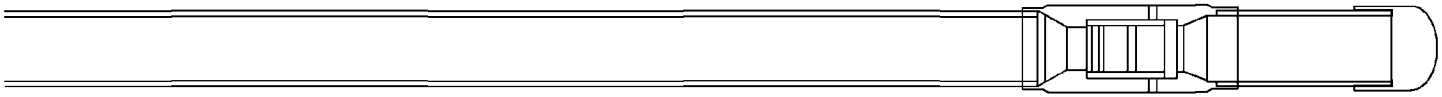
Figure 14B:
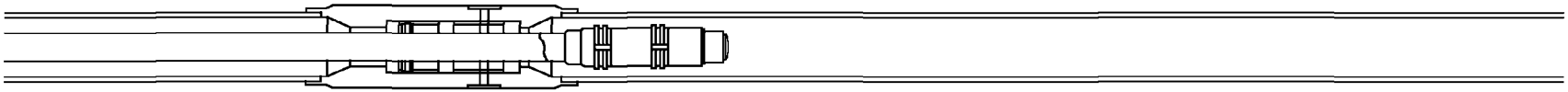
Figure 14C:
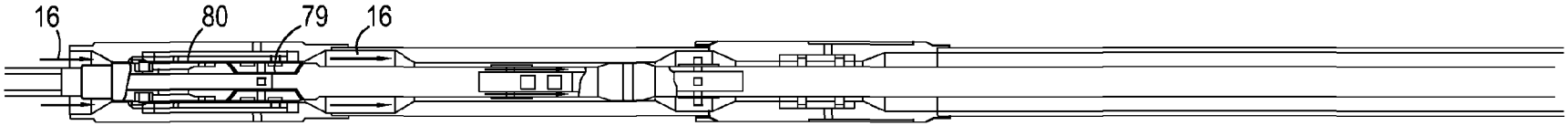

Fluid is then pumped down the inner annulus 16 to create a pressure differential between the annulus 16 and the throughbore 19 of the washpipe. The pressure differential across the seals 82, 83 of the piston 80 is increased to overcome the bias of the spring 81 and urge the piston 80 downhole away from the upper shoulder 74 of the shifting tool 70 (FIG. 14). Retraction of the piston 80 allows the locking dog 56 to move radially inwardly thereby unlocking the closing sleeve 50 from the opening sleeve 40.

Figure 15A:
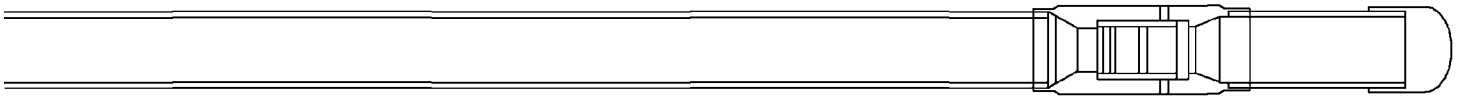
Figure 15B:
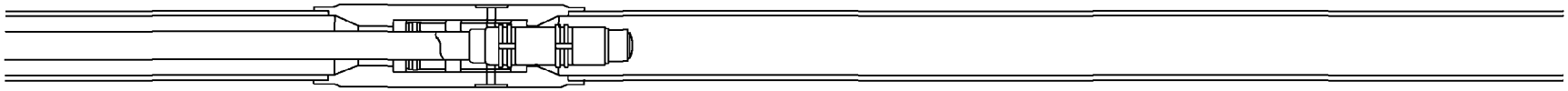
Figure 15C:
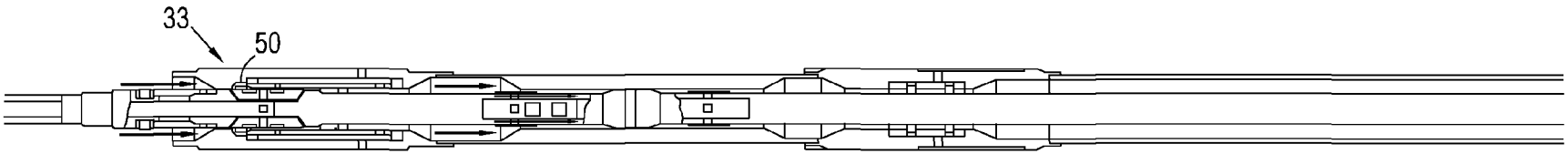

A tensile force is applied to the washpipe by an operator at surface calculated to overcome the force of the shear pin 55 holding the closing sleeve 50 to the opening sleeve 40. Thus the shear pin 55 is sheared and the keyway 72 engaged with the profile 57 on the closing sleeve 50 translates the axial pulling force to the sleeve to move it uphole to the shoulder stop 29 (FIG. 15). The act of moving the closing sleeve 50 over the opening sleeve 40 covers the ports 21, 41 and closes the fluid flow path to the exterior of the tubing. The upper profile of the keyway 72 hits the kick down shoulder 22 and urges the keyway 72 radially inwardly to release the shifting tool 70 from the fracture tool 33.

Figure 16A:
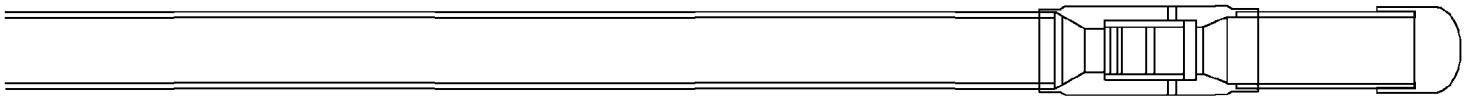
Figure 16B:
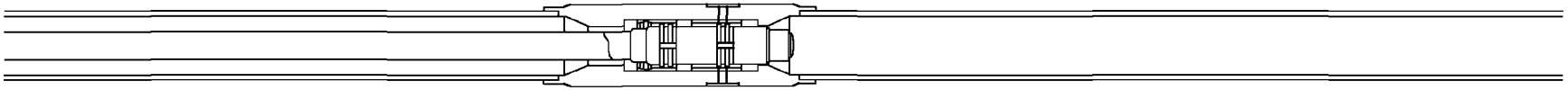
Figure 16C:
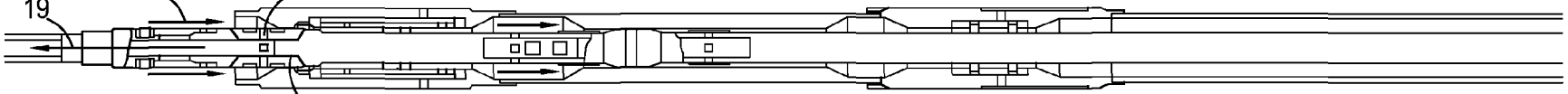

Continued upward pulling on the washpipe moves the shifting tool 70 uphole so that the seals 77*a*, 77*b* are no longer in contact with the fracture tool 33 (FIG. 16). Fluid is then circulated down the inner annulus 16 and into the throughbore 19 of the washpipe through the ports 71 in the shifting tool 70. This fluid washes excess sand or proppant back to surface to clear the throughbore 19 of the washpipe following the fracturing operation.

Figure 17A:
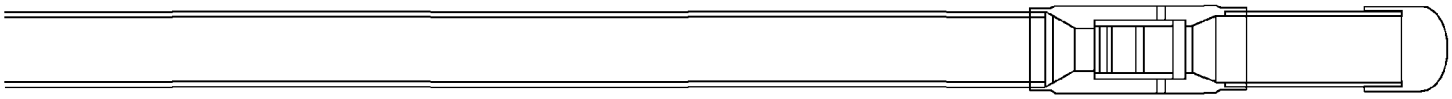
Figure 17B:
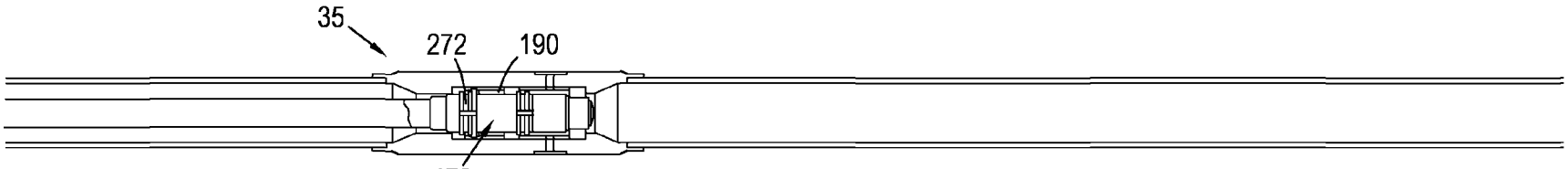
Figure 17C:
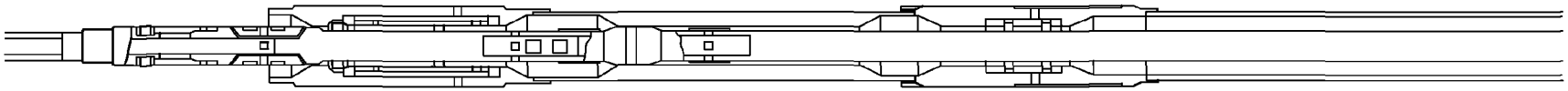
Figure 18A:
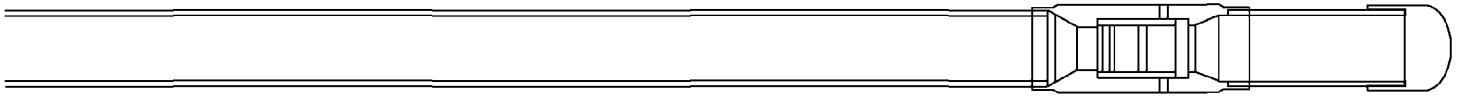
Figure 18B:
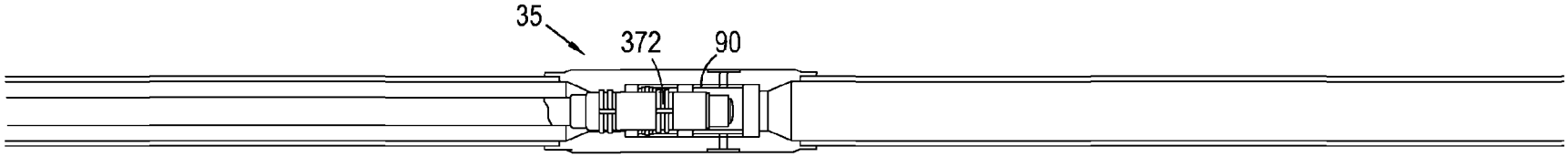
Figure 18C:
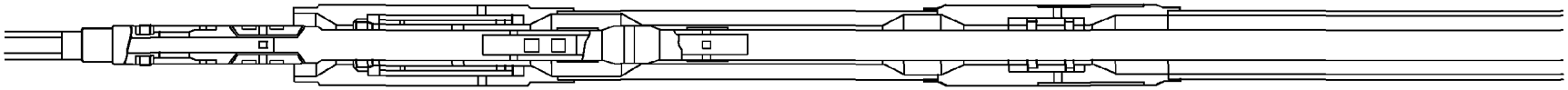

Further pulling on the washpipe moves the shifting tools uphole until the lowermost shifting tool 470 is pulled within the circulation tool 35. The upper keyway 272 has a profile that is arranged to skip over the profile 97 of the circulation sleeve 90 but engage the profile 197 of the stop sleeve 190 (FIG. 17). When the stop sleeve 197 and the shifting tool 470 are engaged, the operator encounters a resistance at surface. A tensile force greater than the rating of the shear pins 195 is applied to the washpipe and translated to the stop sleeve 190. Thus the stop sleeve 197 is no longer pinned to the housing 420 and is pulled uphole to the shoulder stop 424. When the upper profile of the keyway encounters the kick down shoulder 422, the keyway 272 moves radially inwardly and disengages the shifting tool 470 from the stop sleeve 190. The lower keyway 372 of the lower shifting tool 470 is identical to the keyway 72 provided on the upper shifting tool 70 and is arranged to engage the profile 97 of the circulation sleeve 90 (FIG. 18). There is now no longer a stop sleeve 190 restricting further uphole movement of the circulation sleeve 90 and therefore the circulation sleeve 90 is pulled by the washpipe in the uphole direction thereby closing the sealed ports 421 and the fluid flow path in the circulation tool 35. The washpipe is pulled until the circulation sleeve 90 meets the lower end 194 of the stop sleeve 190, at which point the upper profile of the keyway 372 encounters the kick down shoulder 198 on the stop sleeve 190 and releases the lower shifting tool 470 from the circulation sleeve 90.

Figure 19A:
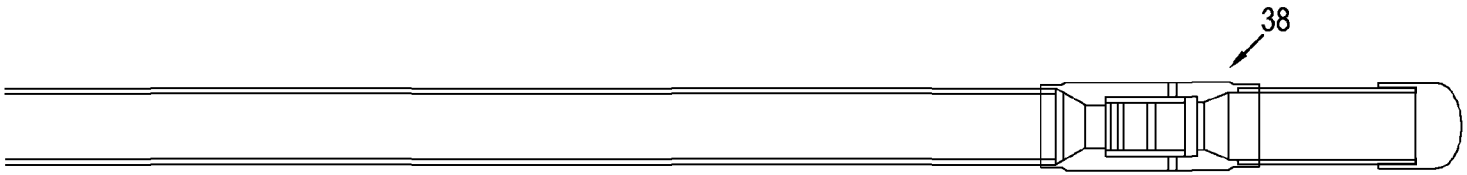
Figure 19B:
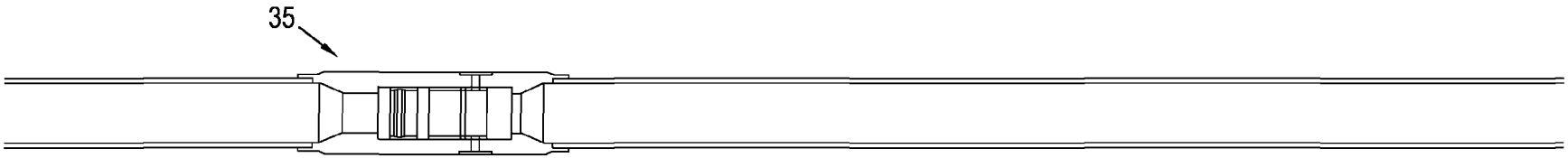
Figure 19C:
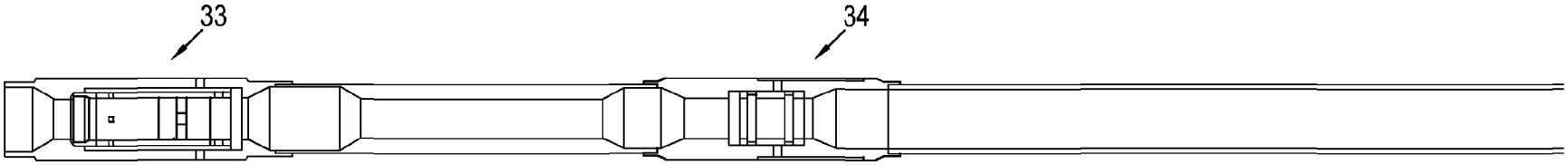

The fracturing of zone 1 is complete and all the ports 421, 21 have been closed so that the fracturing operation of the next zone uphole from the first zone can commence. The wash pipe is pulled uphole and the lower shifting tool 470 if pulled out of the tubing in the first zone, with the keyways 272, 372 skipping off or out of the remaining profiles in the production tool 34 and the fracture tool 33 (FIG. 19).

The method steps are repeated for each and every successive zone. This method allows mechanical control of a fracturing operation from surface with the advantage that the operator remains in full control of the operation having a positive indication of the location of the washpipe shifting tools throughout the operation. This allows a high level of control to be maintained over the mechanical fracturing operation from surface.

Once the fracturing operation of all zones is complete, the wash pipe can be removed from the hole and the ports 121 of the production tools 34 can be opened using another shifting tool with a different keyway. Hydrocarbons can then be produced from the fractured zones.

A tool assembly 1000 according to another embodiment of the invention is shown in FIGS. 20 to 26. The tool assembly 1000 may, for example, but not exclusively, be used in a wellbore system such as the wellbore system 1 described above.

Figure 20:
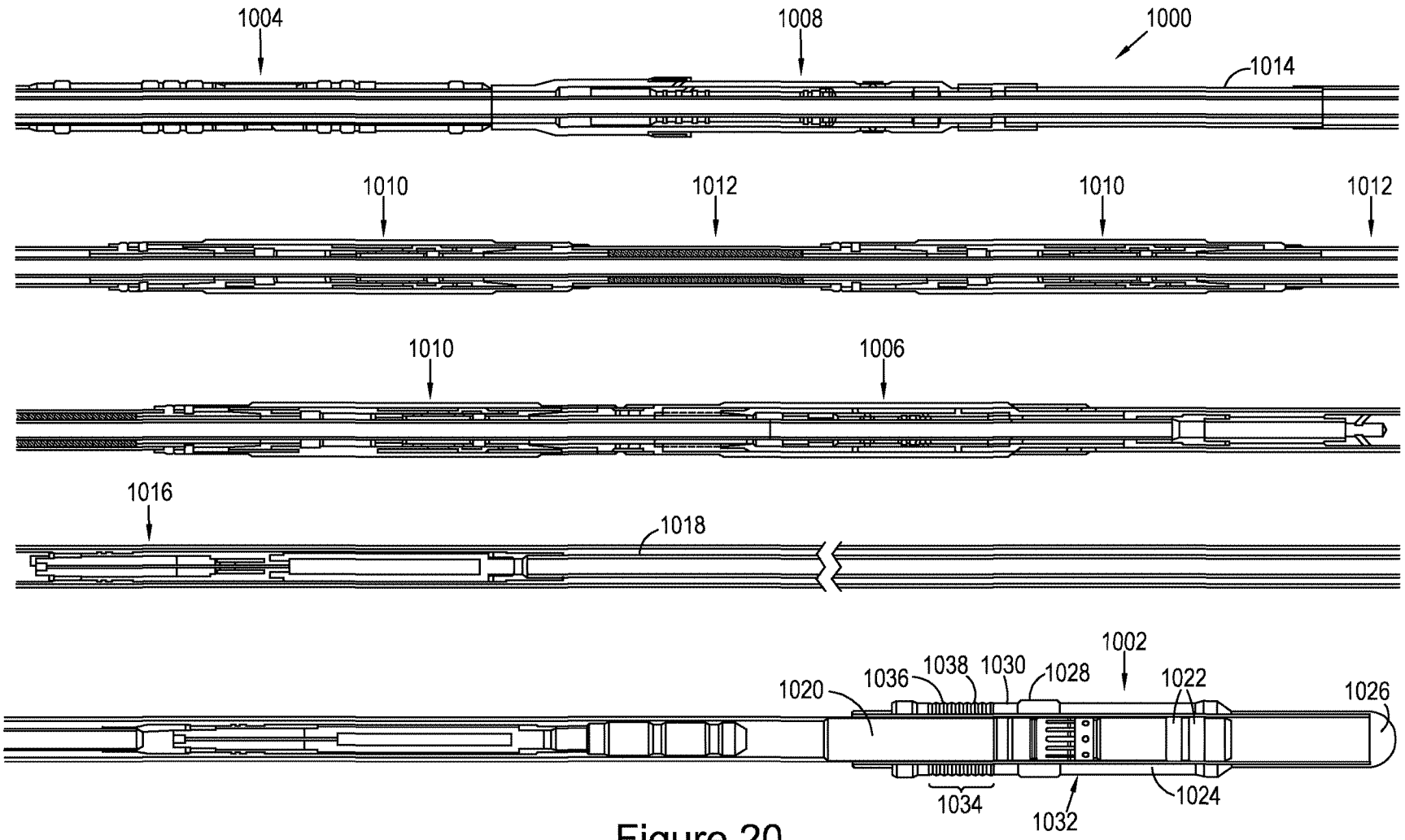
FIG. 20 shows a tool assembly according to another embodiment of the invention.

As shown in FIG. 20, the tool assembly 1000 comprises a lower packer 1002, an upper packer 1004, a first downhole tool 1006, a second downhole tool 1008, a plurality of production tools 1010 and a plurality of screens 1012. In the illustrated embodiment, the upper packer 1004, first downhole tool 1006, second downhole tool 1008 and production tools 1010 form part of a tubular string 1014 which is run into a borehole, such as the borehole 2 represented in FIG. 1. An actuator 1016 is provided within the tool assembly 1000, the actuator 1016 disposed on an inner tubular string 1018 which is run into the borehole 2 with the tubular string 1014 and which may be withdrawn through the tubular string 1014, the actuator 1016 being operable to activate the first downhole tool 1006 and the second downhole tool 1008.

In use, the lower packer 1002 may be run into the borehole 2 ahead of the tubular string 1014, the tubular string 1014 comprising a latch 1020 at its distal end which permits the tubular string 1014 to latch into the lower packer 1002. As shown in FIG. 20, the latch 1020 is provided with seals 1022 which permit the latch 1020 to sealingly engage the lower packer 1002.

In the illustrated embodiment, the lower packer 1002 takes the form of a sump packer and the upper packer 1004 comprises a CZI packer from Petrowell Limited. However, it will be recognised that both the lower packer 1002 and the upper packer 1004 may comprise CZI packers or other packers may be used where appropriate. Once set, the lower packer 1002 and the upper packer 1004 may be used to isolate a formation zone, the lower packer 1002 defining a base at the toe of the tubular string 1014 which permits an operator to apply fluid pressure within the tubular string 1014 above the lower packer 1002.

The lower packer 1002 has a generally tubular body 1024 having a nose 1026 at its distalmost end. A seal 1028 is disposed in a recess 1030 provided in the outer surface 1032 of the body 1024. The lower packer 1002 also comprises a profiled portion 1034 having a number of teeth 1036. In the illustrated embodiment, the teeth 1036 are provided in two sets separated by an annular band or ring 1038.

A first downhole tool 1006 according to this embodiment is shown in FIGS. 21*a* to 21*e* and comprises a flow control tool of the tool assembly 1000. The first downhole tool 1006 takes the form of a sliding sleeve device.

The first downhole tool 1006 has an outer housing 1040, an inner housing 1042 having a lateral flow port 1044 and a sliding sleeve 1046 which in the illustrated embodiment also has a lateral flow port 1048. In use, the first downhole tool 1006 is actuable between a closed configuration in which fluid flow through the flow ports 1044, 1048 is prevented or restricted and an open configuration in which fluid flow through the flow ports 1044, 1048 is permitted.

The outer housing 1040 of the first downhole tool 1006 is generally tubular and comprises a body 1050, an upper end ring 1052 and a lower end ring 1054.

The body 1050 of the outer housing 1040 has an inner surface 1056, an outer surface 1058, an upper end 1060 defining upper end face 1062 and a tapered lower end 1064 defining lower end face 1066. The outer surface 1058 defines, or is provided with, a number of circumferentially spaced and radially extending centraliser blades 1068 and, in use, the centraliser blades 1068 offset the first downhole tool 1006 from the surrounding casing or bore wall C. A bore 1070 is provided in the body 1050 towards the lower end 1064, the bore 1068 receiving a grub screw 1072 which secures the body 1050 to the lower end ring 1054.

The upper end ring 1052 of the outer housing 1040 is generally tubular and forms the uphole end of the first downhole tool 1006 in use (left end as shown in the figures). The upper end ring 1052 has an inner surface 1074, a stepped outer surface 1076, an upper end 1078 defining upper end face 1080 and lower end 1082 defining lower end faces 1084, 1086, the lower end face 1086 disposed on a flange portion 1088 of the upper end ring 1052. A groove 1090 is formed in the outer surface 1064 and a seal 1092 is disposed in the groove 1090.

On assembly, the upper end 1060 of the body 1050 is disposed on the flange portion 1088 of the upper end ring 1052 and abuts the end face 1084, the seal 1092 preventing leakage between the body 1050 and the upper end ring 1052. The upper end face 1080 abuts a lower end ring of the adjacent production tool 1010, the upper end ring 1052 of the first downhole tool 1006 and the lower end ring of the adjacent production tool 1010 joined by a weld connection (not shown) or other suitable means.

The lower end ring 1054 of the outer housing 1040 is generally tubular and forms the downhole end of the first downhole tool 1006 in use (right end as shown in the figures). The lower end ring 1054 has a stepped inner surface 1094, an outer surface 1096, a lower end 1098 defining lower end face 1100 and an upper end 1102 defining upper end faces 1104, 1106, the upper end face 1104 disposed on a flange portion 1108 of the lower end ring 1054. A groove 1110 is formed in the outer surface 1096 and a seal 1112 is disposed in the groove 1110. In addition, a bore 1114 is provided in the lower end ring 1054, the bore 1114 receiving the grub screw 1072.

On assembly, the lower end 1064 of the body 1050 is disposed on the outer surface 1096 of the lower end ring 1054, the grub screw 1072 securing the body 1050 to the lower end ring 1054 and the seal 1112 preventing leakage between the body 1050 and the lower end ring 1054.

The inner housing 1042 of the first downhole tool 1006 is disposed radially inwards of the outer housing 1040 and the inner housing 1042 and the outer housing 1040 are radially spaced so as to provide a tool annulus 1116 therebetween. As shown most clearly in FIG. 21*c*, the annulus 1116 terminates at the lower end ring 1054.

In the illustrated embodiment, the inner housing 1042 is modular in construction having a first module 1118, a second module 1120 having the lateral flow port 1044, a third module 1122, a fourth module 1124 and a fifth module 1126. On assembly, the modules 1118, 1120, 1122, 1124 and 1126 define an axial throughbore 1117 of the first downhole tool 1006. Providing a number of separate modules simplifies manufacture of the inner housing 1042. However, it will be recognised that the inner housing 1042 may alternatively comprise a unitary component.

Figure 21A:
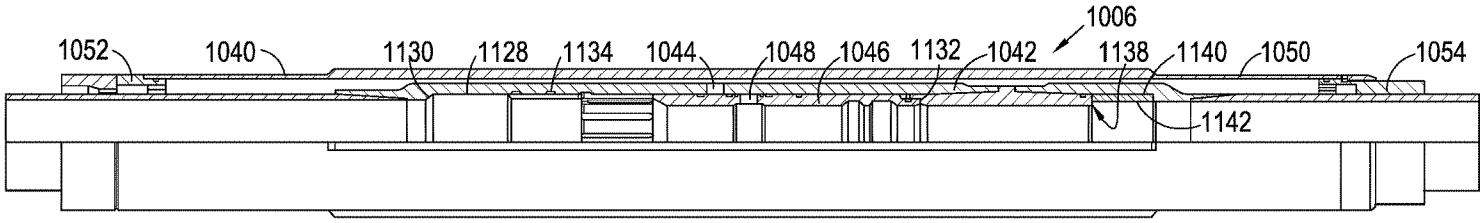
FIG. 21*a* is a longitudinal cut away view of a first downhole of the tool assembly shown in FIG. 20.
Figure 21B:
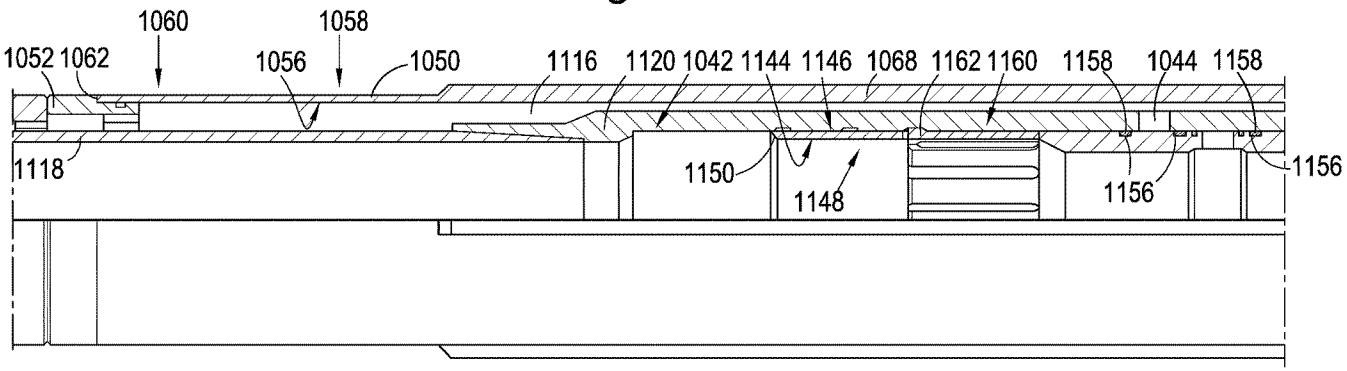
FIG. 21*b* is an enlarged view of an uphole end region of the first downhole tool shown in FIG. 21*a;*
Figure 21C:
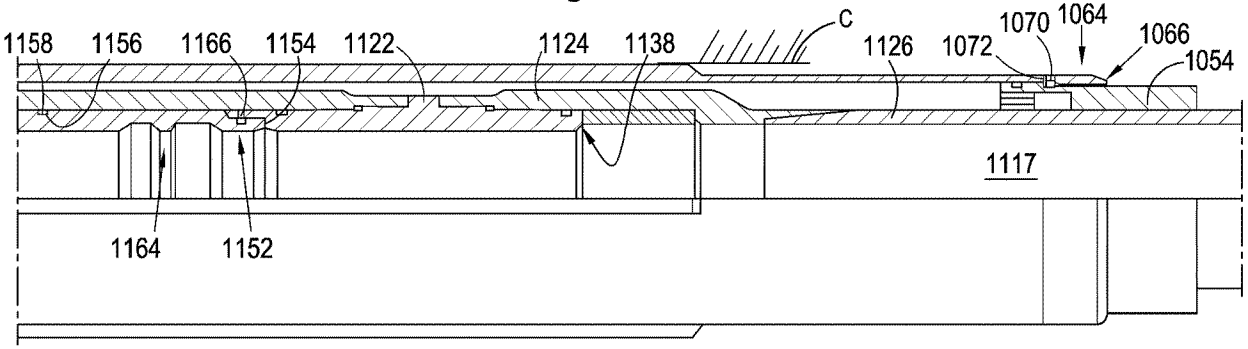
FIG. 21*c* is an enlarged view of a downhole end region of the first downhole tool shown in FIG. 21*a;*
Figure 21E:
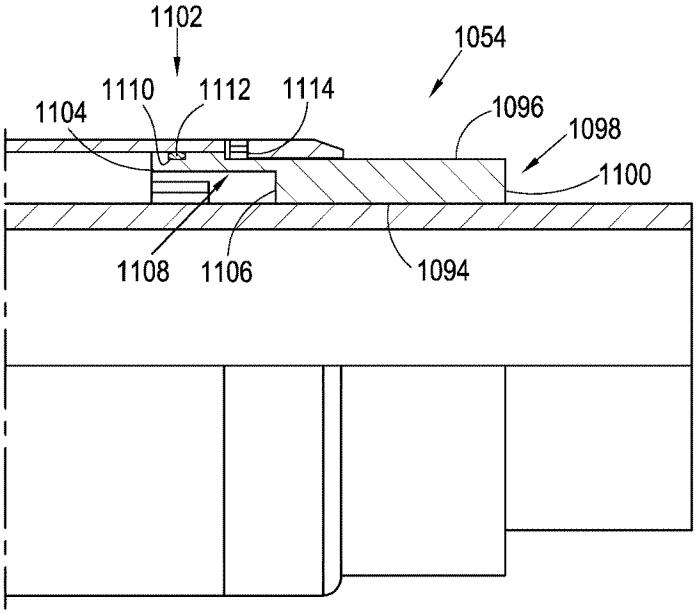
FIG. 21*e* is a further enlarged view of the downhole end region of the first downhole tool shown in FIG. 21*a;*
Figure 21D:
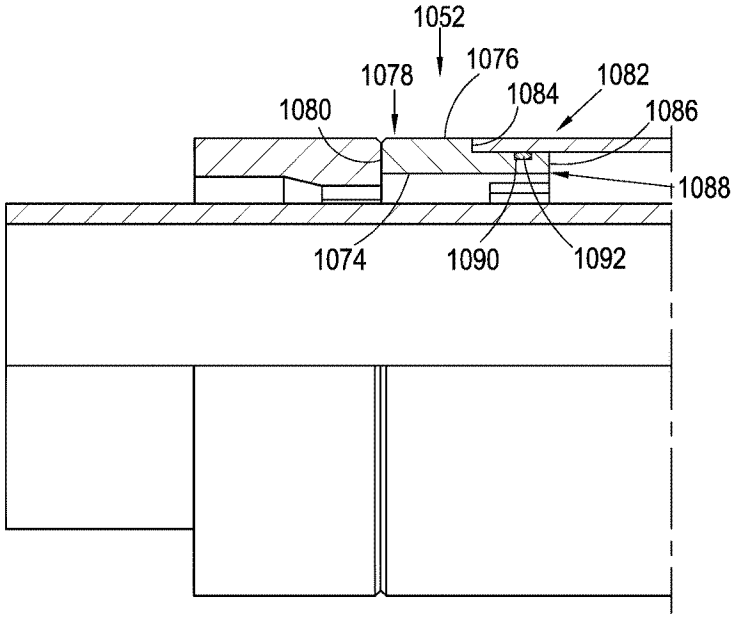
FIG. 21*d* is a further enlarged view of the upper end region of the first downhole tool shown in FIG. 21*a;*

As shown in FIG. 21*a*, a recess 1128 is provided in the inner housing 1042, the recess 1128 formed in the second module 1120 of the inner housing 1042. The recess 1128 is bounded by an upper shoulder 1130 and a lower shoulder 1132, the recess 1128 accommodating axial movement of the sliding sleeve 1046 in use.

Collet grooves 1134 are also formed in the inner housing 1042 for receiving collet fingers of the sliding sleeve 1046 in use.

A lower end face 1136 of the third module 1122 of the inner housing 1042 defines an angled shoulder 1138.

A second recess 1140 is provided in the inner housing 1042, the second recess 1140 formed between the third module 1122 and fourth module 1124 of the inner housing 1042 and receiving an identifier in the form of an electromagnetic coil 1142.

The sliding sleeve 1046 is generally tubular in construction and is disposed in the recess 1128 of the inner housing 1042. The sliding sleeve 1046 has an inner surface 1144, an outer surface 1146, an upper end 1148 defining upper end face 1150 and a lower end 1152 defining lower end face 1154. Grooves 1156 are formed in the outer surface 1146 of the sleeve 1046 on either side of the flow port 1048, each groove 1156 receiving a seal 1158. In use, the seals 1158 prevent fluid bypass between the inner housing 1042 and the sleeve 1046.

A collet 1160 is formed in the sleeve 1046, the collet 1160 having a plurality of circumferentially arranged fingers 1162 configured to engage the collet grooves 1134 in the inner housing 1042.

A profile in the form of keyway profile 1164 is formed in the inner surface 1144 of the sleeve 1046, the keyway 1164 configured for engagement with the actuator 1016 to move the first downhole tool 1006 from a closed configuration in which fluid passage between the tool annulus and the axial throughbore is prevented to an open configuration in which fluid passage between the tool annulus and the axial throughbore is permitted.

The sleeve 1046 is initially axially restrained relative to the inner housing 1042 by a retainer in the form of one or more shear pin 1166, the shear pin 1166 securing the sleeve 1046 relative to the inner housing 1042 until a sufficient actuation force is applied to shear the pin 1166, as described further below.

Figure 22A:
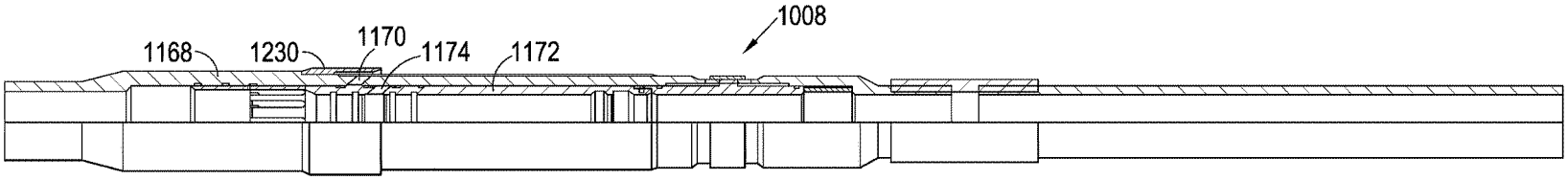
FIG. 22*a* is a longitudinal cut away view of a second downhole tool of the tool assembly shown in FIG. 20.
Figure 22B:
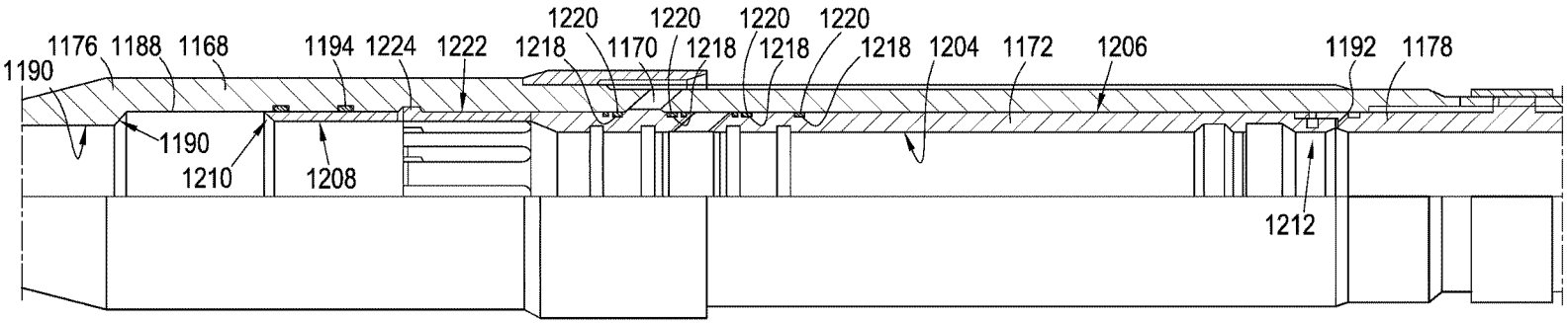
FIG. 22*b* is an enlarged view of an uphole end region of the second downhole tool shown in FIG. 22*a;*
Figure 22C:
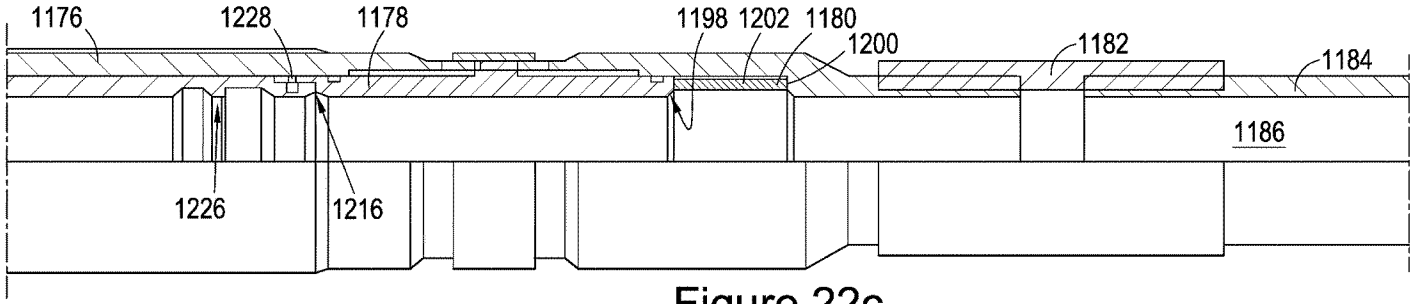
FIG. 22*c* is an enlarged view of a downhole end region of the first downhole tool shown in FIG. 22*a;*
Figure 23A:
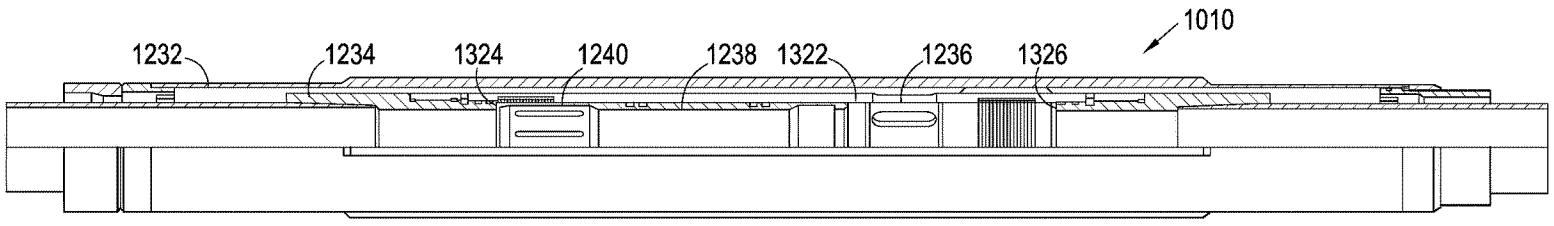
FIG. 23*a* is a longitudinal cut away view of a production tool of the tool assembly shown in FIG. 20.
Figure 23B:
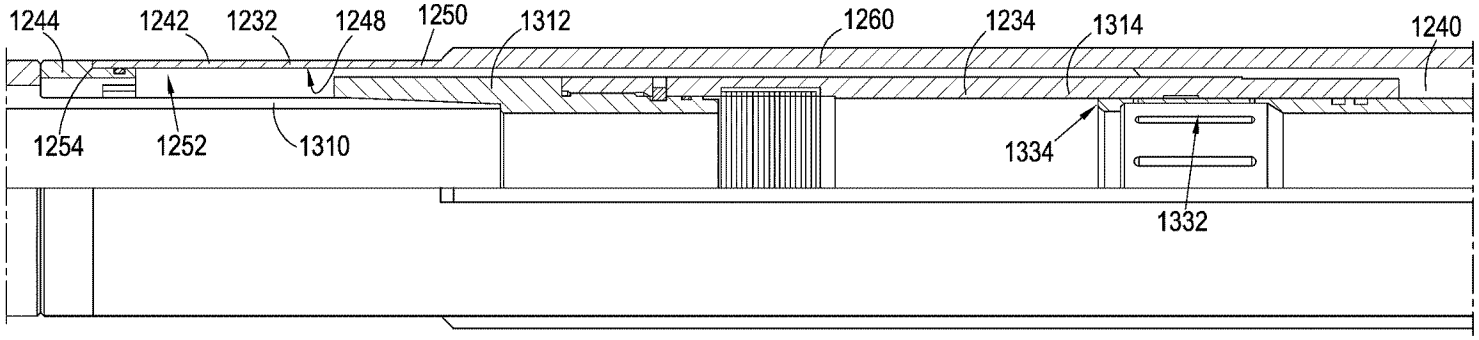
FIG. 23*b* is an enlarged view of an uphole end region of the production tool shown in FIG. 23*a;*
Figure 23C:
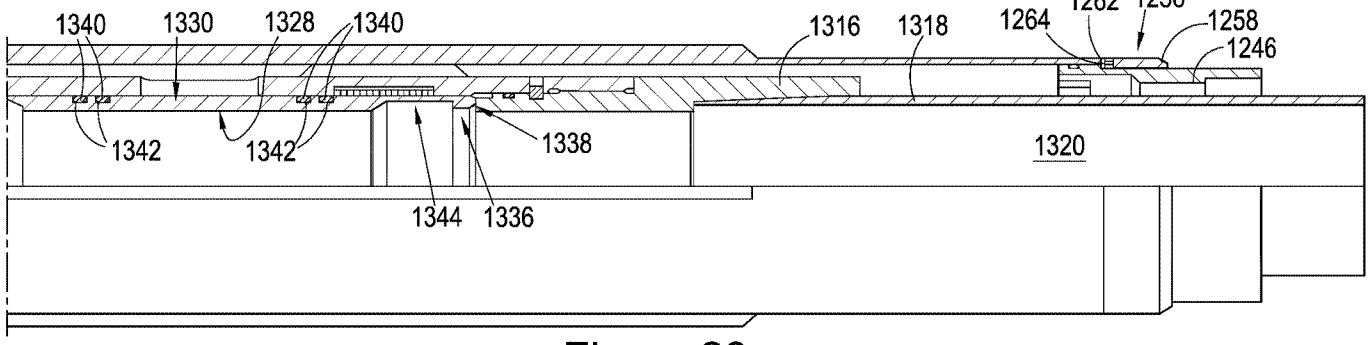
FIG. 23*c* is an enlarged view of a downhole end region of the production tool shown in FIG. 23*a;*
Figure 23E:
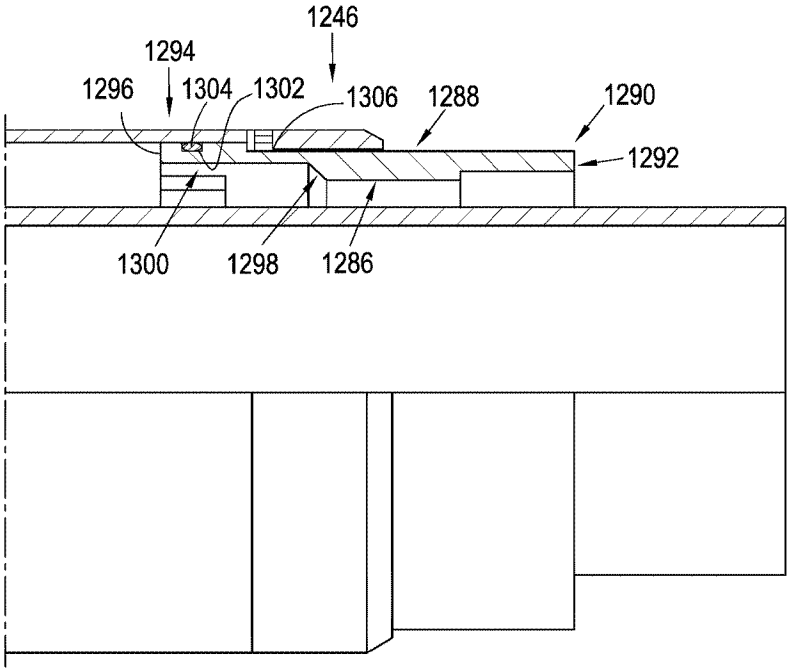
FIG. 23*e* is a further enlarged view of the downhole end region of the production tool shown in FIG. 23*a;*
Figure 23D:
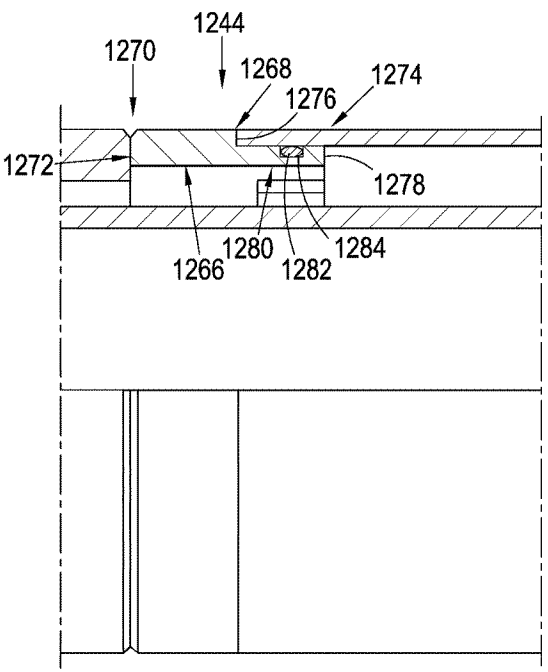
FIG. 23*d* is a further enlarged view of the upper end region of the production tool shown in FIG. 23*a;*

A second downhole tool 1008 according to this embodiment is shown in FIGS. 22*a* to 22*c* and comprises a fracture tool of the tool assembly 1000. The second downhole tool 1008 also takes the form of a sliding sleeve device.

The fracture tool 1008 has a housing 1168 having a number of circumferentially arranged flow ports or fracture ports 1170 extending therethrough, and a sliding sleeve 1172 which in the illustrated embodiment also has a lateral flow port 1174. In use, the fracture tool 1008 is actuable between a closed configuration in which fluid flow through the ports 1170, 1174 is prevented or restricted and an open configuration in which fluid flow through the flow ports 1170, 1174 is permitted.

The housing 1168 of the fracture tool 1008 is generally tubular and in the illustrated embodiment is modular in construction having a first module 1176, a second module 1178, a third module 1180, a fourth module 1182, and a fifth module 1184. On assembly, the modules 1176, 1178, 1180, 1182 and 1184 define an axial throughbore 1186 of the fracture tool 1008. Providing a number of separate modules simplifies manufacture of the fracturing tool 1008. However, it will be recognised that the housing 1168 may alternatively comprise a unitary component.

In the illustrated embodiment, the fracture ports 1170 are provided in the first module 1176 and are angled relative to the longitudinal axis of the tool 1008 so as to direct fluid in a downhole direction in use (to the right as shown in the figures).

As shown most clearly in FIG. 22*b*, a recess 1188 is provided in an inner surface 1190 of the housing 1244, the recess 1188 formed between the first module 1176 and the second module 1178. The recess 1188 is bounded by an upper shoulder 1190 and a lower shoulder 1192, the recess 1188 accommodating axial movement of the sliding sleeve 1172 in use.

Collet grooves 1194 are also formed in the inner surface 1190 of the housing 1168 for receiving collet fingers of the sliding sleeve 1172 in use.

A lower end face 1196 of the third module 1180 of the housing 1168 defines an angled shoulder 1198.

A second recess 1200 is provided in the housing 1168, the second recess 1200 formed between the second module 1178 and the third module 1180 of the housing 1168 and receiving an identifier in the form of an electromagnetic coil 1202.

The sliding sleeve 1172 is generally tubular in construction and is disposed in the recess 1188 of the housing 1168. The sliding sleeve 1172 has an inner surface 1204, an outer surface 1206, an upper end 1208 defining upper end face 1210 and a lower end 1212 defining lower end face 1214. The lower end 1212 of the sleeve 1172 also defines an angled shoulder 1216.

Grooves 1218 are formed in the outer surface 1206 of the sleeve 1172 on either side of the flow ports 1170, each groove 1218 receiving a seal 1220. In use, the seals 1220 prevent fluid bypass between the housing 1168 and the sleeve 1172.

A collet 1222 is formed in the sleeve 1172, the collet 1222 having a plurality of circumferentially arranged fingers 1224 configured to engage the collet grooves in the housing 1168.

A profile in the form of keyway profile 1226 is formed in the inner surface 1204 of the sleeve 1172, the keyway 1226 configured for engagement with the actuator 1016 to move the fracture tool 1008 from the closed configuration and the open configuration.

The sleeve 1172 is initially axially restrained relative to the housing 1168 by a retainer in the form of one or more shear pin 1228, the shear pin 1228 securing the sleeve 1172 relative to the housing 1168 until a sufficient actuation force is applied to shear the pin 1228, as described further below.

In the illustrated embodiment, a cowell 1230 is formed or otherwise provided on the housing 1168, the cowell 1230 assisting in directing fluid in a downhole direction (to the right as shown in the figures).

A production tool 1010 according to this embodiment of the invention is shown in FIGS. 23*a* to 23*e*. The production tool 1010 takes the form of a sliding sleeve device. In the illustrated embodiment, three production tools 1010 are provided, although it will be recognised that any number of production tools 1010 may be provided as required.

The production tool 1010 has an outer housing 1232, an inner housing 1234 having a lateral flow port 1236 and a sliding sleeve 1238 which in the illustrated embodiment also has a lateral flow port 1240. In use, the production tool 1010 is actuable between a closed configuration in which fluid flow through the flow ports 1236, 1240 is prevented or restricted and an open configuration in which fluid flow through the flow ports 1236, 1240 is permitted.

The outer housing 1232 of the production tool 1006 is generally tubular and comprises a body 1242, an upper end ring 1244 and a lower end ring 1246.

The body 1242 of the outer housing 1232 has an inner surface 1248, an outer surface 1250, an upper end 1252 defining upper end face 1254 and a tapered lower end 1256 defining lower end face 1258. The outer surface 1250 defines, or is provided with, a number of circumferentially spaced and radially extending centraliser blades 1260 and, in use, the centraliser blades 1260 offset the production tool 1010 from the surrounding casing or bore wall C. A bore 1262 is provided in the body 1242 towards the lower end 1256, the bore 1262 receiving a grub screw 1264 which secures the body 1242 to the lower end ring 1246.

The upper end ring 1244 is generally tubular and forms the uphole end of the production tool 1010 in use (left end as shown in the figures). The upper end ring 1244 has an inner surface 1266, a stepped outer surface 1268, an upper end 1270 defining upper end face 1272 and lower end 1274 defining lower end faces 1276, 1278, the lower end face 1278 disposed on a flange portion 1280 of the upper end ring 1244. A groove 1282 is formed in the outer surface 1268 and a seal 1284 is disposed in the groove 1282.

On assembly, the upper end 1252 of the body 1242 is disposed on the flange portion 1280 of the upper end ring 1244 and abuts the end face 1276, the seal 1284 preventing leakage between the body 1242 and the upper end ring 1244. The upper end face 1272 abuts a lower end ring of the adjacent production tool 1010 (or in the case of the uppermost production tool, the lower end of the fracture tool 1008), the upper end ring 1244 of the production tool 1010 and the lower end ring of the adjacent production tool 1010 (or fracture tool 1008) joined by a weld connection (not shown) or other suitable means.

The lower end ring 1246 is generally tubular and forms the downhole end of the production tool 1010 in use (right end as shown in the figures). The lower end ring 1246 has a stepped inner surface 1286, an outer surface 1288, a lower end 1290 defining lower end face 1292 and an upper end 1294 defining upper end faces 1296, 1298, the upper end face 1296 disposed on a flange portion 1300 of the lower end ring 1246. A groove 1302 is formed in the outer surface 1288 and a seal 1304 is disposed in the groove 1302. In addition, a bore 1306 is provided in the lower end ring 1246, the bore 1306 receiving the grub screw 1264.

On assembly, the lower end 1256 of the body 1242 is disposed on the outer surface 1288 of the lower end ring 1246, the grub screw 1264 securing the body 1242 to the lower end ring 1246 and the seal 1304 preventing leakage between the body 1242 and the lower end ring 1246.

The inner housing 1234 of the production tool 1010 is disposed radially inwards of the outer housing 1232 and the inner housing 1234 and the outer housing 1232 are radially spaced so as to provide a tool annulus 1308 therebetween. As shown, the annulus 1308 extends through the entire production tool 1010.

In the illustrated embodiment, the inner housing 1234 is modular in construction having a first module 1310, a second module 1312, a third module 1314 having the lateral flow port 1240, a fourth module 1316 and a fifth module 1318. On assembly, the modules 1310, 1312, 1314, 1316 and 1318 define an axial throughbore 1320 of the production tool 1010. Providing a number of separate modules simplifies manufacture of the production tool 1010. However, it will be recognised that the inner housing 1234 may alternatively comprise a unitary component.

As shown in FIG. 23, a recess 1322 is provided in the inner housing 1234, the recess 1322 formed between the second, third and fourth modules 1312, 1314, 1316 of the inner housing 1234. The recess 1322 is bounded by an upper shoulder 1324 and a lower shoulder 1326, the recess 1322 accommodating axial movement of the sliding sleeve 1238 in use.

The sliding sleeve 1238 is generally tubular in construction and is disposed in the recess 1322 of the inner housing 1234. The sliding sleeve 1238 has an inner surface 1328, an outer surface 1330, an upper end 1332 defining upper end face 1334 and a lower end 1336 defining a lower end face 1338. Grooves 1340 are formed in the outer surface 1330 of the sleeve 1238, each groove 1340 receiving a seal 1342. In use, the seals 1342 prevent fluid bypass between the inner housing 1234 and the sleeve 1238.

A profile in the form of keyway profile 1344 is formed in the inner surface 1328 of the sleeve 1238, the keyway 1344 configured for engagement with an actuator to move the production tool 1010 from a closed configuration in which fluid passage between the tool annulus and the axial throughbore is prevented to an open configuration in which fluid passage between the tool annulus and the axial throughbore is permitted. In some embodiments, the production tool 1010 may be configured for activation by the actuator 1016, in which case the keyway 1344 will correspond to the keyways of the first and/or second downhole tools 1006, 1008. However, in the illustrated embodiment, the keyway 1344 defines a different profile from that of the keyways of the first and/or second downhole tools 1006, 1008, such that the actuator 1016 can pass over the production tool 1010 without activating it.

Figure 24A:
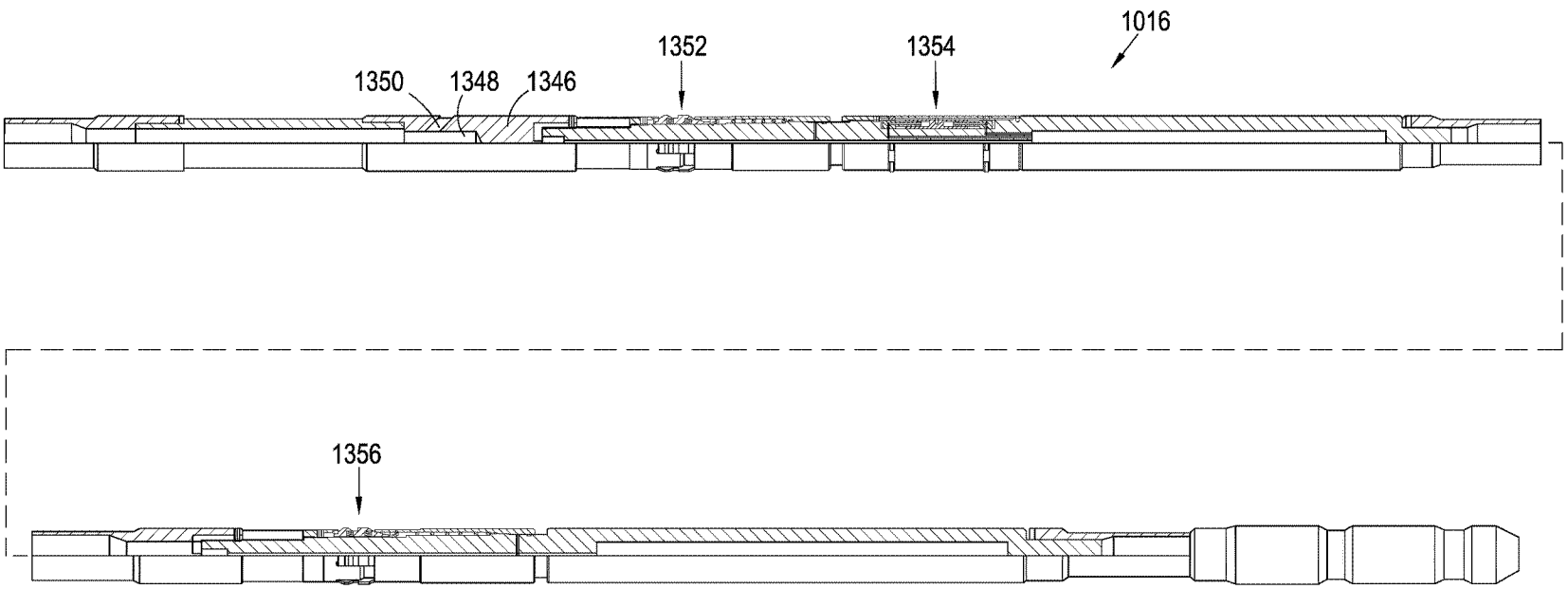
FIG. 24*a* is a longitudinal cut away view of a shifting tool of the tool assembly shown in FIG. 20.
Figure 24B:
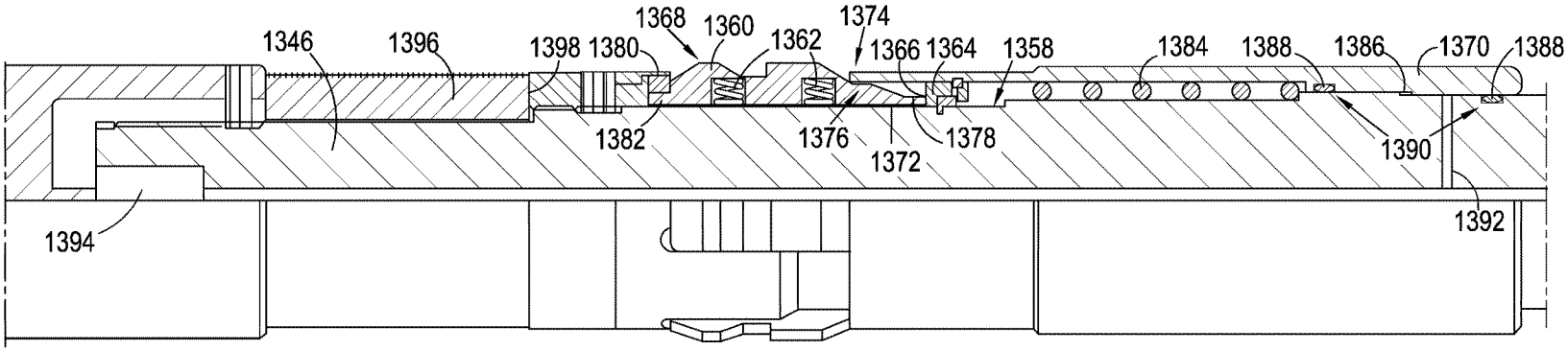
FIG. 24*b* is an enlarged view of part of the shifting tool of FIG. 24*a*, showing an upper keyway assembly.
Figure 24C:
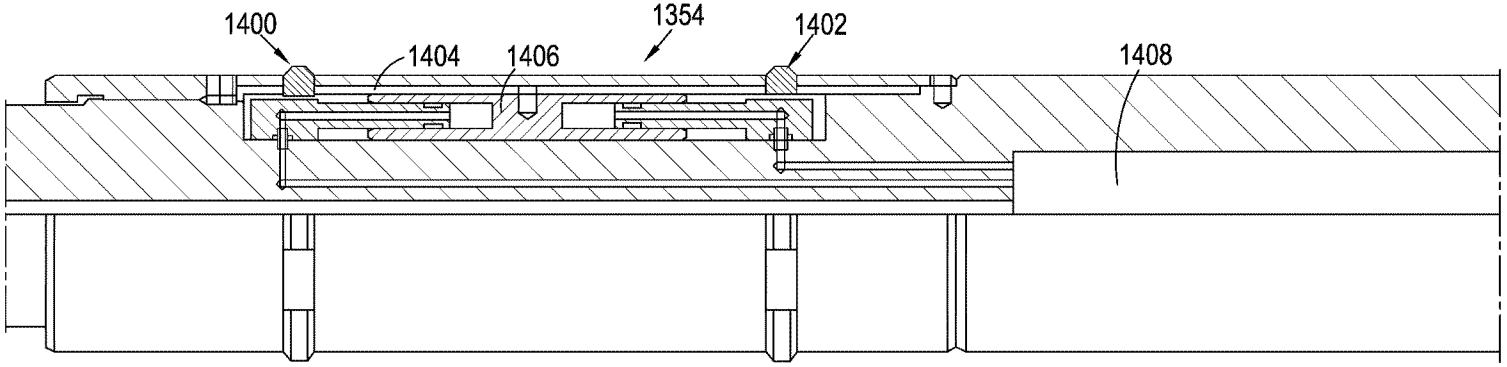
FIG. 24*c* is an enlarged view of part of the shifting tool of FIG. 24*a*, showing a lock assembly.

An actuator 1016 according to this embodiment is shown in FIGS. 24*a* to 24*c* and comprises a shifting tool of the tool assembly 1000. As described above, the shifting tool 1016 is disposed on an inner tubular string 1018 which is run into a borehole, such as the borehole 2, with the tubular string 1014 and which may be withdrawn through the tubular string 1014. In the illustrated embodiment, the inner tubular string 1018 comprises a washpipe string, although other conveyance means may be used where appropriate.

The shifting tool 1016 comprises a mandrel 1346 having a fluid flow path 1348 therethrough and having a lateral flow port 1350, an upper keyway assembly 1352, a lock assembly 1354 operatively associated with the upper keyway assembly 1352 and a lower keyway assembly 1356 axially spaced from the upper assembly 1352.

The upper keyway assembly 1352 is located in a recess 1358 in the mandrel 1346 and is positioned downhole of the lateral flow port 1350. The upper keyway assembly 1352 comprises a shifting key 1360 and, in use, the key 1360 is moveable between a radially retracted position and a radially extended position. The key 1360 is biased radially outwards by springs 1362 (two springs 1362 are shown). Each key 1360 is disposed in a seat 1364 provided in the recess 1358, the downhole seat surface 1366 defines a wedge profile. An outer surface 1368 of the key 1360 is profiled and, in use, engages the corresponding keyway profiles in each of the first downhole tool 1006 and the fracturing tool 1008, as will be described further below.

An annular collar 1370 is disposed around and is axially moveable relative to the mandrel 1346, the collar 1370 arranged to partially extend over a downhole end 1372 of the key 1360, an uphole end 1374 of the collar 1370 extending over ledges 1376, 1378 provided in an outer surface 1368 of key 1360 to retain the key 1360 in the recess 1358. The ledges 1376, 1378 are arranged so that when the collar 1370 is positioned over the upper ledge 1376, the key 1360 is retained in the radially retracted position and when the collar 1370 is positioned over the lower ledge 1378 the key 1360 is retained in the radially extended position. The mandrel

1346 also defines a flange or lip 1380 which extends in a downhole direction over a flange 1382 provided on the key 1360, the lip 1380 and flange 1382 also acting to retain the key 1360 in the recess 1358.

The collar 1370 is biased towards a first axial position relative to the mandrel 1346 by a spring 1384, in which position the collar 1370 extends over the upper ledge and so retains the key 1360 in the radially retracted position. The collar 1370 may be moved from the first axial position to a second axial position against the bias of the spring 1384 by directing fluid into a chamber 1386 defined between the collar 1370 and the mandrel 1346. The chamber 1386 is isolated by seals 1388 provided in grooves 1390 on either side of the chamber 1386 and receives fluid via a passage 1392. In the illustrated embodiment, one of the seals 1388 is disposed in the mandrel 1346 and the other seal 1388 is disposed in the collar 1370. However, it will be recognised that the seals 1388 may both be disposed in the collar 1370 or both in the mandrel 1346, where required. In use, and as will be described further below, fluid directed in the chamber 1386 urges the collar 1370 axially away from the key 1360 and so permits the key 1360 to move from its radially retracted position to its radially extended position.

A control system having a control unit 1394 is operatively associated with the shifting tool 1016, the control system acting to control fluid passage to the chamber 1386 and so control the position of the collar 1370 and thus the shifting key 1360.

An indicator 1396 is operatively associated with or forms part of the control system and, in the illustrated embodiment, the indicator 1396 takes the form of an electromagnetic element, specifically an electromagnetic inductance coil. The coil is mounted in a recess 1398 in the mandrel 1346 and is configured for electromagnetic coupling to the indicators of the first downhole tool 1006 and the fracture tool 1008.

In use, and as will be described further below, the control system receives an indication in the form of an induced signal from the indicator 1396 to indicate that the shifting tool 1016 has passed the indicator of one of the downhole tools 1006, 1008, the control system initiating the flow of fluid into the chamber 1386 to shift the collar 1370 and permit the key 1360 to move from its radially retracted position to its radially extended position.

The lock assembly 1354 is located downhole of the upper keyway assembly 1352 and comprises a first, upper, set of circumferentially spaced dogs 1400 and a second, lower, set of circumferentially spaced dogs 1402. The dogs 1400, 1402 are initially supported in a radially extended position on a sliding sleeve 1404 which in turn is supported on a piston assembly 1406 disposed in a recess 1408 provided in the mandrel 1346.

In use, movement of the piston assembly 1406 first de-supports the upper dogs 1400 so that the dogs 1400 move from a radially extended position to a radially retracted position. Movement of the piston assembly 1406 then de-supports the second set of dogs 1402 so that these dogs 1402 move from a radially extended position to a radially retracted position.

A power source, in the illustrated embodiment, a battery pack 1408 is also provided, together with a fluid pump for directing fluid into the chamber 1386.

In the illustrated embodiment, the shifting tool mandrel 1016 is modular in construction. Providing a number of separate modules simplifies manufacture of the shifting tool. However, it will be recognised that the shifting tool may alternatively comprise a unitary component.

The lower keyway assembly is of substantially the same construction as the upper keyway assembly and operates in the same manner to the upper keyway assembly. In use, the lower keyway assembly is axially spaced from the upper keyway assembly to that after the upper keyway has closed the fracture tool 1008 and is move uphole, the lower keyway will engage the keyway profile of the first downhole tool 1006 to move the first downhole tool from the open configuration to the closed configuration.

Operation of this embodiment of the invention will now be described with reference to FIGS. 20*a* to 24*c* and also to FIGS. 25*a* to 25*o*.

With reference again to FIG. 20, the lower packer 1002 is run into the borehole on a work string. On reaching the required depth, the lower packer 1002 is set to define a base at the toe of the completion which provides a known depth and permits an operator to apply fluid pressure above the packer 1002.

Once the lower packer 1002 has been set, the work string is withdrawn to surface (not shown) and the tool assembly 1000 comprising the tubular string 1014 and the inner tubular string 1016 are run into the borehole. During run-in, fluid is circulated through the assembly 1000 to assist in the discharge of any debris and to lubricate the assembly 1000 as it progresses.

The assembly 1000 is then stabbed into the lower packer 1002, the latch 1020 engaging the lower packer 1002 to secure the assembly 1000 to the lower packer 1002, as shown in FIG. 20. Once located in the lower packer 1002, the operator is able to apply fluid pressure within the assembly 1000 where required.

Next, the upper packer 1004 is set, such that the upper packer 1004 and the lower packer 1002 isolate a formation zone to be treated.

As shown in FIG. 20, the first downhole tool 1006, the fracture tool 1006 and production tools 1010 are all in their respective closed configuration.

As described above, the shifting tool 1016 is provided within the tool assembly 1000, the shifting tool 1016 disposed on the inner tubular string 1016 and operable to perform operations on the first downhole tool 1006 and the fracture tool 1008.

Applying a first tensile force from surface shifts the shifting tool 1016 uphole (to the left as shown on the figures) until the electromagnetic element 1396 of the shifting tool 1016 passes the electromagnetic element 1142 disposed within the first downhole tool 1006. On passing through the electromagnetic element 1142, the control unit 1394 on the shifting tool 1016 actuates the upper keyway assembly 1352 from its initial radially retracted configuration to its radially extended position. As described above, this is achieved by directing hydraulic fluid into the chamber 1386 defined between the collar 1370 and the mandrel 1346 of the shifting tool 1016, causing the collar 1370 to shift downhole (to the right as shown on the figures) and against the action of the spring 1384. The collar 1370 thus uncovers the key 1360 which extends radially outwards under the action of the springs 1362 from the radially retracted position to the radially extended position. With the upper keyway assembly 1352 in its radially extended position, the key 1360 will engage the corresponding keyway profile 1164 in the sliding sleeve 1046 of the first downhole tool 1006. With the key 1360 engaged with the corresponding keyway profile 1164, continued upward movement of the shifting tool 1016 shears the shear pin 1166 permitting the sliding sleeve 1046 to move. As the dogs 1400 are in their initial radially extended position, movement of the sliding sleeve 1046 is limited since the dogs 1400 will engage the shoulder 1138, this distance corresponding to the distance required to shift the lateral flow port of the sliding sleeve 1046 into alignment with the lateral flow port 1044. The engagement between the upper lock dog and the shoulder provides a positive indication to the operator at surface that the first downhole tool has been moved to its open configuration.

Thus, the first downhole tool 1006 is moved from its initial closed configuration to an open configuration permitting passage of fluid between the tool annulus 1116 and the axial throughbore 1117.

In order to disengage the dogs 1400, fluid in the chamber 1386 is bled off causing the collar 1370 to move in an uphole direction relative to the mandrel 1346 (to the left as shown in the figures). Under the action of the spring 1384, the collar 1370 engages the key 1360 moving the key 1360 from the radially extended position to the radially retracted position.

Reference is now made in particular to FIGS. 25*a* to 25*e* which show operation of the fracture tool 1008 by the shifting tool 1016.

Figure 25A:
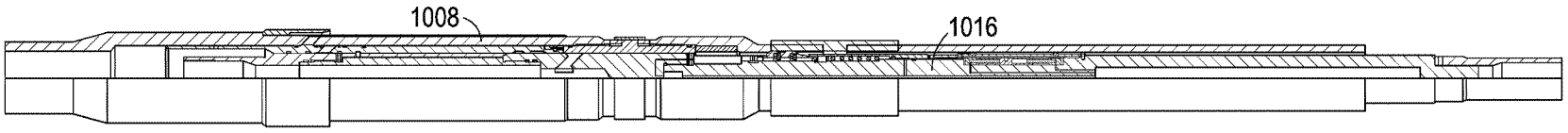
FIGS. 25*a* to 25*o* show operation of the fracture tool by the shifting tool.
Figure 25B:
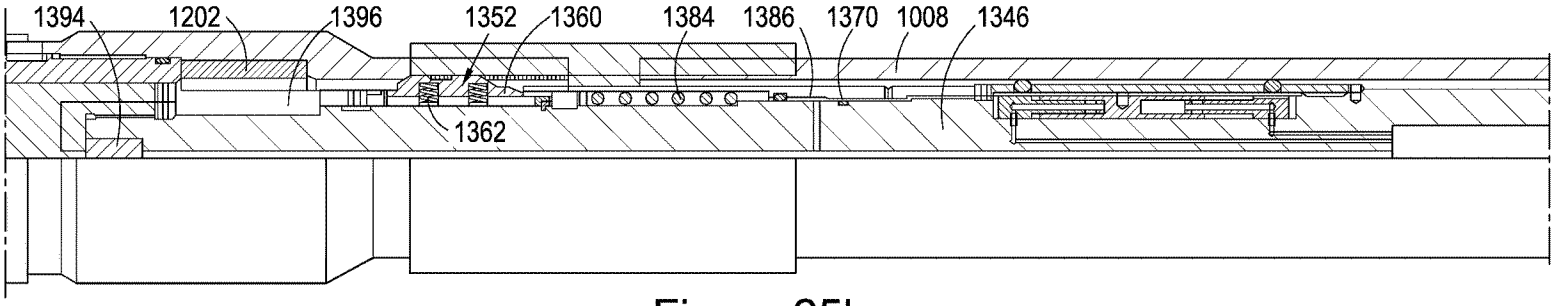
Figure 25C:
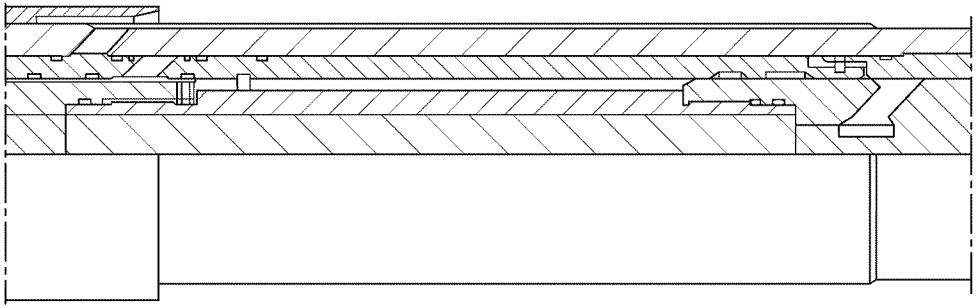

Applying a further tensile force from surface shifts the shifting tool 1016 uphole (to the left as shown on the figures) until the electromagnetic element 1396 of the shifting tool 1016 passes the electromagnetic element 1202 disposed within the fracture tool 1008, as shown in FIGS. 25*a* to 25*c*.

On passing through the electromagnetic element 1202, the control unit 1394 on the shifting tool 1016 actuates the upper keyway assembly 1352 from its initial radially retracted configuration to its radially extended configuration. As above, this is achieved by directing hydraulic fluid into the chamber 1386 defined between the collar 1370 and the mandrel 1346, causing the collar 1370 to shift downhole relative to the mandrel 1346 (to the right as shown on the figures) and against the action of the spring 1384. The collar 1370 thus uncovers the key 1360 which extends radially outwards under the action of the springs 1362.

Figure 25D:
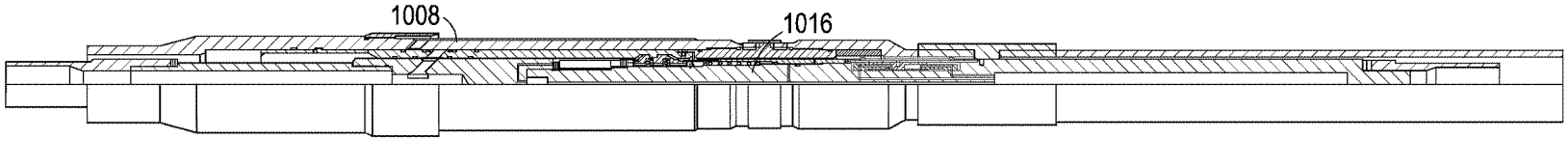
Figure 25E:
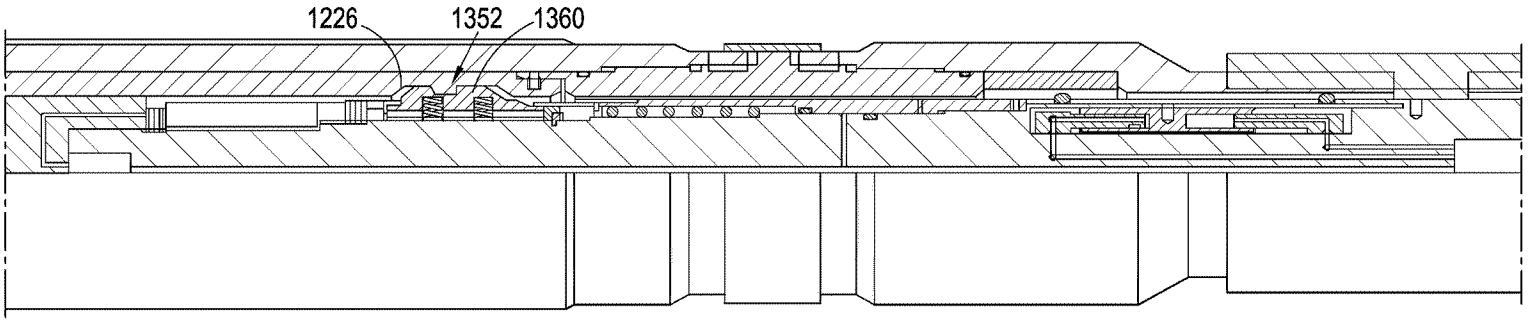
Figure 25F:
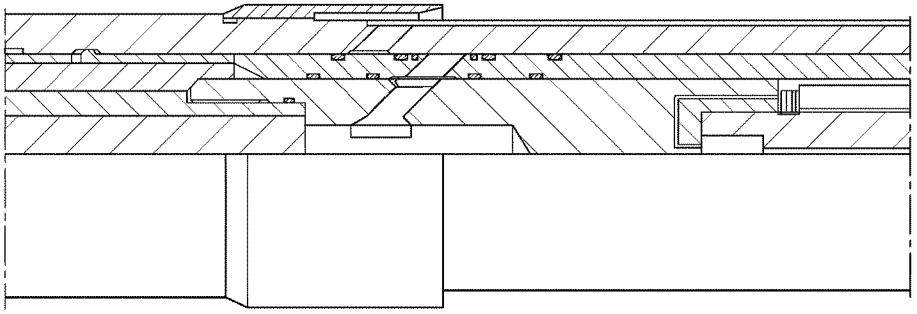

With the upper keyway assembly 1352 in its radially extended position, the key 1360 will engage the corresponding keyway profile 1226 in the sliding sleeve 1172 of the fracture tool 1008 as shown in FIGS. 25*d* to 25*f*.

Figure 25G:
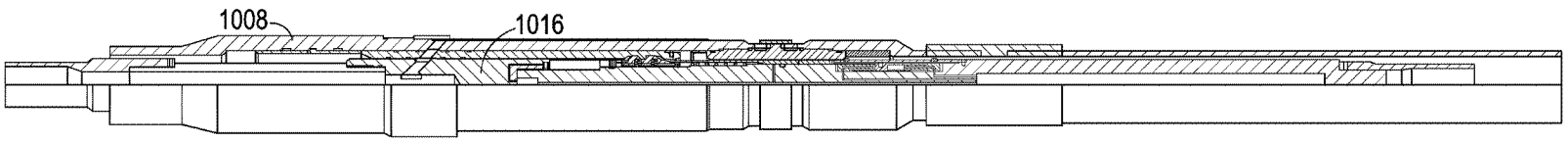
Figure 25H:
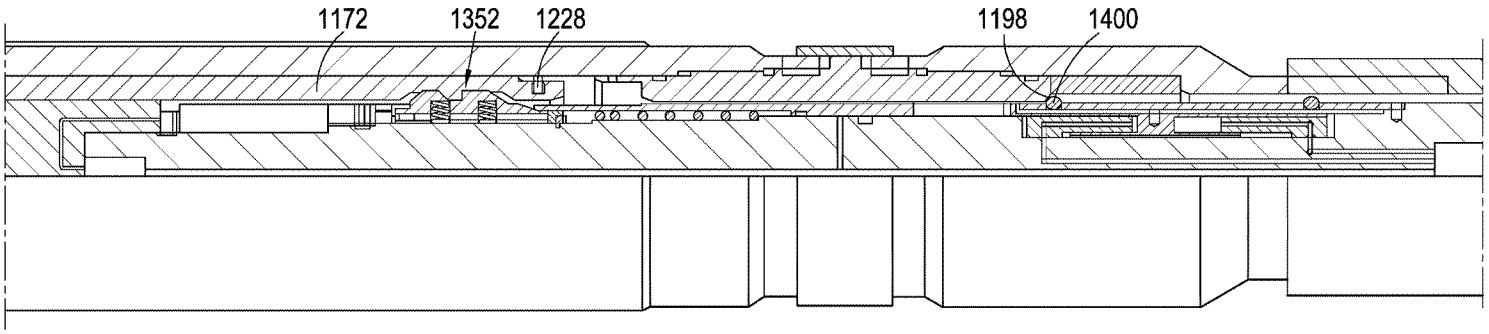
Figure 25I:
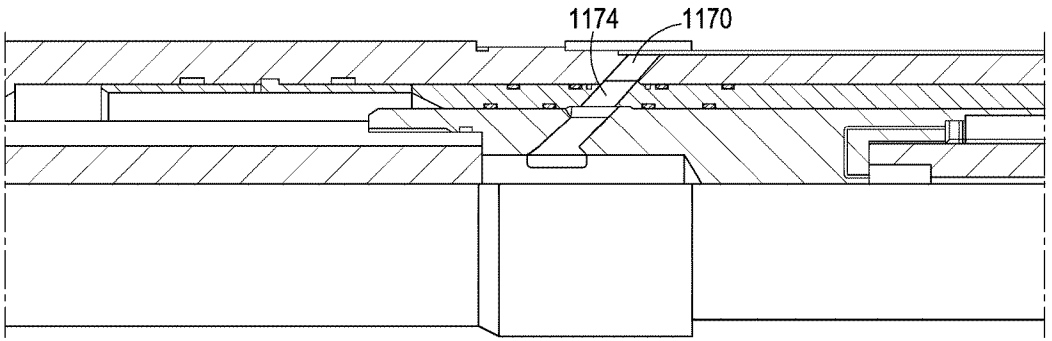

As shown in FIGS. 25*g* to 25*i*, with the key 1360 engaged with the corresponding profile 1226, continued upward movement of the shifting tool 1016 shears the shear pin 1228 permitting the sliding sleeve 1172 to move. As the dogs 1400 are in their radially extended position, movement of the sliding sleeve 1172 of the fracture tool 1008 is limited since the dogs 1400 will engage the shoulder 1198, this distance corresponding to the distance required to shift the lateral flow port 1174 into alignment with the lateral flow ports 1170 of the fracture tool 1008. With the fracture tool 1008 in the open configuration, fracturing fluid may be directed through the assembly 1000 and into the formation.

Figure 25J:
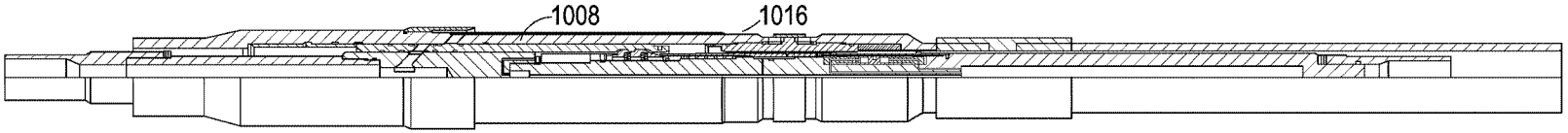
Figure 25K:
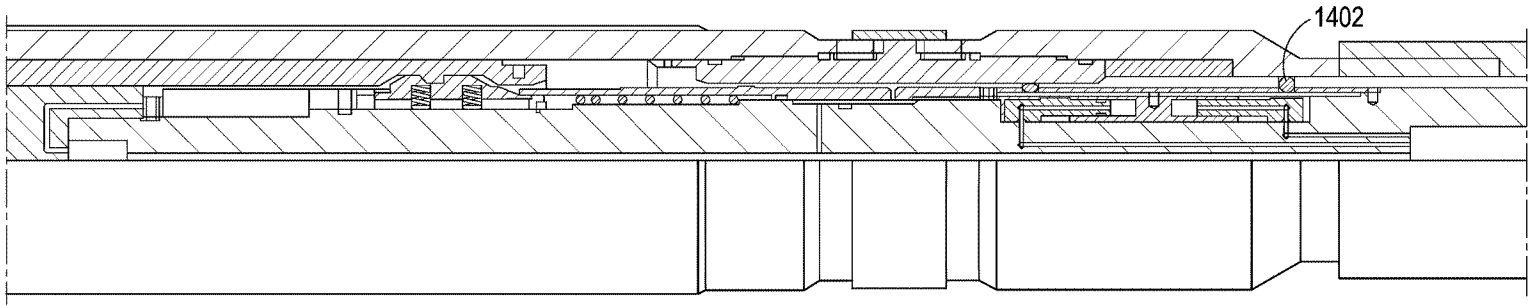
Figure 25L:
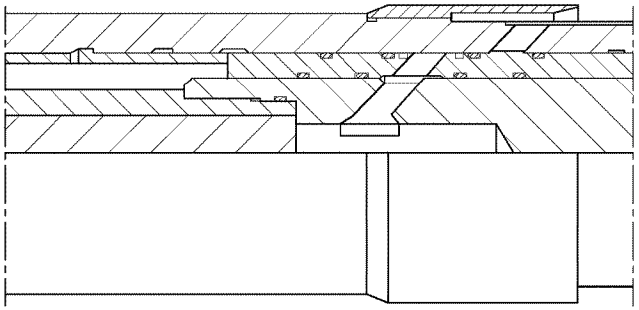
Figure 25M:
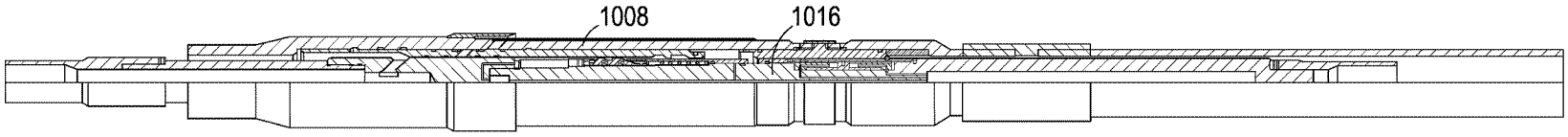
Figure 25N:
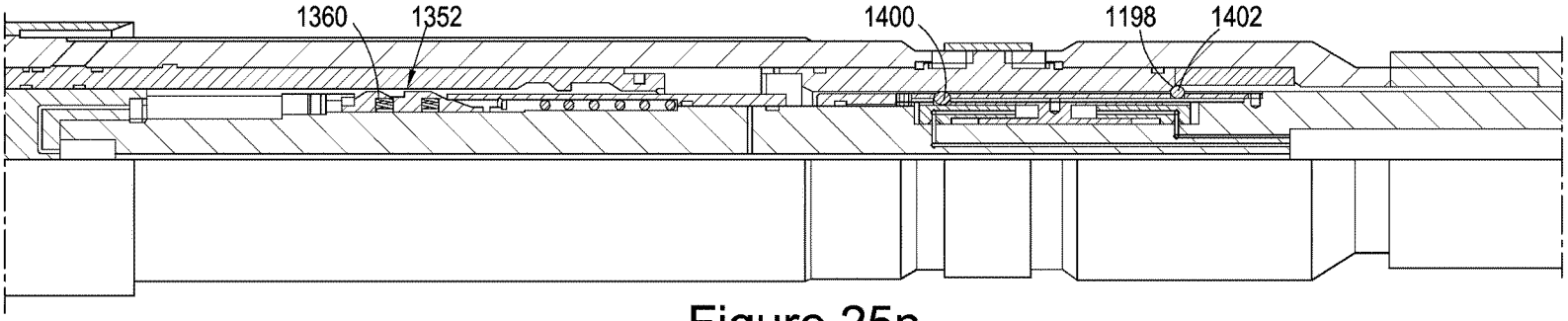
Figure 25O:
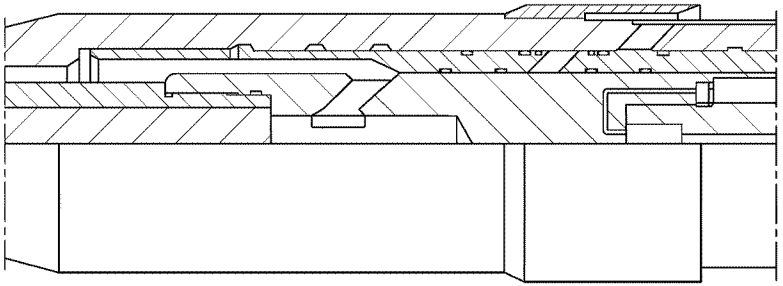

Once the fracturing operation has been completed and it is desired to close the fracture tool 1008, fluid is directed to the uphole side of the floating piston 1406 causing the piston 1406 to shift downhole (to the right as shown in the figures) to de-support the dogs 1400, as shown in FIGS. 25*j* to 25*l*. With the upper keyway assembly still engaged with the sleeve 1172 and the dogs 1400 now in their retracted position, uphole movement of the shifting tool 1016 shifts the sleeve 1172 from its first position to a second position in which the upper end face of the sleeve abuts the shoulder 1190. The key 1360 is then retracted permitting uphole movement of the shifting tool 1016 relative to the fracture tool 1008 until the lower locking dogs 1402—which are in their radially extended position—engage the shoulder 1198, again providing a positive indication to an operator at surface, as shown in FIGS. 25*n* to 25*o*.

Fluid may then be directed to the downhole side (left side as shown in the figures) of the floating piston 1406 de-supporting the dogs 1402 and moving the dogs 1402 from their radially extended position to their radially retracted position. With the upper keyway assembly and both the upper lock dog and the lower lock dog in their radially retracted positions, the shifting tool 1016 may be moved uphole relative to the fracture tool 1008 which is now in its closed position.

Reference is now made to FIGS. 26*a* to 26*f*, which show the first downhole tool 1006 during operation of the assembly 1000.

Figure 26A:
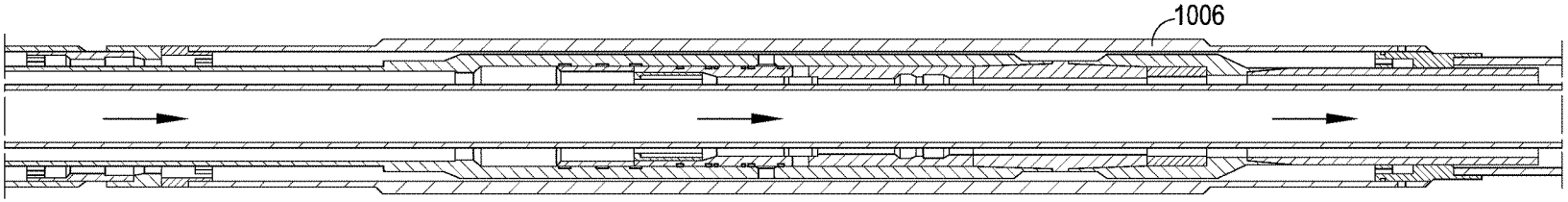
FIGS. 26*a* to 26*f* show the first downhole tool during at stages of operation of the assembly 1000.

FIG. 26*a* shows the first downhole tool during location of the assembly 1000 in the borehole. In this configuration, the first downhole tool defines a closed configuration preventing or restricting passage of fluid through the flow ports which are misaligned.

Figure 26B:
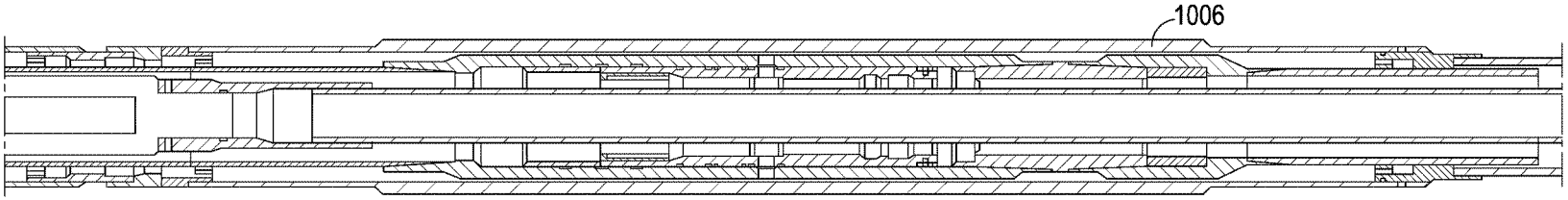

FIG. 26*b* shows the first downhole 1006 after the tool 1006 has been move from the closed configuration shown in FIG. 26*a* to the open configuration in which the ports are aligned.

Figure 26C:
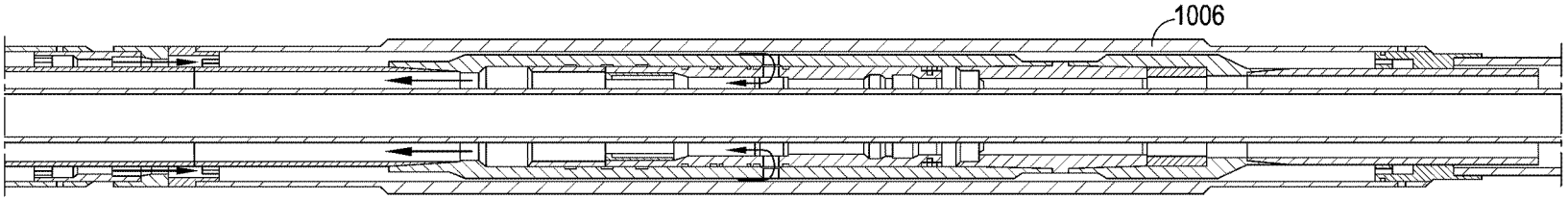

FIG. 26*c* shows the first downhole tool 1006 during the fracturing operation. As shown, during the fracturing operation any fluid returns will enter through the lowermost screen 1012 passing into the tool annulus 1116 into the throughbore 1117 where it can be returned to surface.

Figure 26D:
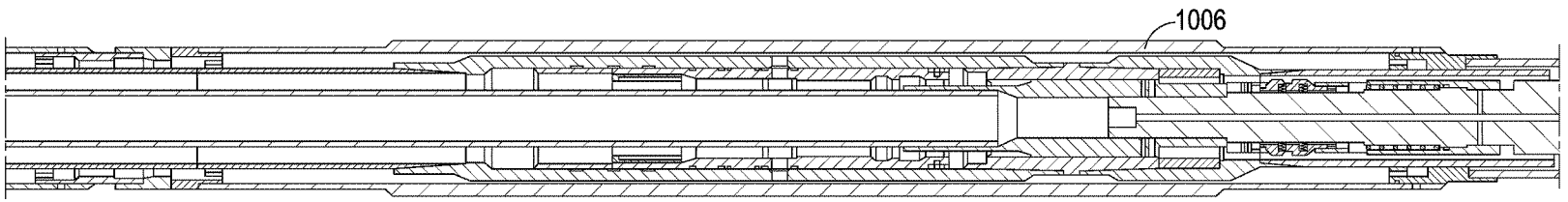
Figure 26E:
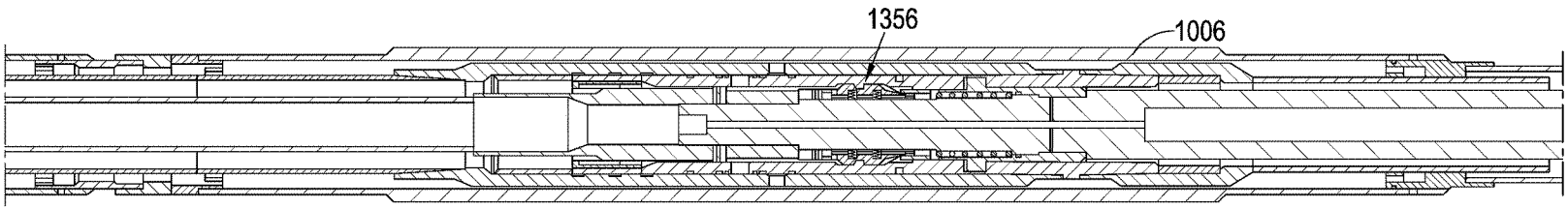
Figure 26F:
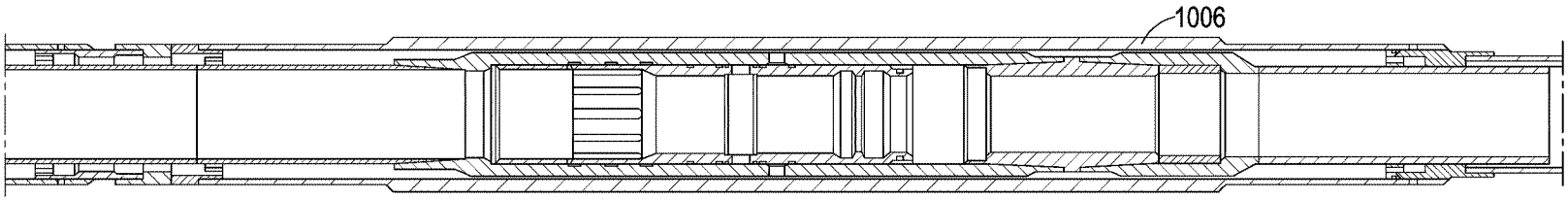

Finally, the first downhole tool 1006 is closed by the lower keyway assembly 1356 of the shifting tool 1016, which operates in a similar manner as to the upper keyway assembly, as shown in FIGS. 26*d* to 26*f*.

With the fracture tool 1008 and the first downhole tool 1006 now both closed, the shifting tool 1016 may be withdrawn to surface.

It will be recognised that the while the terms upper, lower, uphole and downhole have been used, one or more of the tools may alternatively be disposed in other orientations, where required.

It should be understood that the embodiments described herein are merely exemplary and that various modifications may be made thereto without departing from the scope of the invention.

For example, rather than using wash pipe to suspend the mechanical actuator, coiled tubing, wireline or workstring could be used to transport the shifting tools downhole and subsequently actuate successive fracturing and production tools.

The system and mechanical actuator can be used to actuate other downhole tools and cause other downhole operations as well as or instead of the fracturing operation.

The method and apparatus can be used for cased as well as open hole applications.

The invention claimed is:

1. A method for operating a downhole tool, the method comprising the steps of:

(a) running an actuator and a downhole tool downhole simultaneously, the downhole tool disposed on tubing, the actuator operatively associated with an inner string located in the tubing, the actuator and the downhole tool being arranged so that, on running the actuator and the downhole tool downhole, the actuator is located downhole from the downhole tool;

(b) pulling the actuator uphole using the inner string operatively associated with the actuator;

(c) engaging the downhole tool with the actuator;

(d) pulling the actuator uphole to perform a first operation of the downhole tool;

(e) changing the configuration of at least one of the downhole tool and the actuator; and (f) pulling the actuator to perform a second operation of said downhole tool.

2. The method according to claim 1, comprising:

(g) maintaining at least one of a body of the actuator and the inner string operatively associated the actuator in tension throughout steps (b) to (f).

3. The method according to claim 2, wherein step (g) includes at least one of:

maintaining a minimum tensile force on the inner string of between 0 lbs (0 N) and 20,000 lbs (990 kN) throughout steps (b) to (f); and maintaining a minimum tensile force on the inner string of at least 20 lbs (89 N) throughout steps (b) to (f).

4. The method according to claim 2, including the steps of providing a plurality of downhole tools arranged in series and successively operating the downhole tools by repeating steps (b) to (g).

5. The method according to claim 1, including the steps of providing a plurality of the downhole tools arranged in series and successively operating the downhole tools by repeating steps (b) to (f).

6. The method according to claim 1, including pulling the inner string with a predetermined minimum tensile force to perform at least one of the first operation of the downhole tool and the second operation of the downhole tool.

7. The method according to claim 1, wherein the first operation of step (d) includes at least one of:

moving a first portion of the downhole tool relative to a second portion of the downhole tool;

opening a circulation path downhole;

opening a circulation path downhole and then pumping fracturing fluid downhole and directing fracturing fluid out through at least one port of the downhole tool; and circulating fluid in an annulus between an inner diameter of the downhole tool and an outer portion of the inner string.

8. The method according to claim 1, wherein prior to step (e) the method includes locking the actuator and the downhole tool in a configuration in which performance of the second operation is restricted.

9. The method according to claim 1, wherein changing the configuration of at least one of the downhole tool and the actuator according to step (e) includes at least one of:

circulating fluid downhole to cause a pressure differential across a portion of at least one of the downhole tool and the actuator to thereby change the configuration of the downhole tool and/or the actuator; and changing the configuration of at least one of the actuator and the downhole tool mechanically.

10. The method according to claim 1, wherein pulling the actuator to perform the second operation of said downhole tool according to step (f) includes at least one of:

moving a third portion of the downhole tool relative to a fourth portion of the downhole tool; and closing a fluid flow path in the downhole tool.

11. The method according to claim 1, comprising step (h), wherein step (h) includes pulling on the inner string and thereby disengaging the actuator from the downhole tool.

12. The method according to claim 1, including circulating fluid downhole and thereby unlocking the actuator and the downhole tool.

13. The method according to claim 1, wherein performance of the first operation of the downhole tool by pulling the actuator uphole activates a lock provided on at least one of the downhole tool and the actuator to restrict performance of the second operation of the downhole tool, and wherein changing the configuration of at least one of the actuator and the downhole tool deactivates the lock.

14. A system for operating a downhole tool, the system comprising:

an actuator for coupling to a string, the actuator configured to pass through a downhole tool, wherein the actuator and the downhole tool are configured for running downhole simultaneously such that on running the actuator and the downhole tool downhole the actuator is located downhole from the downhole tool and wherein the actuator is selectively engagable with the downhole tool, such that in an engaged position a predetermined minimum tensile force applied to the actuator is transferred to the downhole tool to perform a first operation of said downhole tool and a second operation of said downhole tool; and a lock provided on at least one of the downhole tool and the actuator, wherein the lock is operable between an activated configuration in which performance of the second operation of the downhole tool is restricted and a deactivated configuration, wherein the lock is activated on performance of the first operation of the downhole tool and deactivated by changing the configuration of at least one of the actuator and the downhole tool.

15. The system according to claim 14, wherein at least one of a body of the actuator and the string is arranged to be maintained in tension in use and/or throughout operation of the downhole tool.

16. The system according to claim 14, wherein at least one of:

the lock is configured to be activated on initial engagement of the actuator and the downhole tool; and the lock is configured to be deactivated by a pressure differential controllable by circulation of fluid downhole or by mechanically changing the configuration of at least one of the downhole tool and the actuator.

17. The system according to claim 14, wherein at least one of:

a first portion of the downhole tool is movable relative to a second portion of the downhole tool, the first operation of the downhole tool causing the first portion of the downhole tool to move relative to the second portion of the downhole tool;

the first operation of the downhole tool causes a circulation path to open in the downhole tool;

a third portion of the downhole tool is movable relative to a fourth portion of the downhole tool, the second operation of the downhole tool causing the third portion of the downhole tool to move relative to the fourth portion of the downhole tool; and the second operation of the downhole tool causes a flow path between a throughbore and an exterior of the downhole tool to close.

18. A method for fracturing a formation including the steps of:

(a) coupling a mechanical shifting tool to an inner string and locating the shifting tool downhole simultaneously with a downhole tool, the downhole tool disposed on tubing, the mechanical shifting tool coupled to the inner string located in the tubing, the mechanical shifting tool and the downhole tool arranged so that, on locating the mechanical shifting tool and the downhole tool downhole, the mechanical shifting tool is located downhole from the downhole tool;

(b) applying a tensile force to the inner string and shifting tool to open at least one fracturing fluid flow path;

(c) pumping fracturing fluid downhole along the fracturing fluid flow path to thereby fracture a formation; and (d) applying a tensile force to said inner string and the shifting tool to close the fluid flow path.

19. The method according to claim 18, including maintaining at least one of a body of the mechanical shifting tool and the inner string in tension throughout steps (b) to (d).

20. The method according to claim 18, including fracturing a formation in a plurality of zones by repeating steps (b)-(d) for successive zones.

21. The method according to claim 18, including the steps of:

locating an alternative selective circulation path downhole along a tubing;

coupling a second shifting tool to the inner string and locating the second shifting tool downhole from the first shifting tool;

applying a tensile force to the inner string and shifting tools to open the circulation path with the first shifting tool;

flowing fluid along the alternative circulation path; and applying a tensile force to the inner string and shifting tools to close the alternative circulation path with the second shifting tool.

22. The method according to claim 21, wherein the alternative circulation path is a reverse circulation path and the step of flowing fluid along the alternative circulation path includes returning at least some fracturing fluid to surface.

23. The method according to claim 18, including restricting performance of step (d) until fluid is circulated within an annulus between the inner string and a tubing.

24. The method according to claim 18, wherein performance of the first operation of the downhole tool by pulling the actuator uphole activates a lock provided on at least one of the downhole tool and the actuator to restrict performance of the second operation of the downhole tool, and wherein changing the configuration of at least one of the actuator and the downhole tool deactivates the lock.

25. A downhole completion method, comprising:

deploying a downhole system into a wellbore, wherein the downhole system includes a completion system and an activator tool mounted within the completion system such that the completion system and the activator tool are deployed into the wellbore simultaneously, the completion system disposed on tubing, the activator tool operatively associated with an inner string located in the tubing, the activator tool and the completion system arranged so that, on deploying the activator tool and the completion system downhole, the activator tool is located downhole from at least a portion of the completion system; and withdrawing the activator tool from the completion system using the inner string operatively associated with the activator tool to operate at least a the portion of the completion system.

26. The method according to claim 25, comprising maintaining at least one of a body of the activator tool and the inner string operatively associated the activator tool in tension.

27. The method according to claim 25, wherein performance of the first operation of the downhole tool by pulling the actuator uphole activates a lock provided on at least one of the downhole tool and the actuator to restrict performance of the second operation of the downhole tool, and wherein changing the configuration of at least one of the actuator and the downhole tool deactivates the lock.

28. A downhole completion system, comprising:

a downhole system deployable into a wellbore, wherein the downhole system includes a completion system and an activator tool mounted within the completion system such that the completion system and the activator tool are deployed into the wellbore simultaneously, the completion system disposed on tubing, the activator tool operatively associated with an inner string located in the tubing, the activator tool and completion system arranged so that, on deploying the activator tool and the completion system downhole, the activator tool is located downhole from at least a portion of the completion system, wherein the activator tool is configured to be withdrawn from the completion system using the inner string operatively associated with the activator tool to operate at least the portion of the completion system.

29. The system of claim 28, wherein at least one of a body of the activator tool and the inner string operatively associated with the activator tool is arranged to be maintained in tension in use.

30. The system of claim 28, wherein the activator tool comprises an actuator according to claim 14.

31. The system of claim 28, wherein the activator tool is disposed on a tubular inner string.

32. The system of claim 28, wherein the activator tool comprises at least one of an upper shifter assembly comprising a key moveable between a radially retracted position and a radially extended position and a lower shifter assembly.

33. The system of claim 28, comprising an indicator, the indicator configured for electromagnetic coupling to an indicator of the downhole tool.

34. The system of claim 28, comprising a lock assembly.

35. The system of claim 28, comprising a downhole tool.

36. The system of claim 28, comprising a plurality of downhole tools.

37. The system according to claim 28, wherein the downhole tool and the actuator are provided with co-operable engagers for providing the selective engagement between the actuator and the downhole tool.

38. The system according to claim 28, comprising a lock provided on at least one of the completion system and the activator tool, wherein the lock is operable between an activated configuration in which performance of a second operation of the completion system is restricted and a deactivated configuration, wherein the lock is activated on performance of a first operation of the completion system and deactivated by changing the configuration of at least one of the activator tool and the completion system.

39. A method for operating a downhole tool, the method comprising the steps of:

(a) locating an actuator downhole from a downhole tool;

(b) pulling the actuator uphole;

(c) engaging the downhole tool with the actuator;

(d) pulling the actuator uphole to perform a first operation of the downhole tool;

(e) changing the configuration of at least one of the downhole tool and the actuator; and (f) pulling the actuator to perform a second operation of said downhole tool, wherein performance of the first operation of the downhole tool by pulling the actuator uphole activates a lock provided on at least one of the downhole tool and the actuator to restrict performance of the second operation of the downhole tool, and wherein changing the configuration of at least one of the actuator and the downhole tool deactivates the lock.

* * * * *